US007752960B2

(12) United States Patent
Toor et al.

(10) Patent No.: US 7,752,960 B2
(45) Date of Patent: Jul. 13, 2010

(54) HIGH-COMPRESSION BALER

(75) Inventors: Irfan A. Toor, Plano, TX (US); F. Scott Crawford, Carrollton, TX (US); Rick R. Redie, Richardson, TX (US); Ritchie G. Studer, Plano, TX (US)

(73) Assignee: RPP America, LLC, South Orange, NJ (US)

( * ) Notice: Subject to any disclaimer, the term of this patent is extended or adjusted under 35 U.S.C. 154(b) by 0 days.

(21) Appl. No.: 11/718,237

(22) PCT Filed: Jun. 12, 2006

(86) PCT No.: PCT/US2006/022903

§ 371 (c)(1),
(2), (4) Date: Jul. 3, 2007

(87) PCT Pub. No.: WO2006/135869

PCT Pub. Date: Dec. 21, 2006

(65) Prior Publication Data

US 2008/0257177 A1 Oct. 23, 2008

Related U.S. Application Data

(60) Provisional application No. 60/689,411, filed on Jun. 10, 2005.

(51) Int. Cl.
*B30B 5/04* (2006.01)
*B65B 63/04* (2006.01)

(52) U.S. Cl. ..... 100/88; 100/87; 53/215; 53/430; 53/438; 53/587

(58) Field of Classification Search ..... 100/87, 100/88; 56/341; 53/118, 176, 211, 215, 53/430, 438, 587
See application file for complete search history.

(56) References Cited

U.S. PATENT DOCUMENTS

| | | | | |
|---|---|---|---|---|
| 3,249,039 | A * | 5/1966 | Jonghe | 100/96 |
| 4,102,109 | A | 7/1978 | Modra et al. | |
| 4,172,677 | A * | 10/1979 | Gunti | 403/189 |
| 4,334,467 | A * | 6/1982 | Nishibe et al. | 100/89 |
| 4,352,267 | A * | 10/1982 | Mellinger | 56/341 |

(Continued)

FOREIGN PATENT DOCUMENTS

EP 574679 A1 * 12/1993

(Continued)

*Primary Examiner*—Jimmy T Nguyen
(74) *Attorney, Agent, or Firm*—Heimbecher & Assoc., LLC

(57) ABSTRACT

High-compression balers and methods for forming bales are disclosed. An exemplary baler 10 comprises a baling chamber 26 configured to receive the material. The baling chamber is formed by a pair of end plates 30*a*, 30*b* defining the longitudinal ends of the baling chamber, and a driven endless belt 28 guided by a plurality of rollers 36, 37, 40, 44, 50. The endless belt defines a periphery of the baling chamber. An exemplary method comprises providing an endless belt around at least a driven roller 40 and a tilt roller pair 36, 37, receiving the material in a baling chamber 26 through a throat 24 formed between the driven roller 40 and the tilt roller pair 36, 37, increasing the pressure applied by the endless belt 28 to the material, and securing the material in the baling chamber with netting 60 to form the bales 20.

16 Claims, 43 Drawing Sheets

U.S. PATENT DOCUMENTS

| | | | | |
|---|---|---|---|---|
| 4,763,464 | A | 8/1988 | Mouret | |
| 5,638,749 | A * | 6/1997 | Ansbjer et al. | 100/87 |
| 6,006,504 | A * | 12/1999 | Myers et al. | 53/556 |
| 6,321,507 | B1 * | 11/2001 | Copeland et al. | 53/118 |
| 6,336,306 | B1 | 1/2002 | Sieger et al. | |
| 6,530,311 | B1 * | 3/2003 | Wilkens et al. | 100/40 |
| 6,681,689 | B2 * | 1/2004 | Geiser | 100/88 |
| 6,715,410 | B2 | 4/2004 | Boucher et al. | |

FOREIGN PATENT DOCUMENTS

| | | | |
|---|---|---|---|
| WO | WO 01/76858 | A1 | 10/2001 |
| WO | WO 2005/041640 | A1 * | 5/2005 |

* cited by examiner

HIGH-COMPRESSION BALER

CROSS-REFERENCE TO RELATED APPLICATIONS

This application is a national stage filing based upon international application no. PCT/US2006/022903, filed 12 Jun. 2006 and published in English on 21 Dec. 2006 under international publication no. WO 2006/135869 A2, which claims priority to U.S. provisional patent application No. 60/689,411, filed 10 Jun. 2005. This application is also related to U.S. provisional patent application No. 60/681,896, filed 16 May 2005; international patent application no. PCT/US2006/019117, filed 16 May 2006; and to U.S. nonprovisional application Ser. No. 09/980,527, filed 29 Apr. 2002, now U.S. Pat. No. 6,971,220 B1. Each of these applications is hereby incorporated by reference as though fully set forth herein. This application is also related to U.S. nonprovisional application Ser. No. 11/914,555, which entered the United States national state on 15 Nov. 2007 from international application no. PCT/US2006/019117, now pending.

BACKGROUND OF THE INVENTION a. Field of the Invention

The instant invention relates to a bale press for baling a wide variety of materials and to a method of compressing a wide variety of materials into bales. In particular, the instant invention relates to bale presses and related methods for making cylindrical bales.

b. Background Art

It is well known that refuse may be compressed into bales, such as for transport, to burn for energy generation, or for disposal. Thus, the bales allow the refuse to be held together and to maintain its caloric value until the refuse is burned. In U.S. Pat. No. 6,336,306 (the '306 patent), for example, a round bale press or baler is disclosed including an endless belt guided around a plurality of deflection rollers via a pair of disk-like side walls or end plates defining a compression chamber. Refuse is fed into the compression chamber via a feed aperture and compacted into a round bale. A yarn or net web is unwound around a roller and into the compression chamber to pre-secure the compressed bale. The pre-secured bale may then be delivered to a wrapping apparatus to be fully enveloped in film, or the pre-secured bale may then be transported, burned, or otherwise disposed of as is. The endless belt comprises a segment pivotable out of a closed configuration suitable for compacting refuse to an open configuration suitable for discharging the pre-secured round bale from the compression chamber and conveying the bale to a wrapping table.

For some applications, the baling process is most cost-effective when the bales are, for example, efficiently and rapidly compacted to a high density. Where the bales are to be disposed of in a landfill, for example, it is valuable to maximize use of the available landfill volume by more tightly compacting each bale so as to increase the amount of refuse that can be stored in the same volume of the landfill. In addition, the less time it takes to produce each bale, the faster, more efficient, and cost-effective the waste disposal process becomes.

While round bale presses such as the one disclosed in the '306 patent provide round bales of compacted refuse that may be transported, burned, or otherwise disposed of, problems often arise when the bales are compacted at increased compression and/or higher speeds. Where the compression of the refuse in the compression chamber of a round bale press is increased, for example, refuse often "boils" at the feed aperture or "throat" of the compression chamber as the hard-packed bale in the compression chamber prevents the new refuse from entering the compression chamber. In addition, as bale compression increases in existing bale presses, the bale itself may bulge out at the feed aperture of the compression chamber. Before desirable bale densities can be reached, the bulge can get large enough that the bale is prevented from easily rotating within the compression chamber, and the motors driving the endless belt may stall or fail prematurely. Merely increasing the size or horsepower of the drive motor or motors may not overcome this stalling tendency and may unnecessarily increase the size and/or cost of the bale press.

Where the production speed of the bale press is increased, other problems are often created. For example, until enough refuse is in the compression chamber, the refuse rolls or tumbles around the chamber, similar to clothing in a dryer, without being compressed. Thus, wasted time and energy is used operating the bale press until the chamber is sufficiently full so that the refuse starts to be compacted. In addition, as the speed of the bale press is increased, the tendency of the yarn or net web to skew to one end of the roller may increase. A skewed web may, for example, insufficiently secure the bale so that as the bale exits the bale press, the bale falls apart and the bale press must be stopped to clean up the refuse that has separated from the bale. The skewed web may also catch on a portion of the compression chamber and jam the bale press. Again, the bale press must be stopped to clear the jam and realign the web. Time lost cleaning a busted bale from the bale press and realigning the web is time that could have been used to form more bales.

Further, as the pivotable segment of the endless belt opens, the kinetic energy of the bale may cause unloading problems if the bale is allowed to roll out of the compression chamber of the bale press.

Thus, it remains desirable to have a bale press that operates at high speed while creating high-density bales that may be efficiently unloaded from the bale press.

BRIEF SUMMARY OF THE INVENTION

It is desirable to have high-speed, high-compression balers capable of reliably producing high-density bales. Baled waste reduces or altogether eliminates odor and contamination issues, such as, blowing debris during transport and at the waste disposal facility. In addition, the shipping containers or vehicles used for transporting the waste may be reused, and may even be used for other purposes, without extensive cleaning or decontamination.

An exemplary baler for compressing material into bales comprises a baling chamber configured to receive the material. The baling chamber is formed by a pair of end plates limiting opposite end faces of the baling chamber, and a driven endless belt guided by a plurality of rollers. The endless belt extends around the end plates and limits a periphery of the baling chamber.

Other embodiments of the baler may include a "tailgate" pivotably connected to a baler frame adjacent to the baling chamber, the tailgate being lowerable to unload a precursor bale formed in the baling chamber. A tilt roller pair may be provided which controls movement of the precursor bale so that it does not inadvertently roll off of the tailgate while unloading the precursor bale off of the tailgate.

An exemplary method for compressing material into bales comprises providing an endless belt around at least a driven roller and a tilt roller pair, receiving the material into a baling chamber through a throat formed between the driven roller and the tilt roller pair, increasing pressure being applied by the endless belt to the material in the baling chamber to form a bale, and securing the compressed material while the material is still in the baling chamber with netting to form the precursor bales.

An exemplary configurable baling system for producing bales with a variety of densities, lengths, and diameters is also disclosed. The configurable baling system comprises chamber means for receiving material. The chamber means is formed by adjustable end plate means for limiting opposite end faces of the chamber means. The chamber means is also formed by adjustable belt means for limiting a periphery of the chamber means. The configurable baling system also comprises means for securing the material before an unloading operation from the chamber means.

The foregoing and other aspects, features, details, utilities, and advantages of the present invention will be apparent from reading the following description and claims, and from reviewing the accompanying drawings.

DETAILED DESCRIPTION OF THE INVENTION

The balers of the present invention are configured to provide high-density bales of a variety of different possible materials including, for example, municipal solid waste (MSW), construction and demolition waste, medical and other hazardous waste, mine trailings, dirt, agricultural products, and anything else that needs to be efficiently contained, moved, stored, or disposed of. As explained further below, the balers according to the present invention are highly configurable and are thus capable of producing bales of a wide variety of bale densities, lengths, and diameters. These balers include special hardware and process control features that allow a user to select or "dial in" desired bale parameters and then produce the desired bales at high speeds with minimal interruptions. If desired, these balers can produce a hermetically sealed, essentially self-contained bale that facilitates easy movement of a high volume of material to, for example, a landfill, if the baled material will be disposed of, or to a power plant, if the baled material will be used in the production of energy for delivery to consumers and businesses. These balers are particularly beneficial when a large volume of any type of material needs to be packaged in a secure and portable configuration. For situations where the materials to be baled may be moist and would thus produce undesirable leachate if the materials were compressed using various conventional balers, the production of undesirable leachate may be controlled via the process and the film wrapping that are both used by the balers according to the present invention. In particular, the tumbling and pressing actions tend to disperse any moisture contained within the materials being baled throughout the bale, while the film wrapping contains the remaining moisture within the bale.

Figure 1:
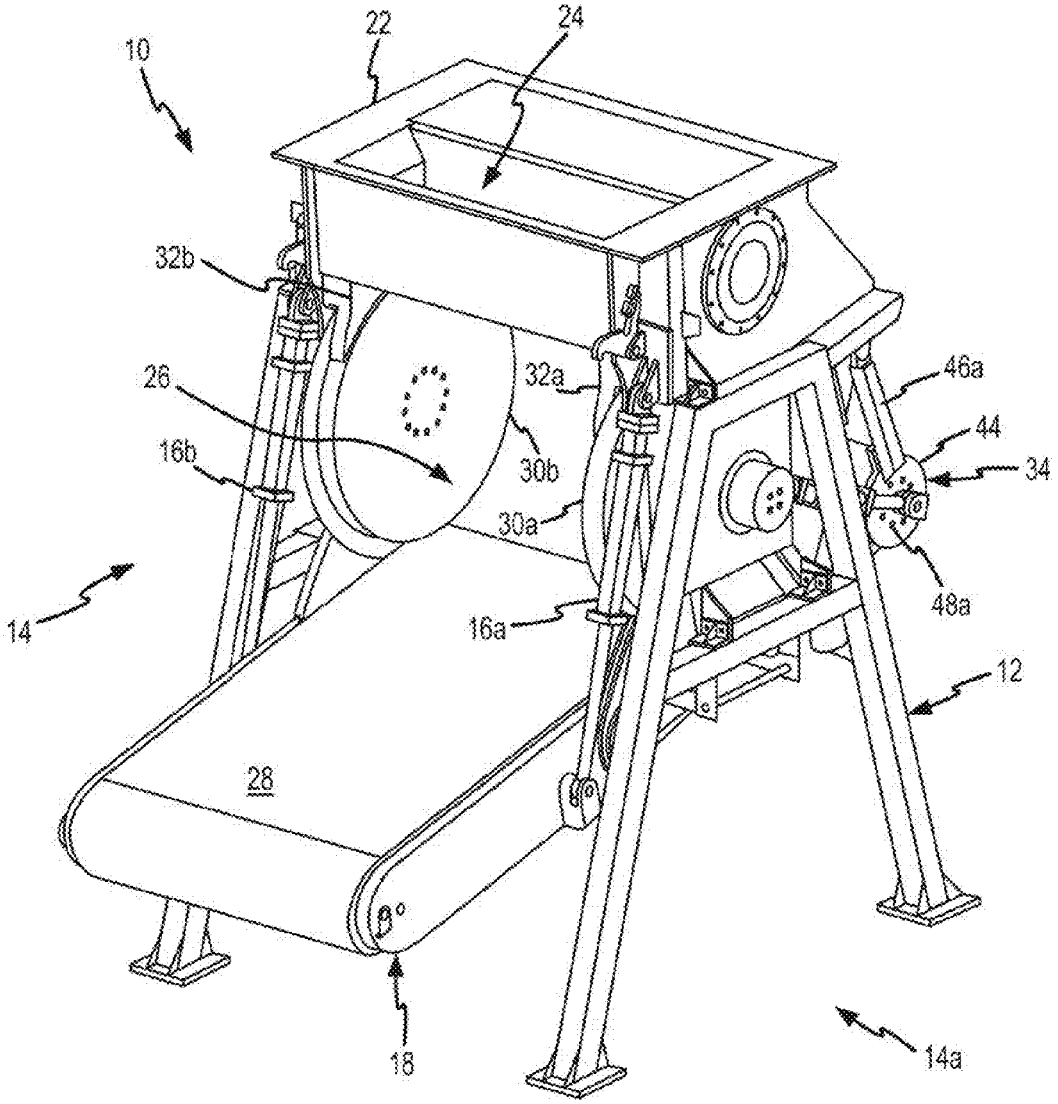
FIG. 1 is an isometric view of the front and right side of a baler according to a first embodiment of the present invention, shown with a baler tailgate in a fully-open configuration.
Figure 20:
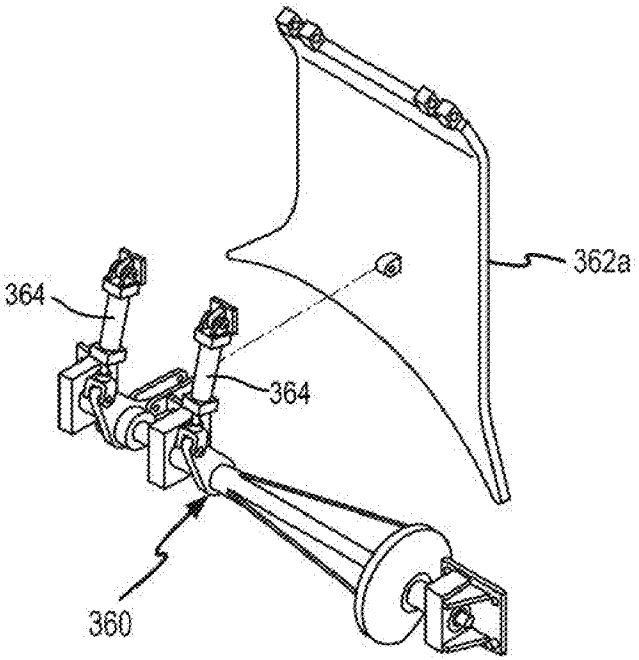
FIG. 20 is an isometric view depicting a bale chamber swing plate and a swing plate movement mechanism comprising a pair of hydraulic rams exploded away from the swing plate.
Figure 22:
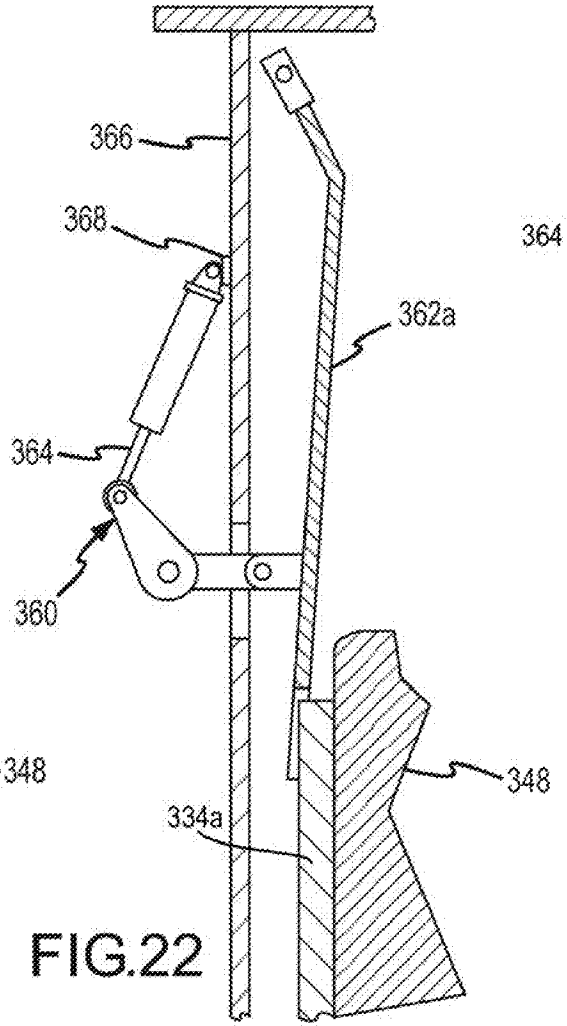
FIG. 22 is similar to FIG. 21, but depicts the swing plate configured or positioned to provide less clamping or holding force to the longitudinal end of the precursor bale, permitting delivery of the bale from the baling chamber.
Figure 21:
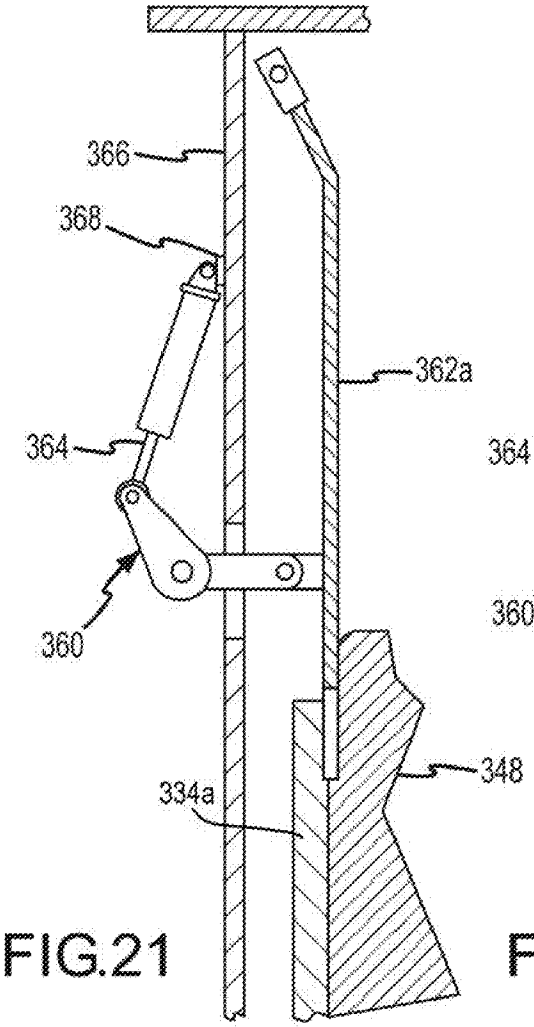
FIG. 21 is a fragmentary, cross-sectional view of the swing plate movement mechanism depicted in FIG. 20 with the swing plate positioned tightly against one longitudinal end of the precursor bale.

FIGS. 1-8 depict a baler 10 according to a first embodiment of the present invention in various operating configurations. In FIG. 1, the baler 10 according to the first embodiment is shown in an isometric view of the front 14 and right side 14*a* of the baler 10. In this particular embodiment, a pair of hydraulic rams 16*a*, 16*b* are used to open a "tailgate" 18 that permits a formed bale (e.g., bale 20 in FIG. 7) to be dispatched from the baler 10. In FIG. 1, this tailgate 18 is shown in its fully-open configuration. During the creation of a bale 20, the tailgate 18 is moved to its fully-closed configuration (see, e.g., FIGS. 2-6). The material to be baled is introduced into the baler 10 at a feed opening or throat 22 defining an entry path 24 into the baler 10. A baling chamber 26 is formed when the tailgate 18 is fully-closed by an endless compression belt 28 and end plates 30*a*, 30*b*. Also visible in FIG. 1 and, for example, FIGS. 20-22, are a pair of swing plates or panels 32*a*, 32*b* that help guide the material to be baled into the space between the end plates 30*a*, 30*b* of the baling chamber 26. As explained further below, these swing plates or panels 32*a*, 32*b* may also be used to keep the bale 20 from immediately rolling out of the baling chamber 26 as the tailgate 18 is moved from its fully-closed position to its fully-open position. Along the right-hand edge of FIG. 1, it is also possible to see the tensioner assembly 34, which is used to control the amount of tension in the endless compression belt and thus the density of the bale 20 that is ultimately formed in the baling chamber 26.

Figure 2:
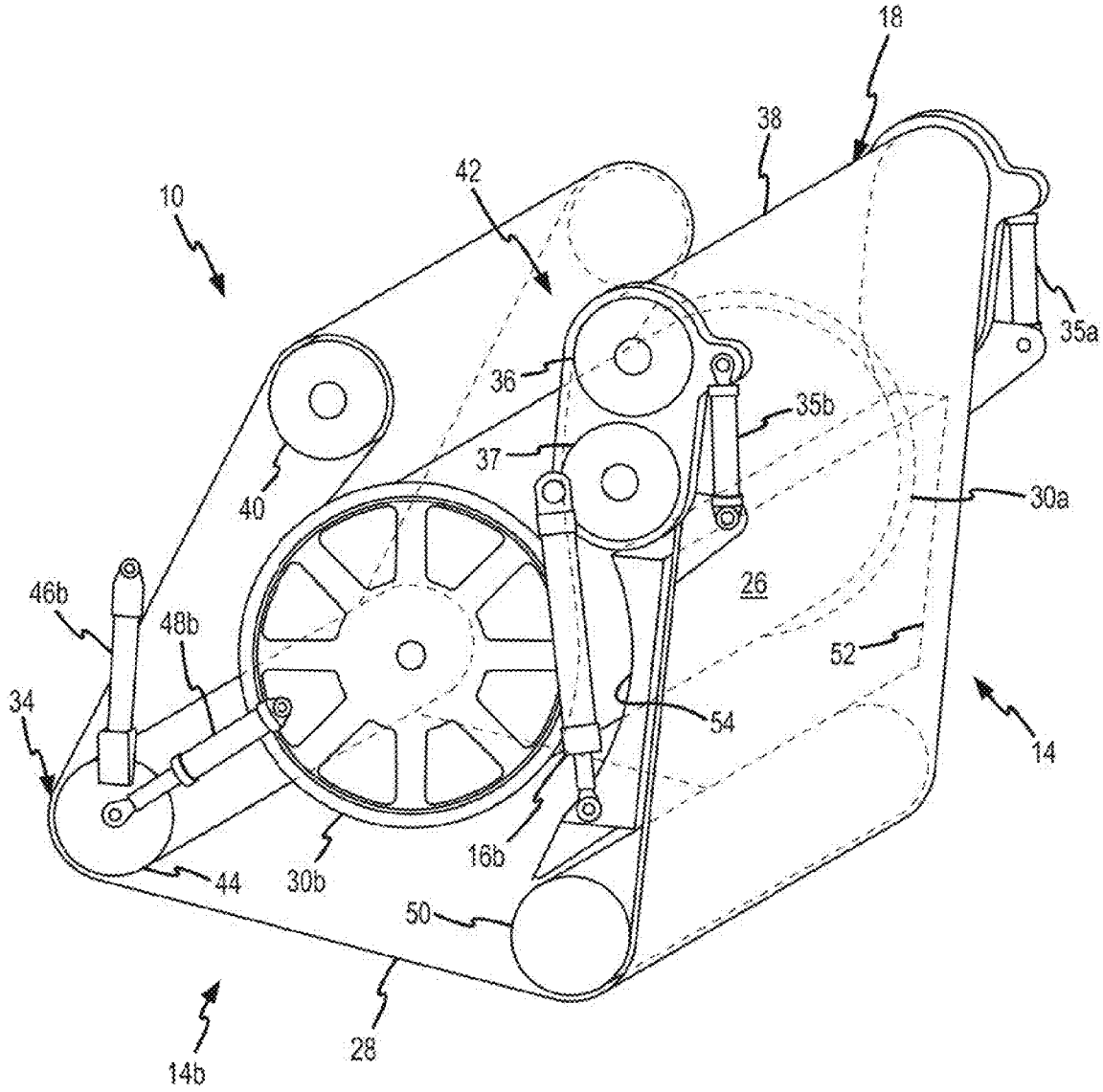
FIG. 2 is an isometric view of the front and left side of the baler depicted in FIG. 1 with various components removed for clarity and clearly showing a tilt roller pair adjacent to a distal edge of the tailgate, the tilt roller pair including a distal tilt roller and a proximal tilt roller.

FIG. 2 is a schematic, isometric view of the left side 14*b* and front 14 of the baler 10 depicted in FIG. 1. In FIG. 2, however, the support frame 12 and several other features and components of the baler 10 shown in FIG. 1 have been removed to more clearly show the rollers or cylinders and the path of the endless compression belt 28 used to form the bales 20. In the upper right-hand portion of FIG. 2, a pair of tilt rollers or idler rollers 36, 37 are visible. In particular, a distal tilt roller 36 is present adjacent to the distal edge 38 of the tailgate 18 and a proximal tilt roller 37 is immediately adjacent to the distal tilt roller 36. As explained further below in connection with some of the other figures, the tilt roller pair 36, 37 may be tilted toward and away from the baling chamber 26 by a pair of tilt rams 35*a*, 35*b*. To the left of the tilt roller pair 36, 37 in FIG. 2, is a driven roller or cylinder 40. After the endless compression belt travels 28 over the tilt roller pair 36, 37, it extends around the outer circumference of the end plates 30*a*, 30*b* and then around the driven roller 40. The gap 42 that can be seen between the tilt roller pair 36, 37 and the driven roller 40 defines the material entry path or throat 24 through which materials to be baled are introduced into the baling chamber 26.

The endless belt 28 then travels around the tensioner assembly 34 that includes another roller or cylinder 44. This tensioner roller 44 is pivotably mounted by a pair of arms 46*a*, 46*b* (arm 46*a* is visible in FIG. 1 and arm 46*b* is visible in FIG. 2) that are bolted to the support frame 12. A pair of tensioner rams 48*a*, 48*b* (ram 48*a* is visible in FIG. 1 and ram 48*b* is visible in FIG. 2) may be activated to move the tensioner roller 44 leftward or rightward in FIG. 2. This motion of the tensioner roller 44 changes the length of the path that the endless compression belt 28 must follow, thereby increasing or decreasing the amount of pressure being applied to the material in the baling chamber 26. In the embodiment depicted in FIG. 2, an idler roller 50 is also present. This latter idler roller 50, which is shown in FIG. 2 as the lower right-hand roller 50, may be a driven roller that could be used in conjunction with the driven roller 40 shown in the upper left-hand portion of FIG. 2, or it could be used as a backup driven roller. Also shown substantially in phantom in FIG. 2 is a shaping plate 52 that extends between the tilt roller pair 36, 37 and the idler roller 50. This shaping plate 52 includes a contoured surface 54 that helps form the curved side wall of the cylindrical bale 20 formed in the baler 10.

Figure 3:
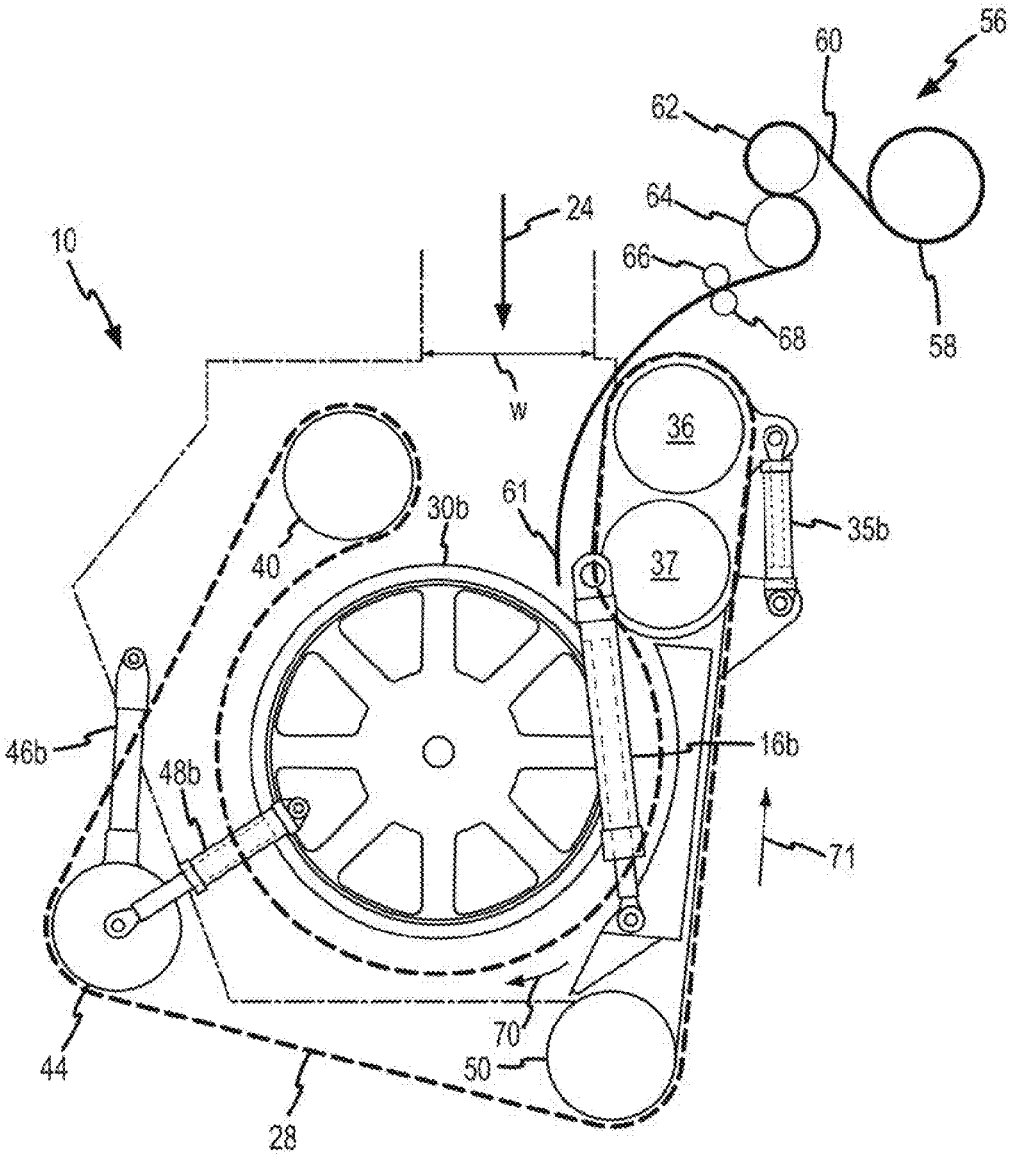
FIG. 3 is a schematic left side view of the baler depicted in FIGS. 1 and 2 during the initial phase of bale formation, and depicts a first embodiment for a securement netting delivery system.

FIG. 3 is a schematic cross-sectional view of the baler 10 of FIGS. 1 and 2 during the initial phase of a bale formation cycle. In this initial configuration, the entry path or throat 24 of the baler 10 is in its least constricted configuration. The width W of entry path 24 may be, for example, approximately thirty-one inches. FIG. 3 also shows in cross-section a first possible embodiment of a securement netting delivery system 56. In this particular embodiment, the delivery system 56 comprises a netting supply roller 58, which dispenses yarn or netting 60 for initial securement of the baled materials to form a "precursor bale" (i.e., a bale that is not completely enveloped in film or foil since its longitudinal ends remain uncovered). In particular, the netting 60 travels over a first netting roller 62, which may be smooth, then a second netting roller 64, which may include grooves or helical channels to help spread the netting 60 toward the longitudinal ends of the first and second netting rollers 62, 64, respectively, as explained further below. In the embodiment depicted in FIG. 3, the smooth netting roller 62 and the grooved netting roller 64 are directly adjacent to each other, but need not be (see, e.g., the alternative embodiment shown in FIG. 6 where there is a gap between these two rollers). The netting 60 next travels between a pinch roller 66 and a driven roller 68, which pull the netting 60 off of the netting supply roller 58 and around both the smooth netting roller 62 and the grooved netting roller 64. The driven roller 68 may include, for example, a neoprene surface to help this roller 68 trap the netting 60 against the pinch roller 66 making it possible for the driven roller 68 to thereby pull the netting 60 off of the supply roller 58. The free end 61 of the netting 60 is thereby fed into the baling chamber 26 as shown in FIG. 3. In particular, during the formation of a bale 20, the belt 28 moves in the direction of the arrows 70, 71 shown in FIG. 3. Thus, as the baling chamber 26 begins to fill with material, the free end 61 of the securement netting 60 eventually gets trapped and pulled into and around the formed bale 20. As explained further below, this netting 60 thus makes it possible to keep the baled materials together until the precursor bale (i.e., the bale that has been formed and then wrapped with one or more layers of netting 60) is delivered to, for example, a wrapping station.

Figure 4:
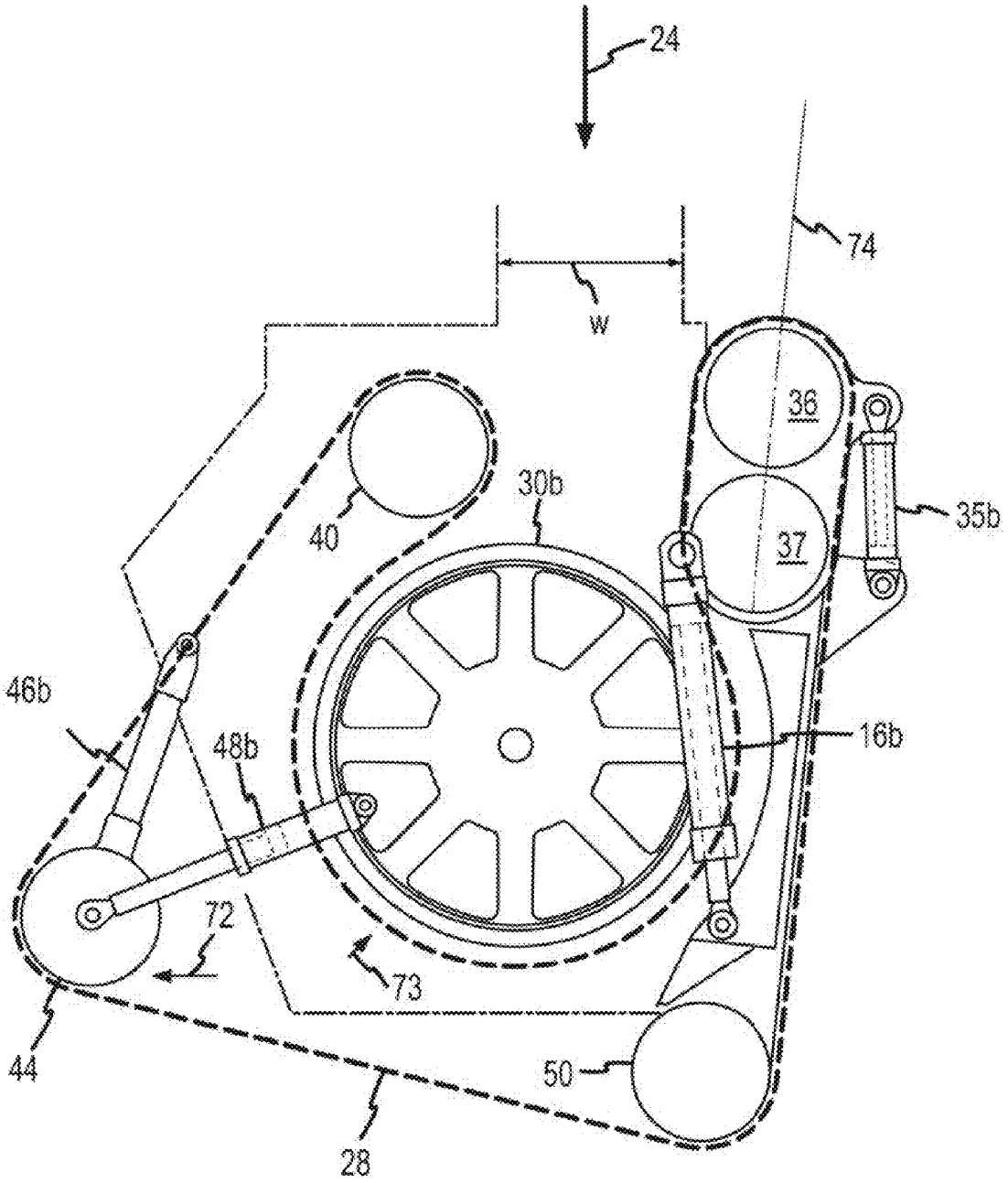
FIG. 4 is similar to FIG. 3, but depicts the baler of FIGS. 1-3 during an intermediate phase of the compression cycle.

FIG. 4 is similar to FIG. 3. However, in FIG. 4, the tensioner rams 48*a*, 48*b* have been extended slightly, thereby driving the tensioner roller 44 in the direction of the arrow 72 shown in the lower left-hand portion of FIG. 4. This movement of the tensioner roller 44 increases the length of the circuitous pathway followed by the endless compression belt 28. This, in turn, moves the endless compression belt 28 in the direction of the small arrow 73 adjacent to the baling chamber end plate 30*b* shown in FIG. 4. When the belt 28 moves in this direction, it compresses the material in the baling chamber 26. In particular, the material in the baling chamber 26 is moved upward and rightward in FIG. 4 towards the proximal tilt roller 37 (an idler roller), which acts as a compression roller when the baler 10 is in this configuration. Thus, the material being fed into the throat 24 of the baler 10 is being pressed by the upward and rightward motion of the belt 28 against the proximal tilt roller 37 and the outer surface of the bale 20 that is being formed. In a typical operation, the belt speed is set such that the material forming the bale passes by the proximal tilt roller 37, in this configuration, between ten and forty times per minute. In other words, the proximal tilt roller 37 potentially acts on or presses against each point on the outer surface of the cylindrical bale 20 ten to forty times per minute, which evenly distributes the material in the bale 20, including any potential moisture in the materials that are being baled.

Figure 5:
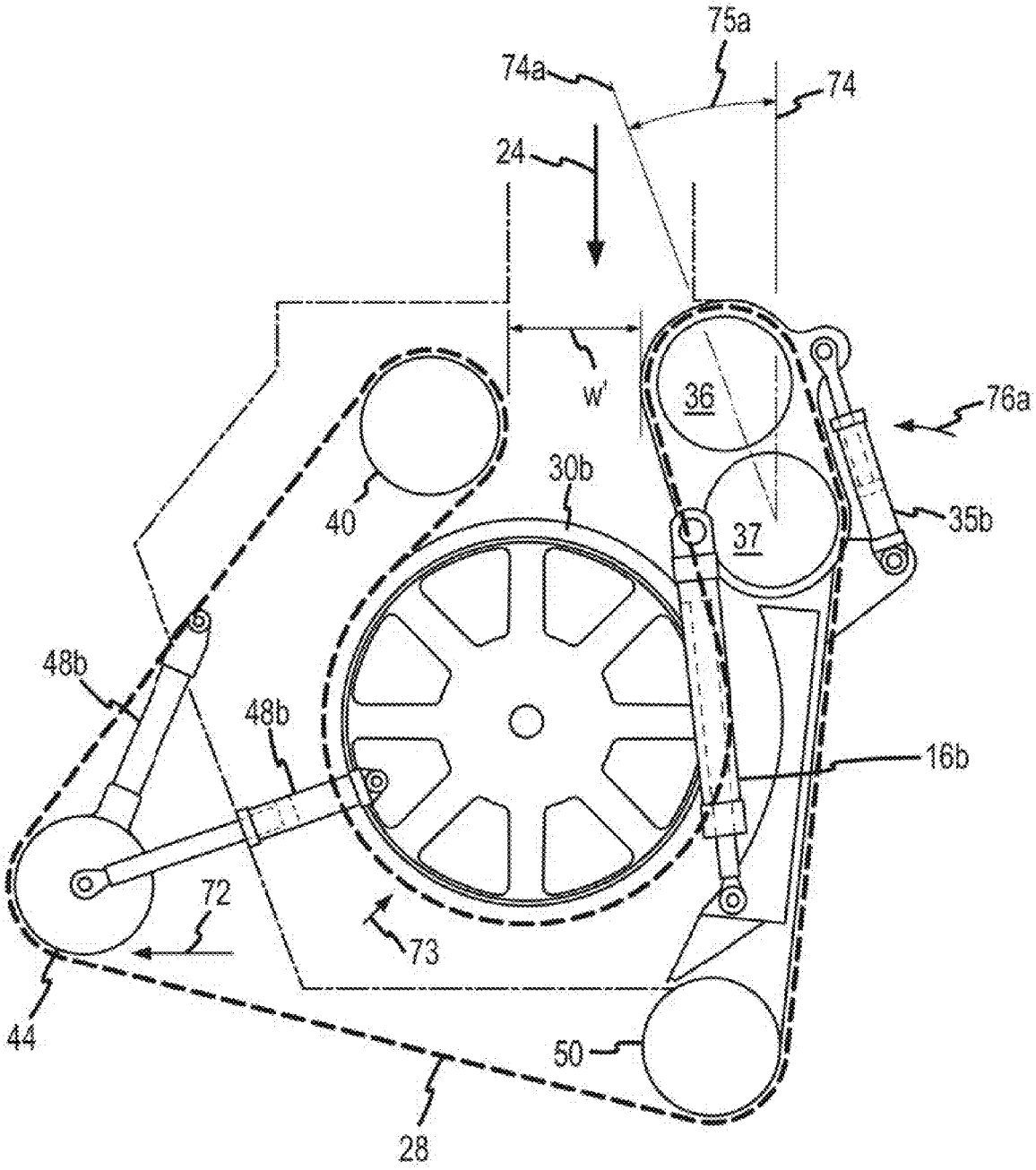
FIG. 5 is similar to FIG. 4, depicting the baler of FIGS. 1-4 during a later intermediate phase of a baler cycle, with the tilt roller pair adjacent to the distal edge of the tailgate rotated slightly inward toward the hale being formed.

In FIG. 5, the tensioner rams 48*a*, 48*b* have been extended even further, thereby driving the tensioner roller 44 again in the direction of the arrow 72 shown in the lower left-hand portion of FIG. 5. This, in turn, further lengthens the path that the endless compression belt 28 must follow, which causes the belt to further compress the material in the baling chamber 26. At this point in the process, the pressures inside of the baling chamber 26 has increased substantially. Material being fed into the throat 24 of the baler 10 may experience difficulty being incorporated into the bale 20. In other words, the newly introduced materials may tend to sit in the gap formed between the tilt roller pair 36, 37 and the driven roller 40, thereby "boiling" or churning without being drawn into the bale 20 itself.

In order to deliver more frictional force to these materials, thereby making it possible to pull them into the baling chamber 26, tilt rams 35*a*, 35*b* may be operated to angle or tilt the tilt roller pair 36, 37 in the direction indicated by arrow 76*a* toward the baling chamber 26 through angle 75*a* in FIG. 5. In particular, the nearly vertical line 74 in the upper right-hand portion of FIG. 5 represents the edge of a plane extending through the longitudinal centroids of the tilt rollers or cylinders 36, 37 when in their initial configuration shown in FIGS. 3 and 4. In the configuration depicted in FIG. 5, with the tilt roller pair 36, 37 is leaning or tilting toward the baling chamber 26 as indicated by line 74*a*, which represents the edge of a plane extending through the longitudinal centroids of the tilt rollers or cylinders 36, 37. In this tilted configuration, more useful friction is generated by the endless compression belt 28 and may be delivered to the material to be ingested into the baling chamber 26. Thus, as the bale density increases, thereby making it more difficult to pull additional material into the baling chamber 26, the deflection or tilting of tilt rollers 36, 37 makes it possible to deliver additional frictional force to the material so that that material may be actually pulled into or ingested into the bale 20. The rate at which this deflection is accomplished and the ultimate deflection angle achieved, is fully controllable by the operator of the baler 10.

As may be clearly seen by comparing the throat size W in FIGS. 3 and 4 to the throat size W' in FIG. 5, when the tilt roller pair 36, 37 is leaned toward the compression chamber 26, the entry path or throat 24 available for introducing additional material to the baling chamber 26 is reduced. For example, the throat size W may be on the order of thirty-one inches in FIGS. 3 and 4, whereas in the configuration of FIG. 5, the throat size W' may be reduced down to twenty-four inches. At this point in the process, the reduction in the size of the entry path 24 is less critical than the need to increase the force delivered to the material to be ingested. In particular, since the bale 20 is substantially formed, the amount of material being delivered has decreased. Thus, the reduction in the size of the entry path 24 is tolerable.

Figure 6:
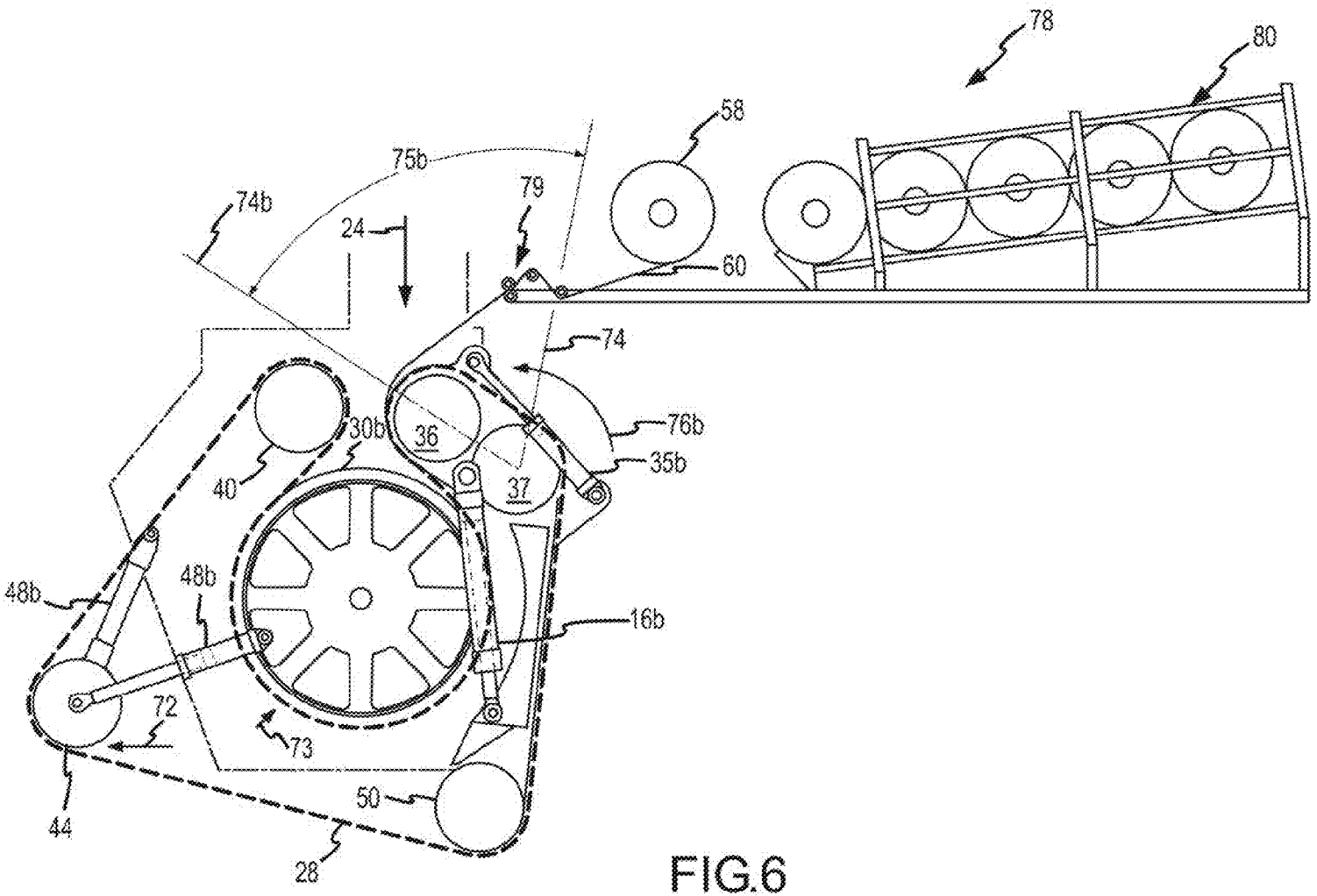
FIG. 6 is similar to FIGS. 3-5, but depicts the tilt roller pair along the distal edge in the tailgate rotated to its maximum inward position, and depicts a second embodiment of a securement netting delivery system.

As shown in FIG. 6 which is similar to FIGS. 3 and 4, as the process progresses further, the tensioner rams 48*a*, 48*b* reach maximum extension (i.e., the maximum extension capable or the maximum extension requested by the controller). At this point, the bale density is reaching the maximum possible density or the maximum target density. As discussed above in connection with FIG. 5, as the bale density increases, it also becomes increasingly difficult to ingest additional material into the bale 20. Thus, in response, tilt rams 35*a*, 35*b* may be operated to further lean or rotate the tilt roller pair 36, 37 in the direction of arrow 76*b* toward the compression chamber 26 as indicated by line 74*b*, which represents the edge of a plane extending through the longitudinal centroids of the tilt rollers 36, 37. In FIG. 6, for example, the lean angle or tilt angle 75*b* of the tilt roller pair 36, 37 may be on the order of 60°. At this point, very little additional material is being introduced into the bale 20. Thus, the fact that this further restricts the throat or entry path 24 available for material to be introduced into the bale 20 does not create a problem. With the tilt rollers 36, 37 in this configuration, however, the maximum amount of frictional force may be delivered to any material in the gap between the tilt roller pair 36, 37 and the driven roller 40, thereby making it possible to pull this last material into the bale 20.

FIG. 6 also shows a second embodiment of a securement netting delivery system 78. This securement netting delivery system 78 is similar to the system 56 depicted in, for example, FIG. 3. However, the netting rollers 79 are further offset from the configuration of the netting rollers depicted in FIG. 3, and the netting 60 coming off of the netting supply roller 58 is threaded through the netting rollers 79 differently. The securement netting delivery system 78 depicted in FIG. 6 also include a securement netting supply rack 80 to keep a supply of securement netting 60 conveniently available. Although not shown in FIGS. 3 and 6, a cutter is also provided to cut the securement netting 60 after the precursor bale has been formed. The securement netting 60 may, for example, be cut prior to the tailgate 18 being opened, as the tailgate 18 is being opened, or after the tailgate 18 has been opened but before the precursor bale has been removed from the baler 10.

Figure 7:
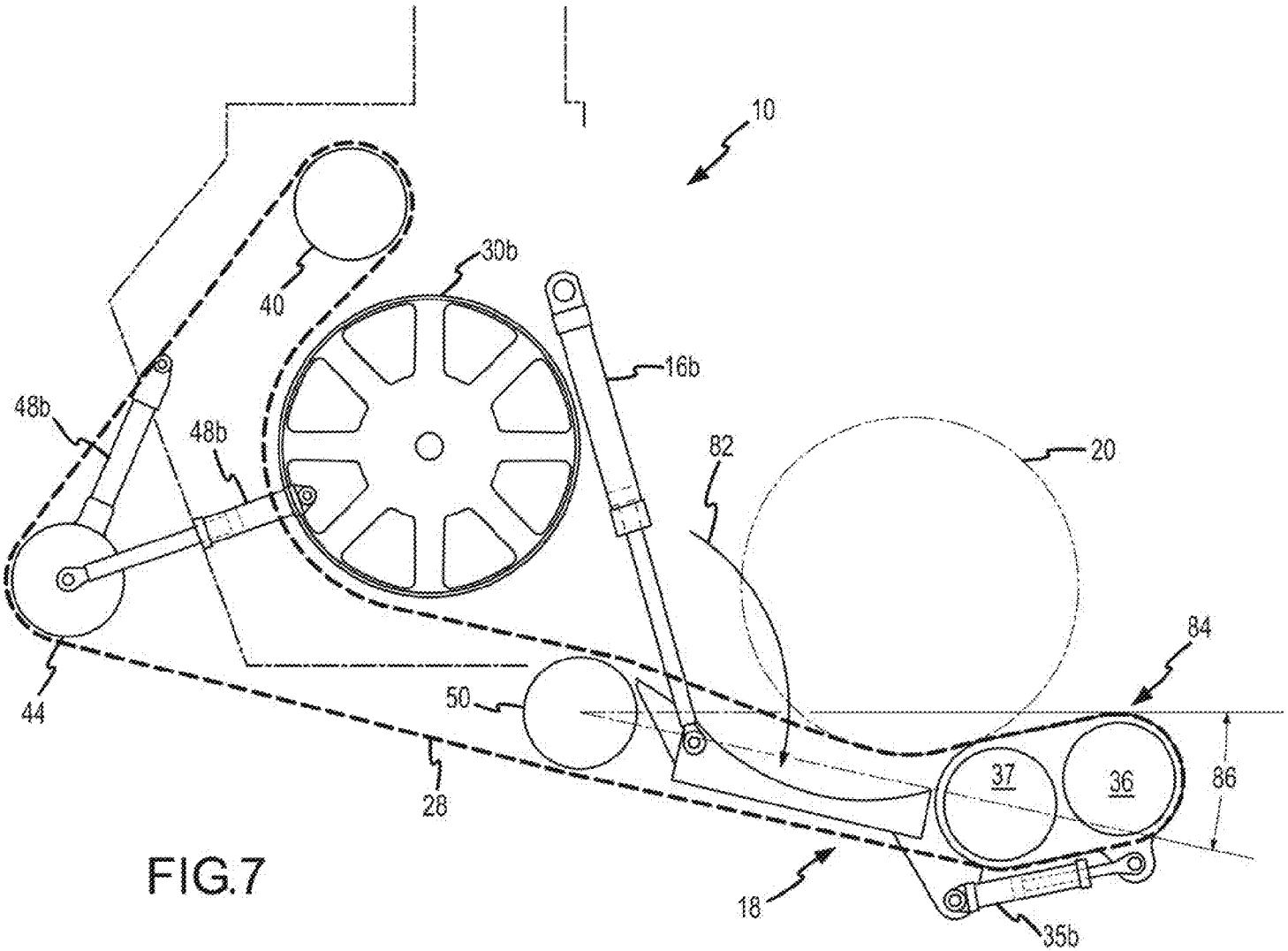
FIG. 7 depicts the baler of FIGS. 1-6 just after the tailgate has opened to facilitate bale extraction or removal.

FIG. 7 depicts the baler of FIGS. 1-6 with the tailgate 18 rotated in the direction of arrow 82 to its fully-open configuration. In particular, when the tailgate rams 16*a*, 16*b* are activated and extend, the tailgate 18 is pivoted from the fully-closed configuration depicted in FIGS. 3-6 to the fully-open configuration depicted in FIG. 7. A formed and "secured" bale 20 is shown in FIG. 7 in phantom. This bale comprises a highly compressed mass of material that is being held in a "precursor" bale configuration by the securement netting 60. The amount of securement netting 60 delivered to the outer surface of the bale 20 depends upon the material from which the netting is formed, the density of the bale 20, the type of material that has been baled, and potentially a number of other factors.

As shown in FIG. 7, when the tailgate 18 initially opens, the formed precursor bale 20 is supported on the endless compression belt 28 and is prevented from rolling off of the baler 10 by the rotated tilt roller pair 36, 37. In particular, the tilt roller pair 36, 37 may remain in the configuration depicted in FIG. 6 as the tailgate 18 is opened, or the tilt roller pair 36, 37 may be rotated back to an intermediate angle 74*a* like that shown in FIG. 5 before or as the tailgate 18 is opened. Either way, the tilt roller pair 36, 37 prevents the bale 20 from rolling off of the distal edge 84 of the tailgate 18 until an appropriate time. In the embodiment depicted in FIG. 7, the tailgate slope angle 86 may be greater than what has been possible with prior art configurations. For example, the tailgate slope angle 86 may be on the order of 12°, which, as described below in connection with FIG. 8, facilitates easy movement of the precursor bale 20 off of the tailgate 18.

Figure 8:
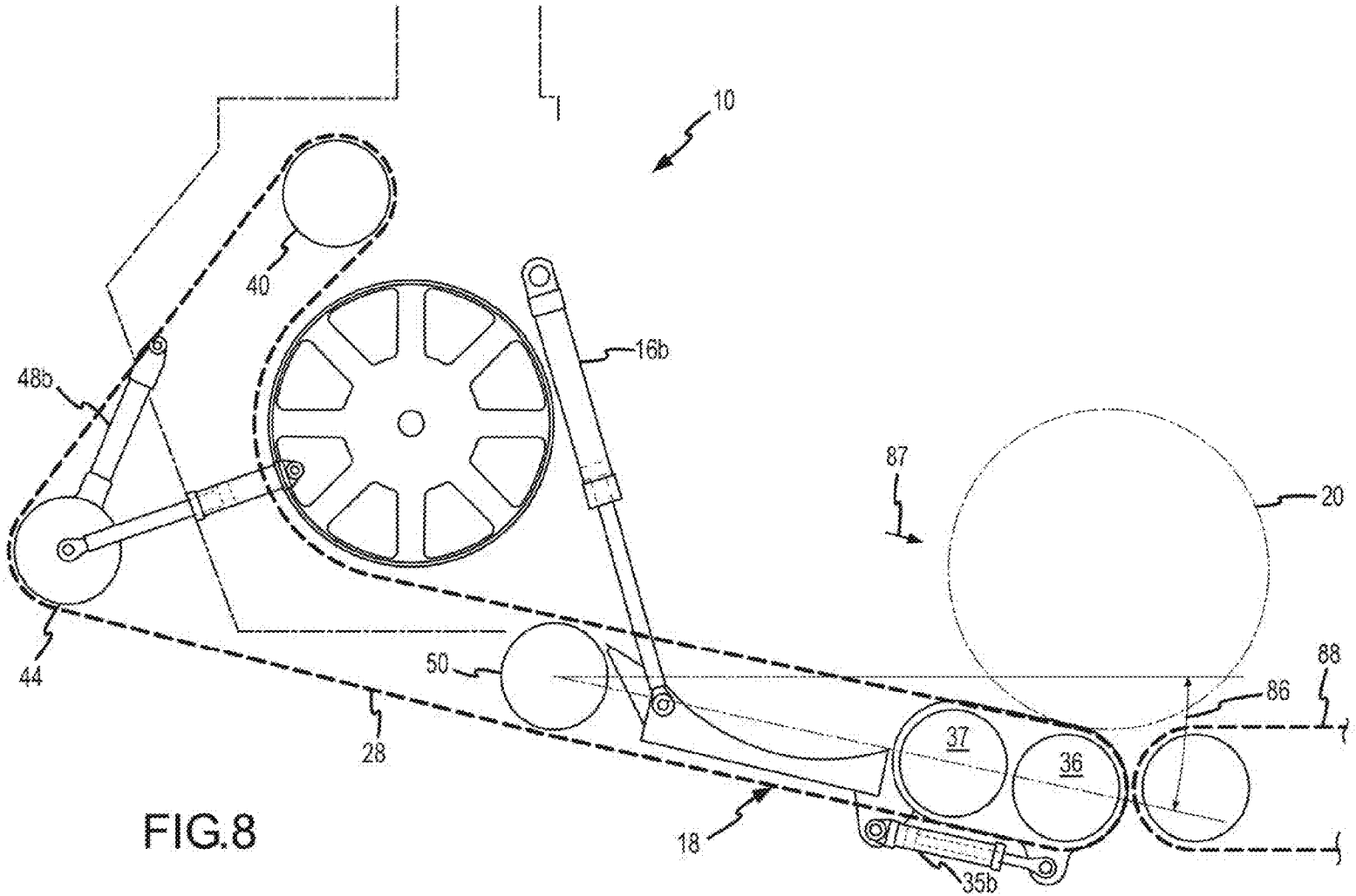
FIG. 8 is similar to FIG. 7, but depicts the baler of FIGS. 1-7 with the tailgate in a fully-open configuration and with the tilt roller pair rotated to permit transfer of the completed bale off of the tailgate and onto an adjacent transfer belt or wrapping table.

In FIG. 8, the precursor bale 20 is being delivered in the direction of arrow 87 to an adjacent transfer belt or wrapping table 88. In particular, by comparing FIGS. 7 and 8, it is possible to see that the tilt rams 35*a*, 35*b* have been activated to rotate the distal tilt roller 36 clockwise relative to the proximal tilt roller 37, which in turn lets the precursor bale 20 roll off of the tailgate 18 to the waiting transfer belt or wrapping table 88. Since the tilt roller pair 36, 37 makes it possible to control the movement of the precursor bale 20 (e.g., it makes it possible to keep the precursor bale 20 from inadvertently rolling off of the tailgate 18), it is possible with this configuration to unload the precursor bale 20 off of the tailgate 18 without movement of the endless compression belt 28. Without the tilt roller pair 36, 37, it can be problematic to achieve the tailgate slope angle 86 depicted in FIGS. 7 and 8. If, in turn, it is not possible to lower the tailgate 18 as far as what is shown in FIGS. 7 and 8, the trough or depression in which the bale 20 is shown in phantom in FIG. 7, may become much deeper. As explained further below in connection with, for example, FIGS. 36A-38B, the deeper this trough is and the shallower the tailgate slope angle 86, the more difficult it may be to remove the bale 20 from the tailgate 18, and the more damaging the process can be on the equipment, particularly the endless compression belt 28.

Figure 9:
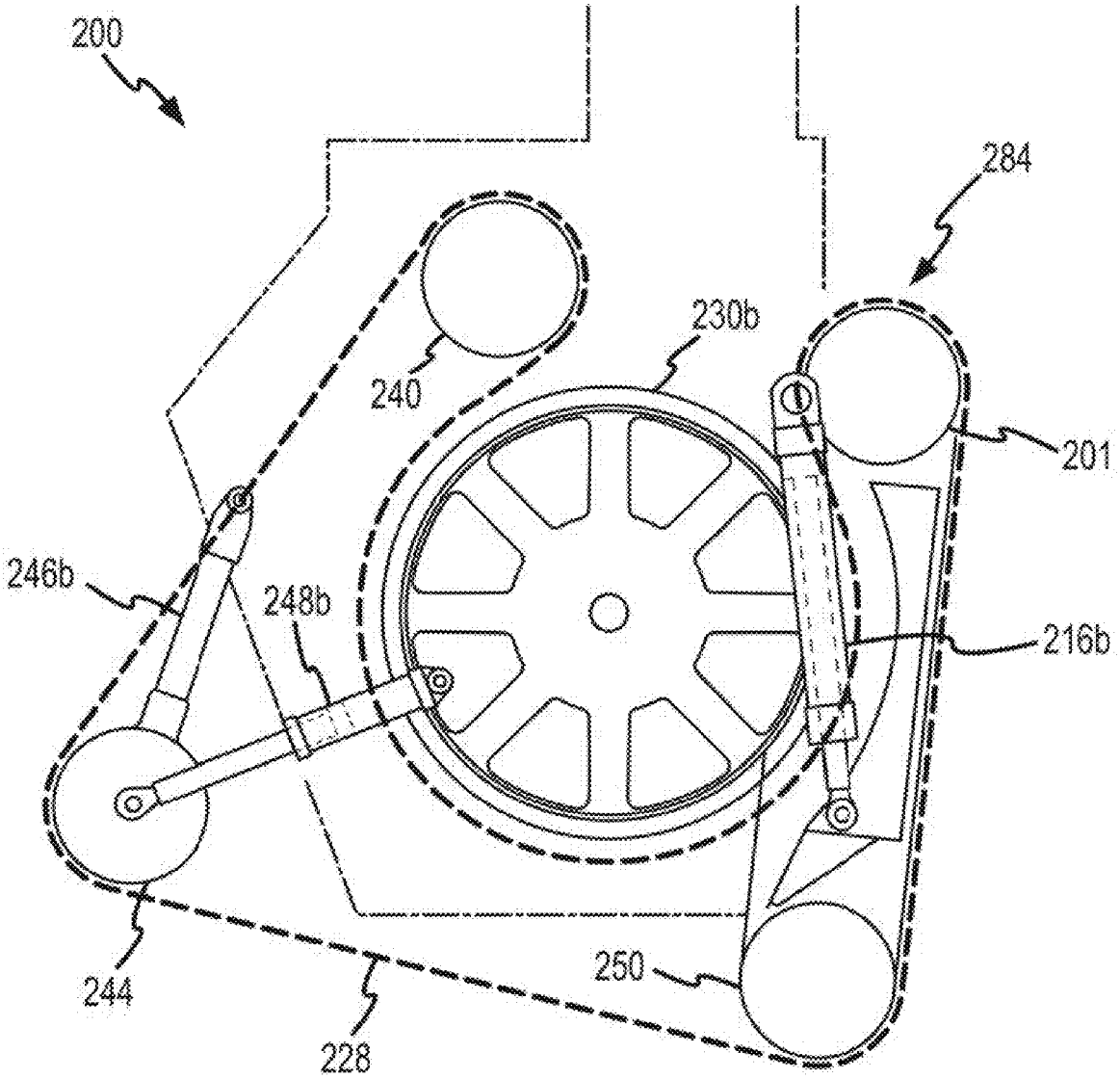
FIG. 9 is similar to FIG. 4, but is a schematic left side view of a baler according to a second embodiment of the present invention with the tailgate in its fully-closed or up position.
Figure 10:
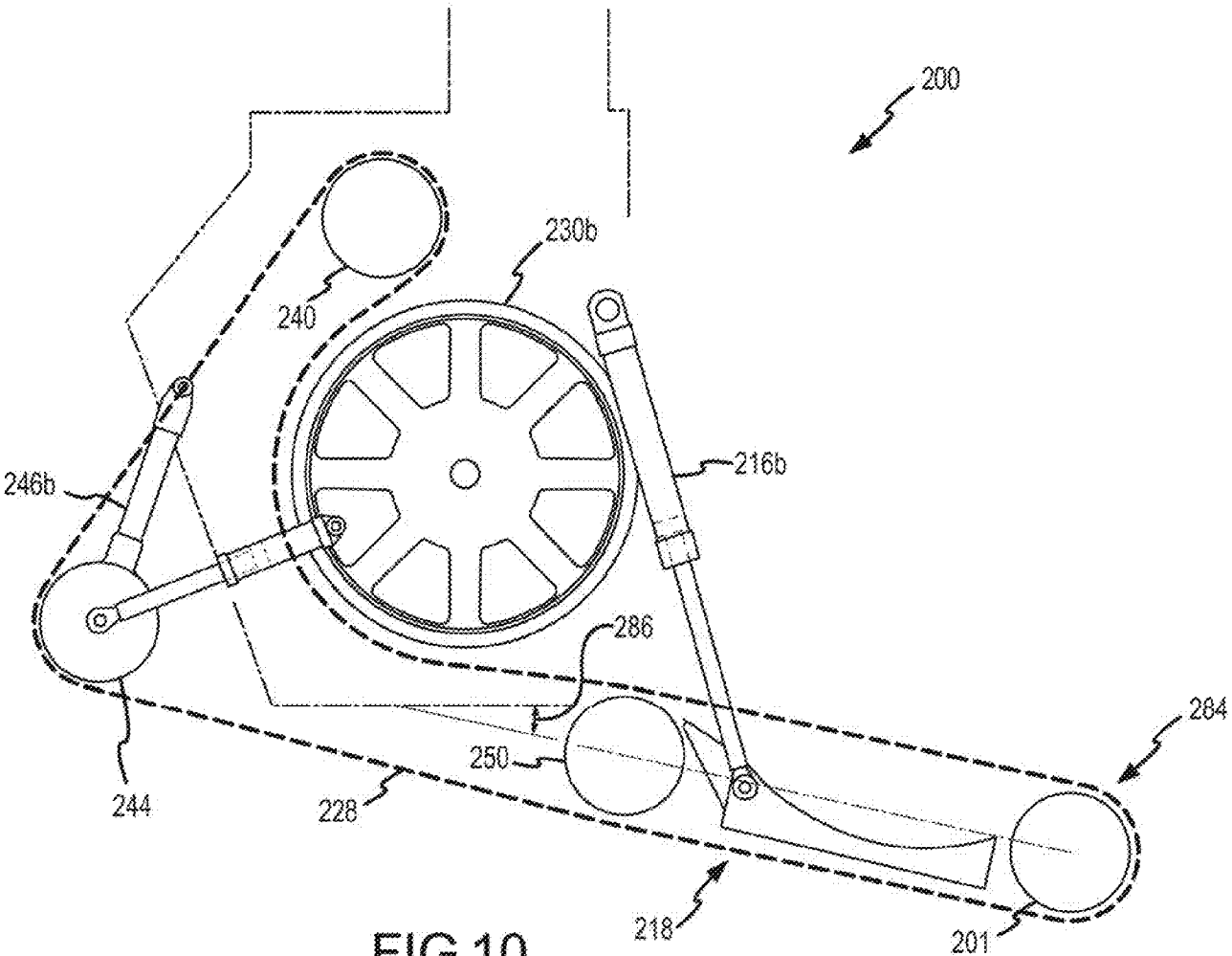
FIG. 10 is similar to FIG. 7, but depicts the baler of FIG. 9 with its tailgate in a fully-open configuration.

FIGS. 9 and 10 show a baler 200 according to a second embodiment of the present invention. It is noted that 200-series reference numbers are used to refer to like elements and such elements may not be described again herein. The primary difference between the first embodiment of the baler 10, shown in FIGS. 1-8, and the second embodiment of the baler 200, shown in FIGS. 9 and 10, is that the baler 200 does not include the tilt roller pair 36, 37 at the distal edge 284 of the tailgate 218. In particular, in FIGS. 9 and 10, a single compression roller 201 is shown at the distal edge 184. In this alternative configuration, as with the first embodiment of baler 10 depicted in FIGS. 1-8, the diameter of the end plates 230*a*, 230*b* have been adjusted to permit higher compression of the materials that are being baled.

Figure 11:
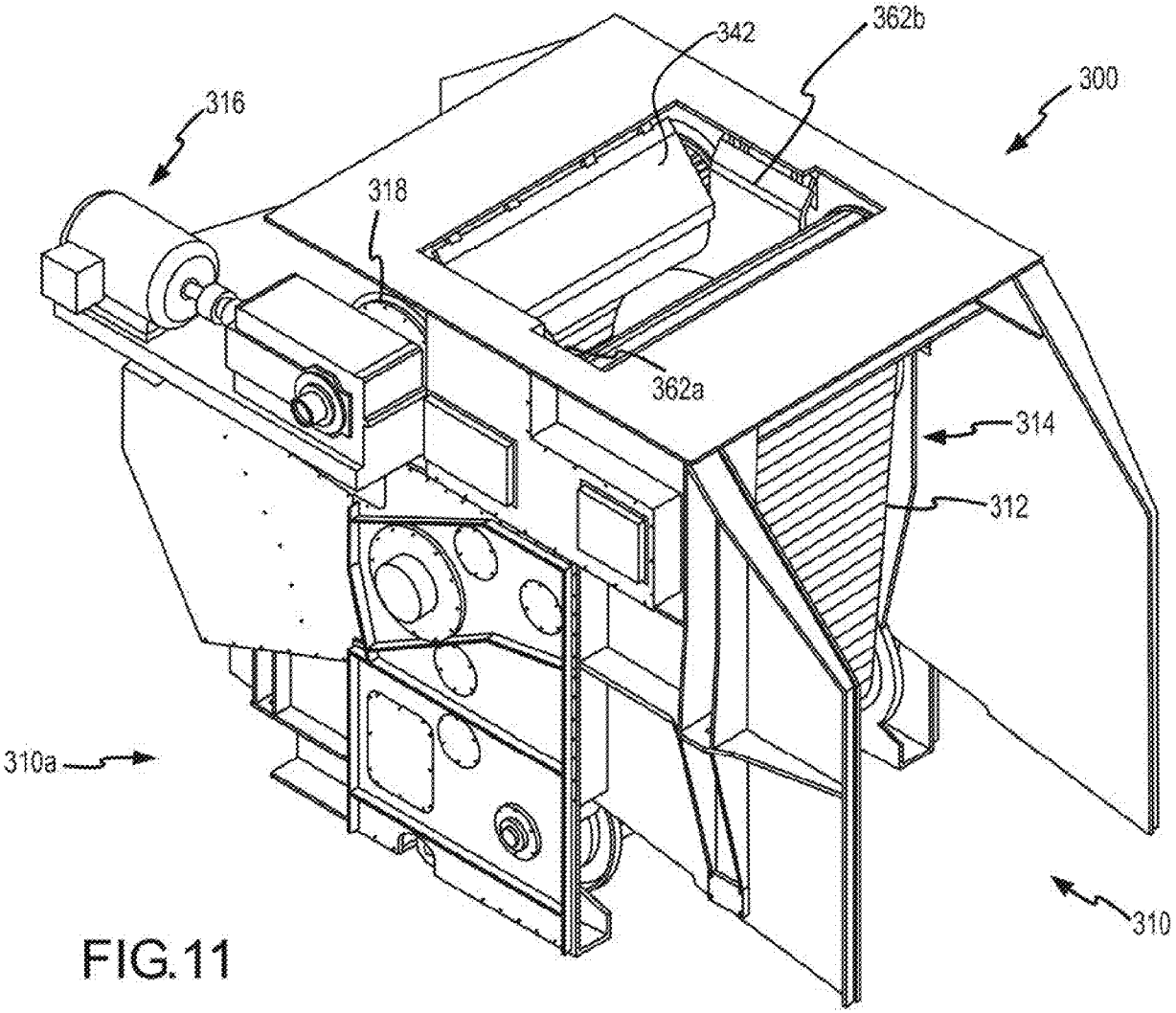
FIG. 11 is similar to FIG. 1, but is an isometric view of the front and left side of a baler according to a third embodiment of the present invention.

FIGS. 11-14 depict a baler 300 according to a third embodiment of the present invention. In particular, FIG. 11 is an isometric view showing the front 310 and left side 310*a* of the baler 300 according to the third embodiment. As in the prior embodiments, an endless compression belt 312 is used to create the baling chamber. A portion of this endless compression belt 312 may be clearly seen in FIG. 11. This third embodiment of the baler 300 according to the present invention includes a different mechanism, explained further below for raising and lowering the tailgate 314. Optionally, the alternative mechanism for raising and lowering the tailgate 314 may be used in conjunction with the roller configurations depicted in FIGS. 2-10, particularly the tilt roller pair 36, 37 shown to good advantage in FIGS. 2-8.

Figure 12:
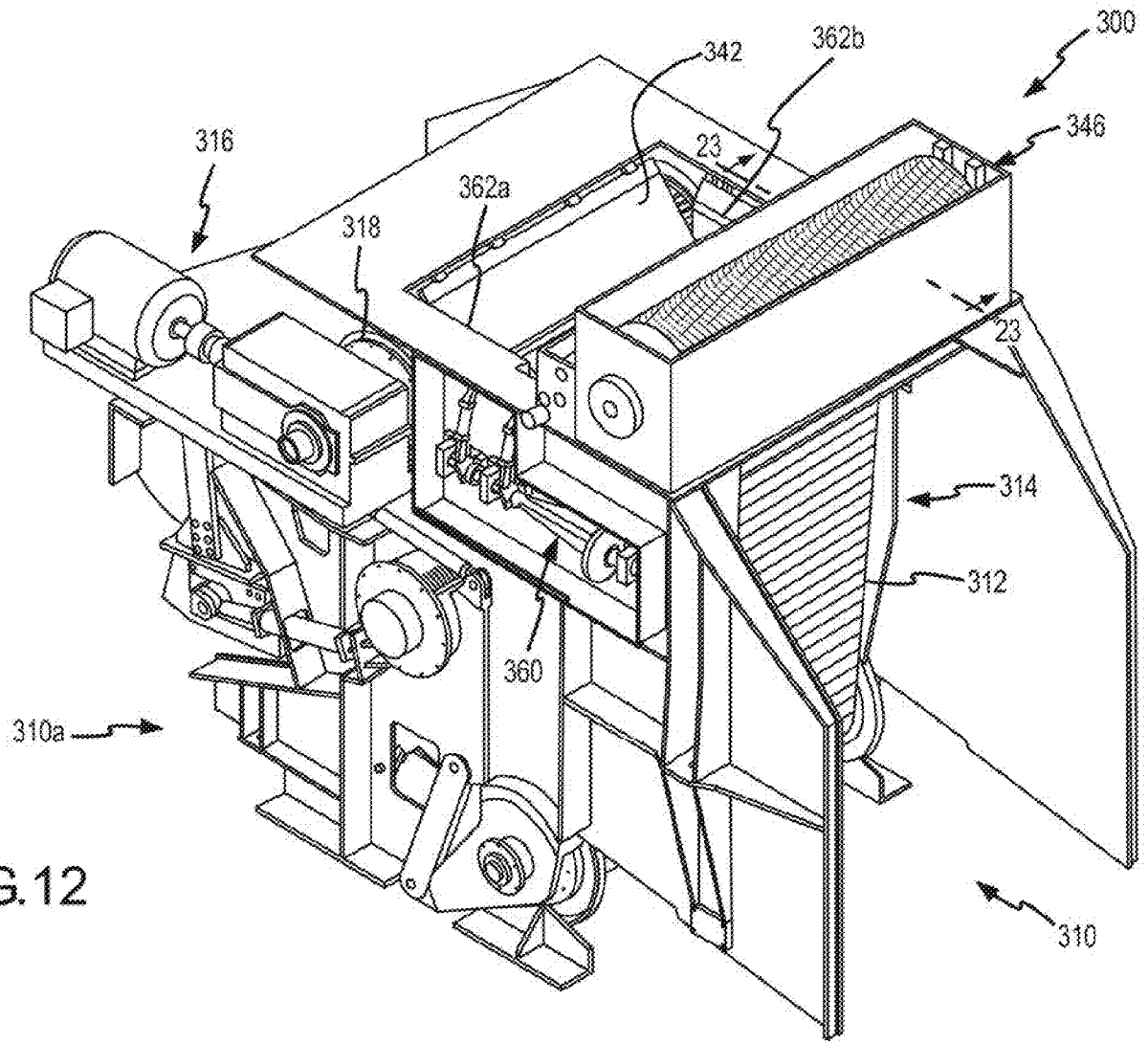
FIG. 12 is similar to FIG. 11, but depicts the baler according to the third embodiment with various side panels removed for clarity and with a second embodiment of a securement netting delivery system.
Figure 13:
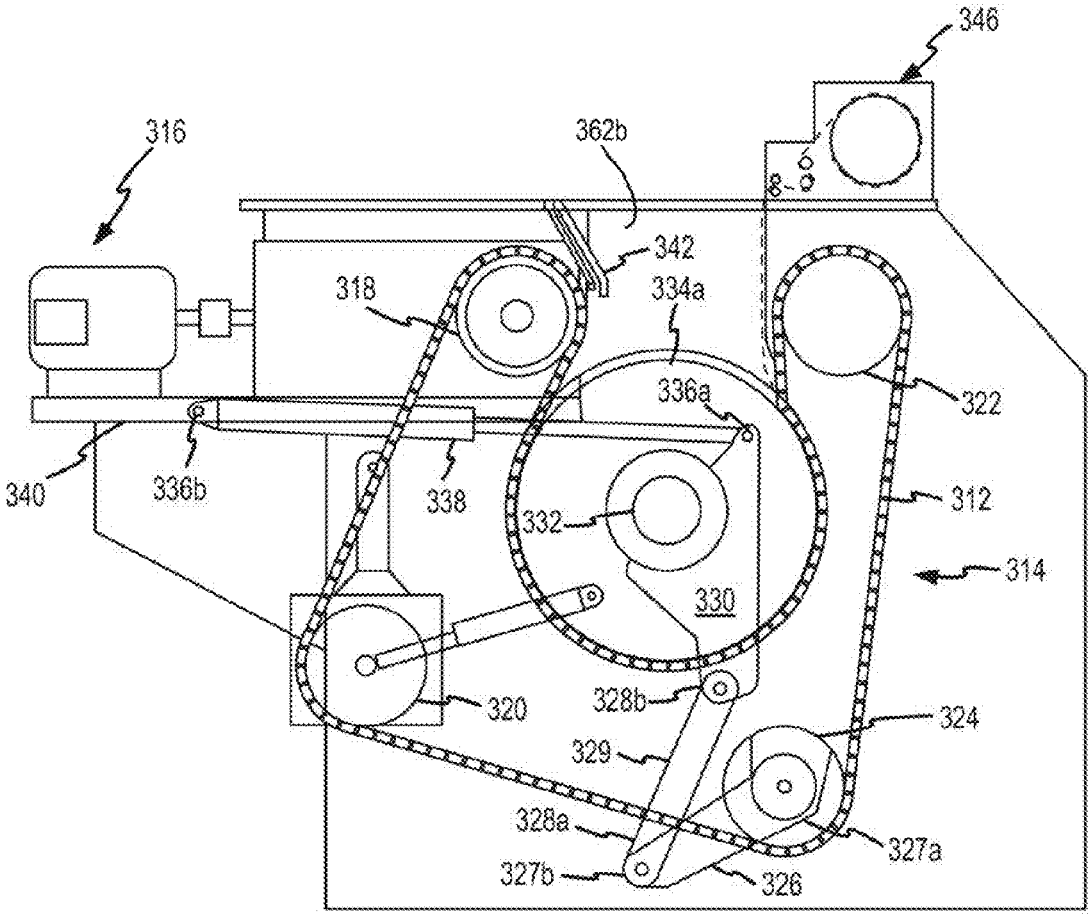
FIG. 13 is a schematic view in partial cross-section looking toward the left side of the baler depicted in FIGS. 11 and 12, with various components removed to clearly show the linkage for opening and closing the tailgate.

FIG. 12 is similar to FIG. 11, but various access panels and shielding panels have been removed to reveal the mechanical linkage used to move the tailgate 314 in this third embodiment of the baler 300. Also visible in FIGS. 11 and 12 is the motor and transmission (generally referred to by reference 316) that drive the driven roller 318 to move the endless compression belt 312. FIG. 13 is a schematic side view of the baler 300 depicted in FIGS. 11 and 12. As shown in FIG. 13, the endless compression belt 312 follows a serpentine or circuitous path around a plurality of rollers including a tensioning roller 320 shown in the lower left-hand corner of FIG. 13, a driven roller 318 shown in the upper left-hand portion of FIG. 13, a compression roller 322 shown in the upper right-hand portion of FIG. 13, and an idler roller 324 shown in the lower right-hand portion of FIG. 13. Again, the idler roller 324 may be an additional driven roller or an alternative driven roller in any of the baler embodiments depicted and described herein. Again, even though the third embodiment is depicted in FIGS. 11-14, with the single compression roller 322 in the upper right-hand portion of, for example, FIG. 13, the tilt roller pair 36, 37 depicted in FIGS. 2-6 may also be used with the mechanism depicted in FIGS. 11-13 for raising and lowering the tailgate 314.

Referring most specifically to FIG. 13, the mechanical linkage for raising and lowering the tailgate 314 will be described next. Starting at the lower, right-hand corner of FIG. 13 with the idler roller 324, an idler roller link arm 326 is present with one of its ends 327*a* attached to the axis of rotation of the idler roller 324, and its opposite end 327*b* attached to one end 328*a* of a pivot arm or link 329. The opposite end 328*b* of this pivot arm or link 329 is connected to a pivot arm clamp assembly 330 aligned with the center axis 332 of the baling chamber and the baling chamber end plates 334*a*, 334*b* (although only plate 334*a* is visible in FIG. 13). The pivot arm clamp assembly 330 includes a hydraulic cylinder attachment point 336*a* to which the tailgate activation hydraulic cylinder 338 is attached. The opposite end 336*b* of the tailgate activation cylinder 338 is attached to the support frame 340 for the baler 300. Also visible in FIG. 13 is the optional sprayer assembly 342 that will be described further below in connection with FIGS. 32-34.

Figure 14:
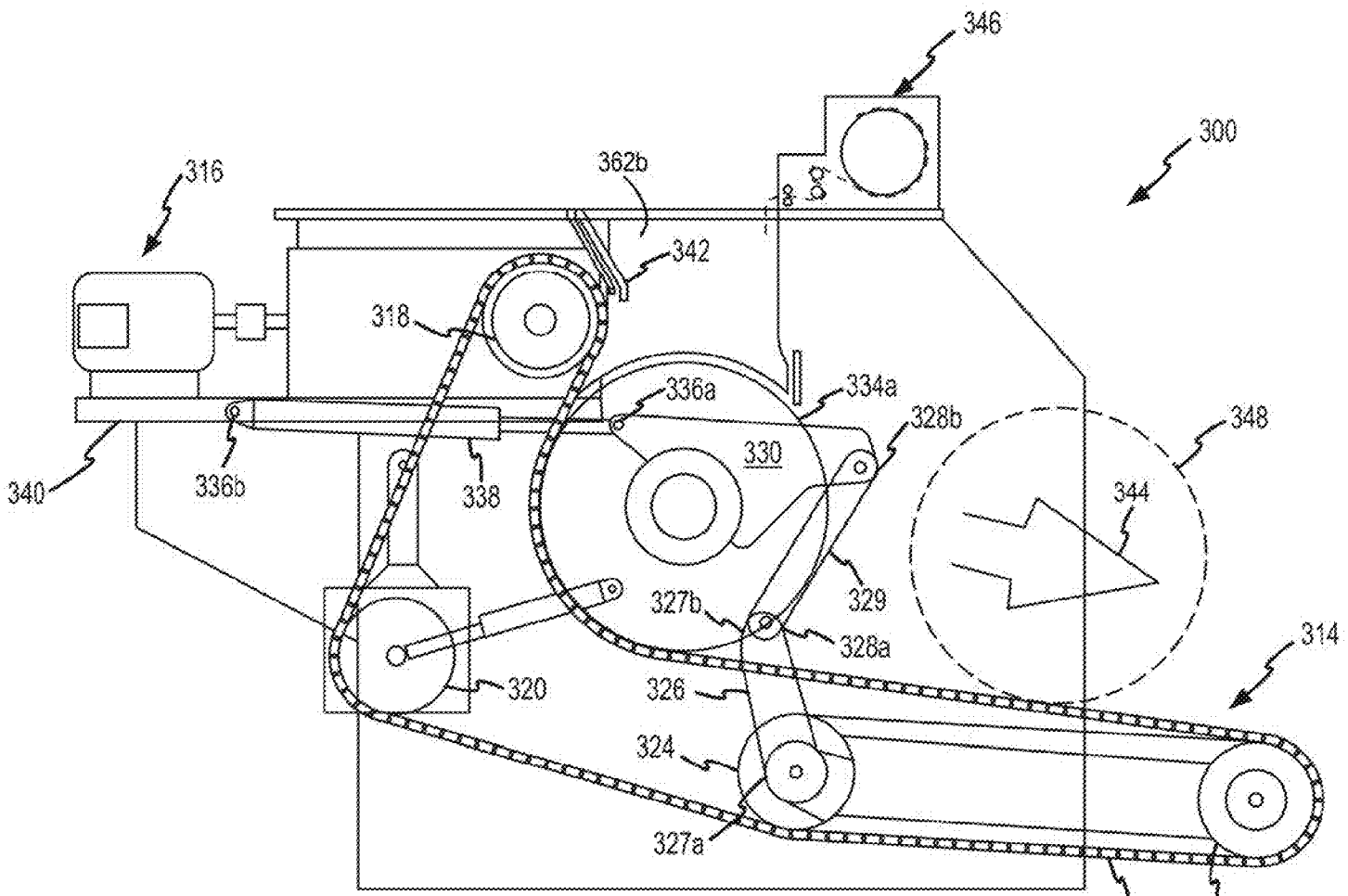
FIG. 14 depicts the baler of FIGS. 11-13 with the tailgate in its fully-open position, and the completed bale moving towards the distal edge of the tailgate.

By comparing FIGS. 13 and 14, it is possible to see how the mechanism for raising and lowering the tailgate 314 functions. In particular, the tailgate activation cylinder 338 is shown in FIG. 13 with its ram extended. To open the tailgate 314, the ram of the tailgate activation cylinder 338 is retracted, which rotates the pivot arm clamp assembly 330 counterclockwise in FIGS. 13 and 14 to the position shown in FIG. 14. This pivoting motion of the pivot arm clamp assembly 330 thereby pulls on the pivot arm 329, raising it from the position shown in FIG. 13 to the position shown in FIG. 14. As this pivot arm 329 is raised by the pivot arm clamp assembly 330, the pivot arm 329 itself pulls on one end of the idler roller link arm 326. As this end of the idler roller link arm 326 is raised, it rotates the tailgate 314 to the fully-open position depicted in FIG. 14. The precursor bale 348, which is shown in phantom in FIG. 14, can then be moved off of the tailgate 314. As previously discussed, a securement netting delivery system 346 may be present on the baler 300. In particular, in FIGS. 12-14 such a securement netting delivery system 346 is present, and is similar to the securement netting delivery system 56 depicted in FIG. 3.

As the linkage just described opens the tailgate 314, the bale chamber end plates 334*a*, 334*b* are simultaneously displaced away from the longitudinal ends of the precursor bale 348, thereby readying the bale 348 for removal from the baling chamber, e.g., as illustrated by arrow 344. The movement of the bale end plates 334*a*, 334*b* away from the longitudinal ends of the bale 348 is accomplished in this embodiment by a baler hub assembly 350 depicted in FIGS. 15-19.

Figure 16:
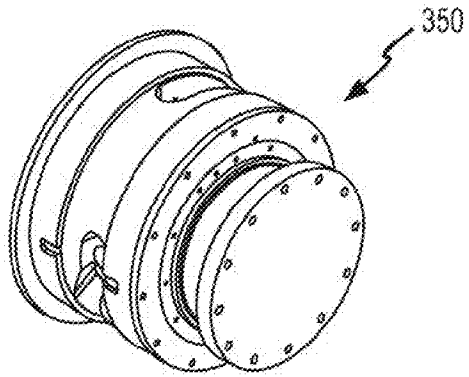
FIG. 16 is an isometric view of the mechanism of FIG. 15 when fully assembled.
Figure 15:
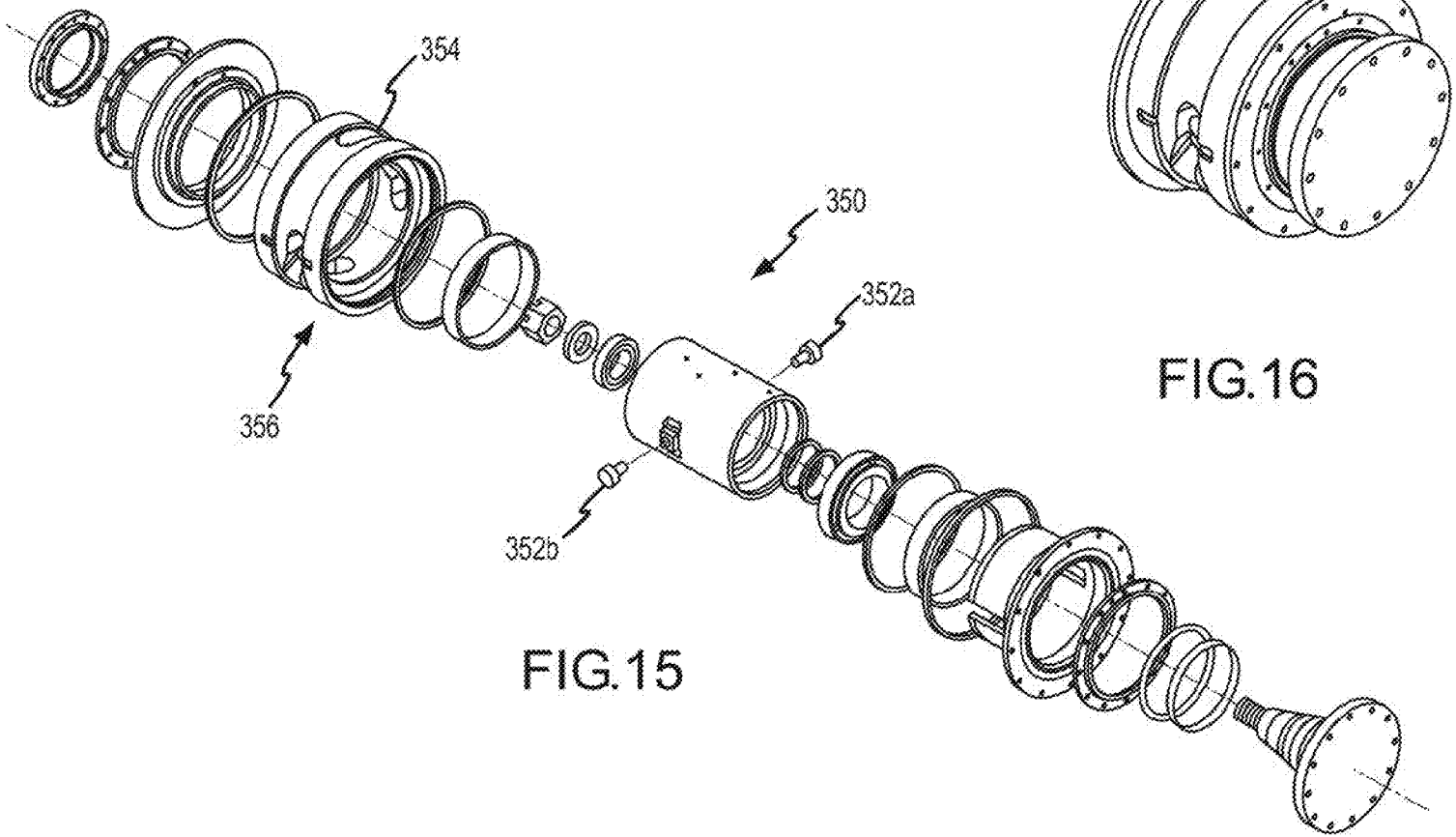
FIG. 15 is an exploded isometric view of a mechanism for moving the bale chamber end plates away from the longitudinal ends of a precursor bale to allow easier extraction of the precursor bale from the baling chamber.
Figure 17:
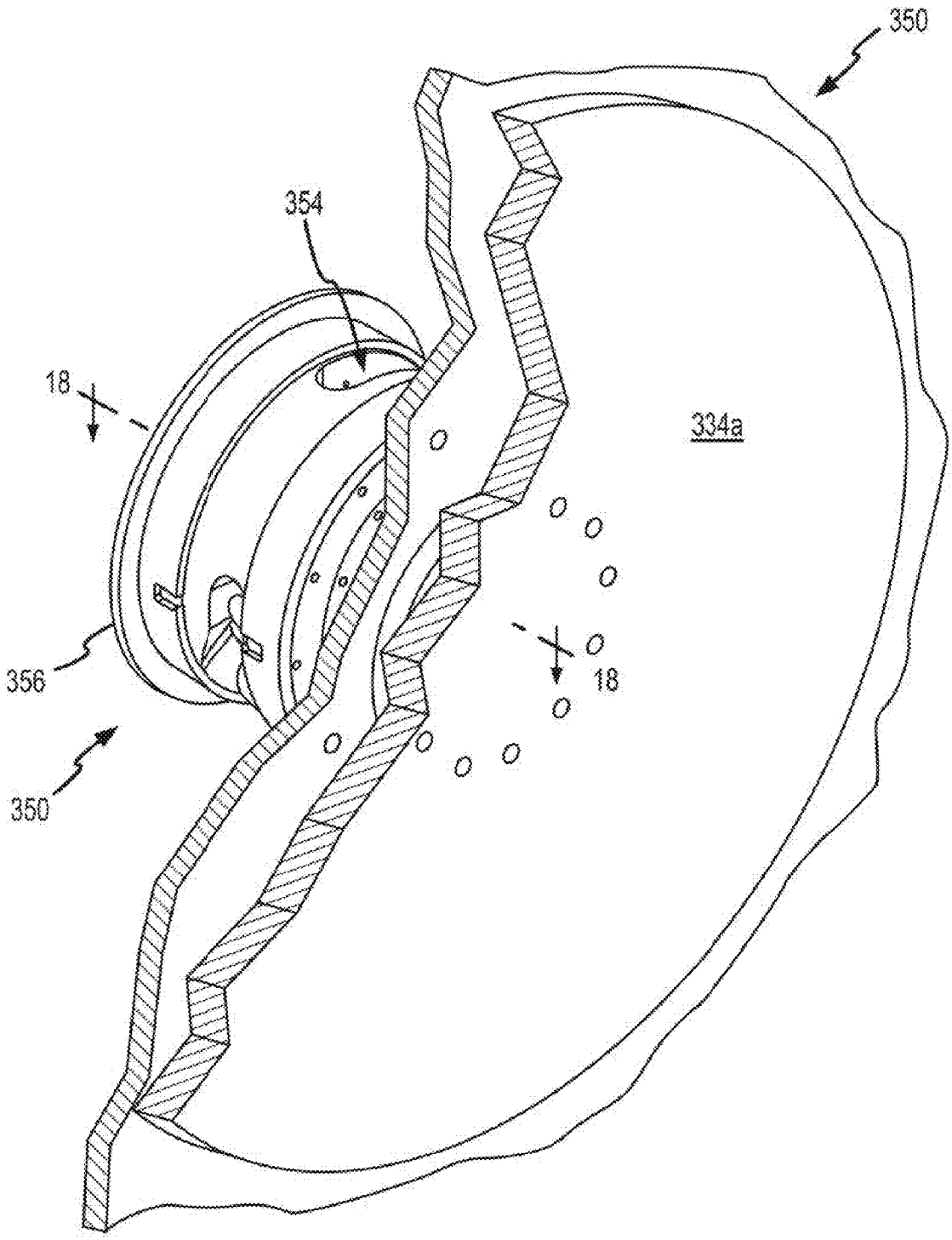
FIG. 17 is an enlarged, fragmentary isometric view of the mechanisms of FIGS. 15 and 16.
Figure 18:
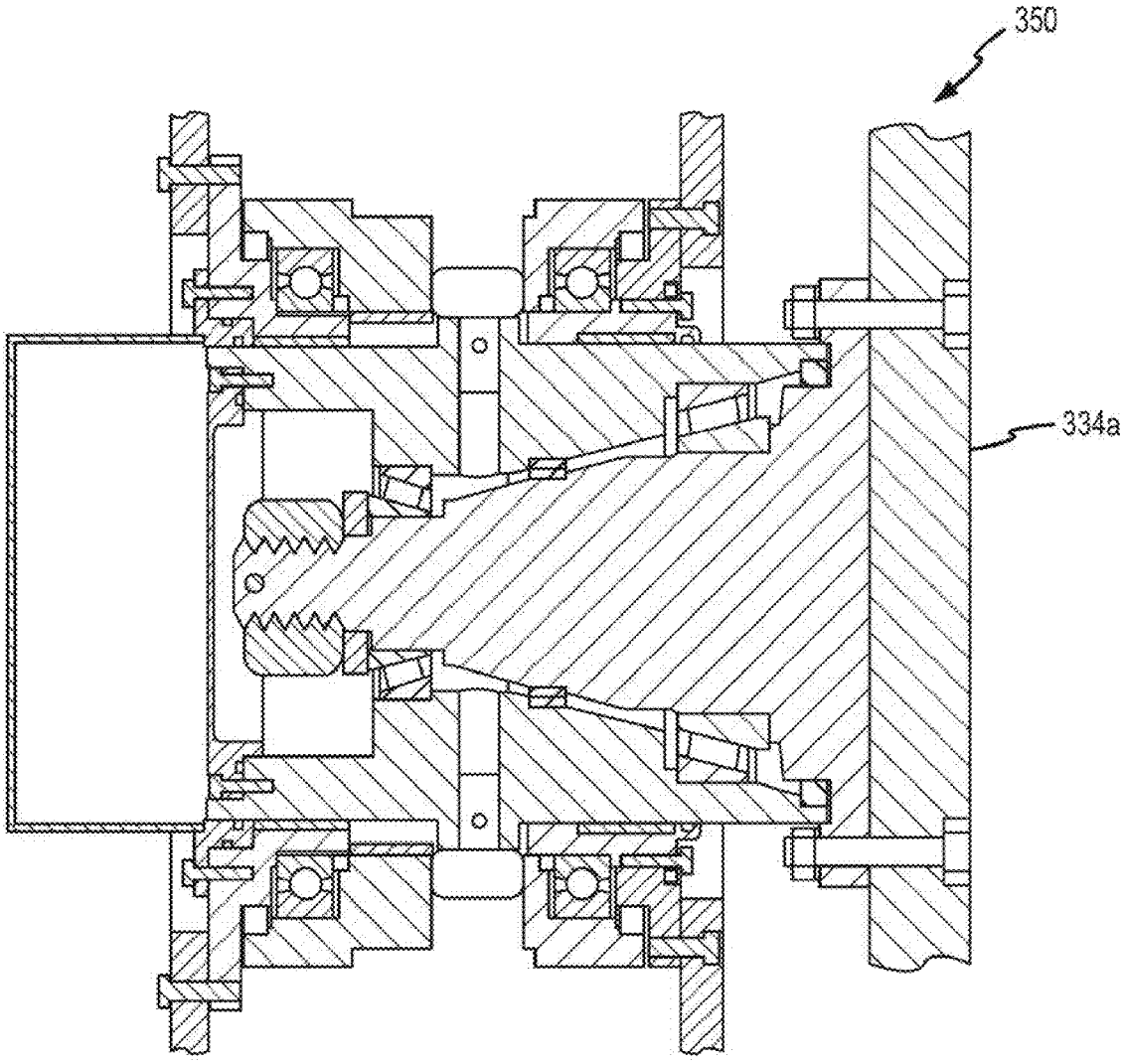
FIG. 18 is a fragmentary, cross-sectional view of the mechanism depicted in FIGS. 15-17 taken along line 18-18 of FIG. 17 with the mechanism positioned to drive the bale chamber end plate against a longitudinal end of a bale during formation of that bale.
Figure 19:
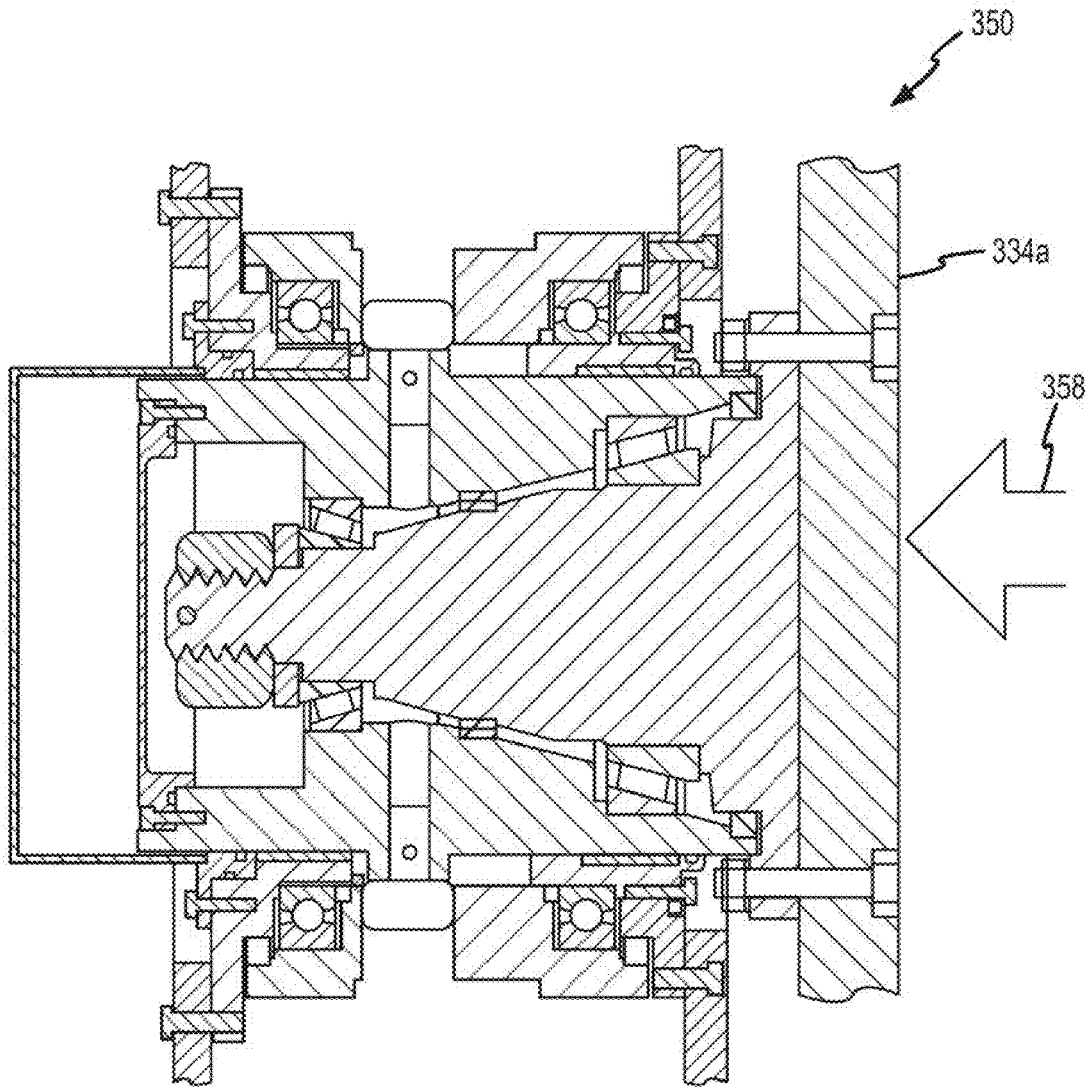
FIG. 19 is similar to FIG. 18, but is a fragmentary cross-sectional view of the mechanism of FIGS. 15-18, showing the mechanism when activated to move the bale chamber end plate away from a longitudinal end of the precursor bale after it has been formed in the baling chamber.

FIG. 15 is an exploded isometric view of a baler hub assembly 350. FIG. 16 is an isometric view of the baler hub assembly 350 in its fully assembled configuration. The baler hub assembly 350 is the mechanism that coordinates movement of the end plates 334*a*, 334*b* with the opening and closing of the tailgate 314. As may be clearly seen in FIGS. 15-17, cam followers or pins 352*a*, 352*b* ride in a slot 354 (see, e.g., FIG. 17). This slot 354 follows an angled path around the outer circumference of a cam follower housing 356. Thus, as the tailgate 314 is opened and closed, the cam followers 352*a*, 352*b*, riding in the cam follower housing 356, create the longitudinal motion of the end plates 334*a*, 334*b* toward or away from the longitudinal ends of the precursor bale 348. This longitudinal movement of the bale end plates 334*a*, 334*b* is represented by, for example, the large arrow 358 on the right-hand side of FIG. 19. Review of FIGS. 15-19, including a comparison of FIGS. 18 and 19, clearly shows how the angular motion of the pivot arm clamp assembly 330 results in longitudinal movement of the end plates 334*a*, 334*b* relative to the longitudinal ends of the precursor bale 348. The distance that the end plates 334*a*, 334*b* move longitudinally as the tailgate 314 opens and closes is controllable by the configuration of the cam follower slot and may be, for example, on the order of a couple of inches.

FIGS. 20-22 show further details concerning the hydraulic and mechanical linkage 360 that moves or swings the swing plates 362*a*, 362*b* into and out of position. Although only swing plate 362*a* is shown in FIGS. 20-22, swing plate 362*b* is visible in FIGS. 13 and 14. The linkage 360 is also shown in, for example, FIG. 12. When the hydraulic rams 364 visible in FIGS. 12 and 20-22 are activated, the swing plates 362*a*, 362*b* may be moved into and out of contact with the longitudinal ends of the precursor bale (e.g., the bale 348 shown in FIG. 14). In particular, each swing plate 362*a*, 362*b* is mounted to the support frame 366 for the baler 300 by a mounting bracket 368. Each mounting bracket 368 (or brackets) permits the respective swing plate 362*a*, 362*b* to move toward and away from the longitudinal end of the bale 348 under the influence of the hydraulic rams 364 and their associated cams and linkages.

If, for example, the end plate moving mechanism described above in connection with, for example, FIGS. 15-19, moves the bale chamber end plates 334*a*, 334*b* away from the longitudinal ends of the bale 348 as the tailgate 314 is opened, the bale 348 may start to roll out of the bale chamber and off the tailgate 314 earlier than desired. In order to control this exit or departure of the bale 348 from the bale chamber, the swing plates 362*a*, 362*b* may be used. In FIG. 21, one of the swing plates 362*a* is shown being pressed into a longitudinal end of a precursor bale 348. In several embodiments of the present invention, a similar swing plate (e.g., swing plate 362*b*) would be present at the opposite end of the precursor bale 348. In this configuration, when the tailgate 314 is opened, the bale chamber end plates 334*a*, 334*b* would move away from the longitudinal end of the precursor bale 348. As shown in FIGS. 21 and 22, the bale chamber end plates 334*a*, 334*b* need not come completely out of contact with the longitudinal ends of the precursor bale 348. Rather, the mechanism depicted most specifically in FIGS. 15-19 may merely move the bale chamber end plates 334*a*, 334*b* enough to prevent them from longitudinally squeezing the bale 348, which would prevent or inhibit removal of the bale 348 from the baling chamber. Thus, for purposes of this discussion, it is assumed that, in FIGS. 21 and 22, a mechanism like the one shown most specifically in FIGS. 15-19 has caused the bale chamber end plates 334*a*, 334*b* to relieve the pressure they may have been putting on the longitudinal ends of the bale 348. At this point, in the configuration depicted in FIG. 21, the swing plate 362*a*, 362*b* at each end of the bale 348 continues to be pressed toward the longitudinal end of the bale 348 by the swing plate hydraulic ram 364 until it is time to release the bale 348 from the bale chamber. In FIG. 22, these swing plate hydraulic rams 364 have been activated to pull the swing plates 362*a*, 362*b* away from the longitudinal ends of the precursor bale 348, thereby releasing the bale 348 to roll out of the compression chamber and off of the tailgate 314.

As shown to good advantage in FIGS. 21 and 22, the bale chamber end plates 334*a*, 334*b* may not extend to or be terminus with the outer circumference of the precursor bale 348. When the end plates 334*a*, 334*b* are smaller than the circular cross-section of the bale 348, it is possible to more firmly squeeze or compress the material to reach the high compressions or bale densities that may be required for particular applications.

FIGS. 3, 6, and 12-14, among others, depict securement netting delivery systems. In order to operate the balers according to the present invention as efficiently as possible, it is important that the securement netting delivery system is able to reliably deliver securement netting around the outer circumference of the compressed materials comprising the bale. If, for example, the securement netting does not extend substantially from one longitudinal end of the cylindrical bale to the other longitudinal end of the bale, when the tailgate is lowered or opened, the precursor bale may rupture or burst. If this were to occur, it would be necessary to shut down the baler until the scattered debris and busted bale could be removed from the apparatus in order to commence full operation of the baler again.

Figure 25:
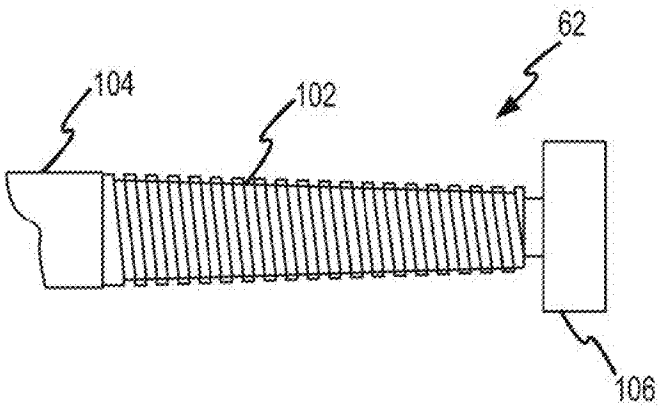
FIG. 25 is a fragmentary side view of one of the net-spreading rollers depicted in FIGS. 23 and 24.
Figure 23:
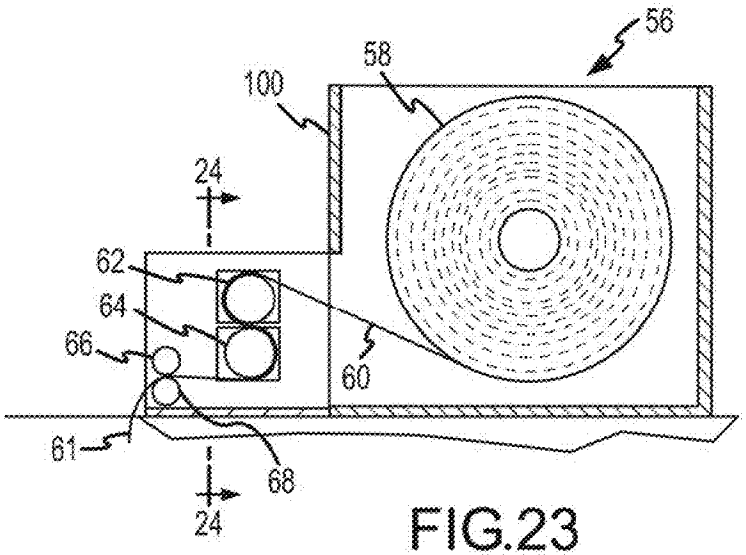
FIG. 23 is a fragmentary, cross-sectional view of the second embodiment of the securement netting delivery system, taken along line 23-23 of FIG. 12.
Figure 24:
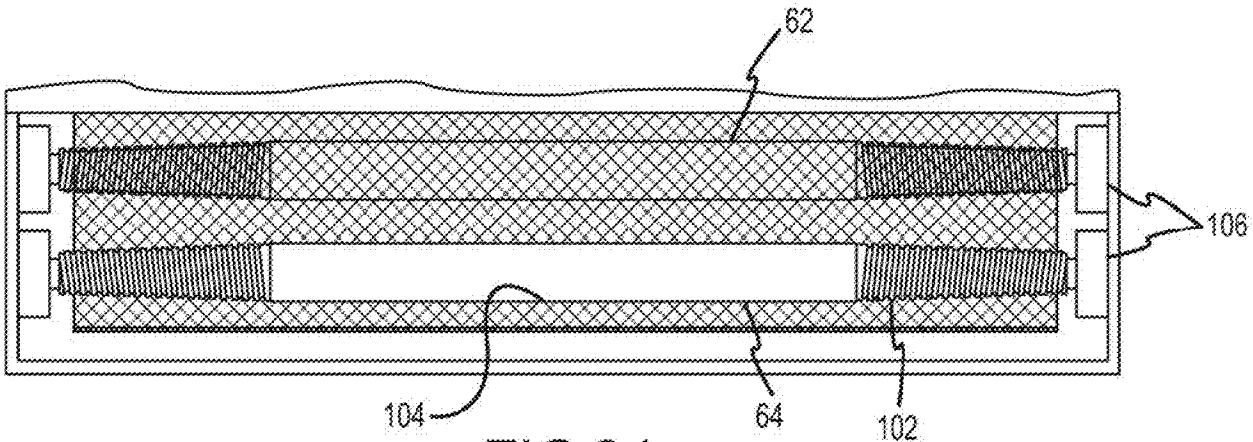
FIG. 24 is a fragmentary view in partial cross-section of a first embodiment of the first and second net-spreading rollers, taken along line 24-24 of FIG. 23.

In order to help ensure that the securement netting is spread to the longitudinal ends of the baled material and does not get bunched up, one or more of the netting rollers may include, for example, helical grooves. Additional, or alternatively, one or more of the netting rollers may be tapered. FIGS. 23-25 depict, for example, the securement netting delivery system 56 discussed briefly above with reference to FIG. 3. FIG. 23 is a fragmentary cross-sectional view of the securement netting delivery system 56. A supply roll 58 of securement netting 60 is mounted within a housing 100 (the housing may or may not be present) and delivers, on demand, securement netting 60. In this particular embodiment, the securement netting 60 follows a serpentine path around a first spreading roller 62 and then a second spreading roller 64. After leaving the second spreading roller 64, the securement netting 60 is passed between a driven roller 68 and a pinch roller 66. The free end of the securement netting 61 is then fed into the baling chamber at the appropriate time to deliver a layer of netting 60 around the exterior of the bale (e.g., bale 20 shown in FIG. 7). Although this securement netting 60 is typically delivered to the outside of the bale 20 as a final step prior to removing the bale 20 from the baling chamber 26, in some applications netting 60 is embedded into the bale 20 at various stages during the formation of the bale 20 to stabilize the materials being baled.

As may be clearly seen in FIG. 23, with the serpentine path that the netting 60 follows around the first and second spreading rollers 62, 64, the securement netting 60 is in contact with one or both of these rollers 62, 64 along a substantial portion of the outer surface of the rollers 62, 64. This extensive contact with the outer surface of the spreading rollers 62, 64 provides an opportunity for the spreading rollers 62, 64 to influence the feeding of the securement netting 60. For example, as shown in FIG. 24, which is a view looking in the direction of line 24-24 in FIG. 23, the spreading rollers 62, 64 each include a plurality of helical grooves 102 at each longitudinal end. Once the netting 60 is properly threaded around these first and second spreading rollers 62, 64, the helical grooves 102 at each longitudinal end of each spreading roller 62, 64 tends to drive the longitudinal edges of the netting 60 toward the longitudinal ends of the rollers 62, 64, thereby keeping the securement netting 60 spread over substantially the entire length of the bale 20 being created in the baling chamber 26. Each section of grooves 102 may be, for example, four to eighteen inches long to ensure that there are sufficient grooves 102 present to have the desired influence on the securement netting 60.

Although both intermediate rollers 62, 64 are shown in this embodiment (FIGS. 23-25) as including net-spreading grooves 102 on each end, it may only be necessary to have these net-spreading grooves 102 on one of the two rollers 62 or 64. In a variant of the depicted embodiment, an additional, compression roller may be present to press the securement netting 60 firmly against one of the spreading rollers 62, 64 to further enhance, for specific situations, the effect of the spreading roller or rollers 62, 64 on the securement netting 60. As clearly shown in FIGS. 24 and 25, the spreading rollers 62, 64 may also taper toward one or both of their longitudinal ends. So that it is easier to see, the taper is somewhat exaggerated in FIGS. 24 and 25. In reality, the taper may be on the order of a 2.5 mm change in diameter for the spreading roller 62, 64 from the center of the spreading roller 62, 64 to each of the longitudinal ends of the spreading roller 62, 64. Further, one or both of the spreading rollers 62, 64 may include a flat section 104 near its longitudinal center, possibly to support the center of the roller 62, 64 as a location where a bearing could be placed. In FIGS. 24 and 25, each longitudinal end of each spreading roller 62, 64 is supported by a bearing block 106 that allows the spreading rollers 62, 64 to spin under the influence of the driven roller 68.

Figure 27:
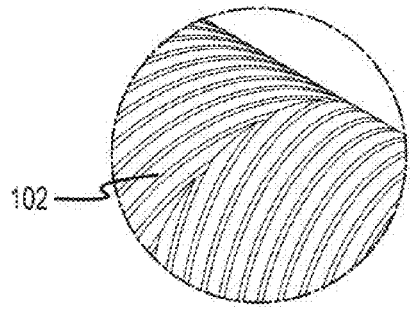
FIG. 27 is an enlarged view of the circled portion of FIG. 26.
Figure 26:
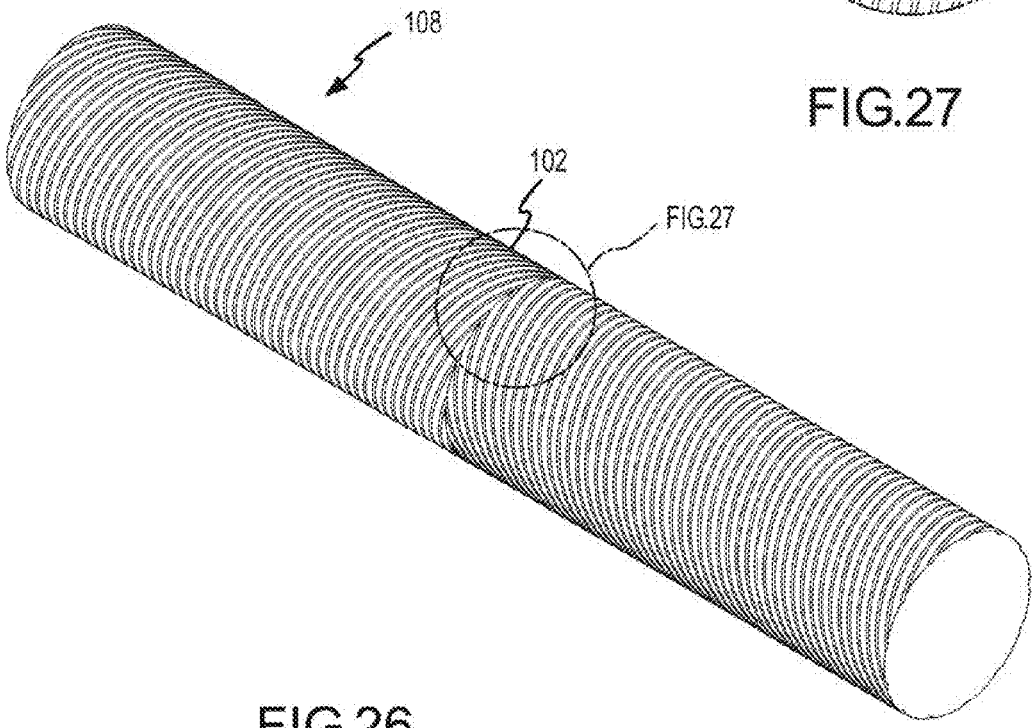
FIG. 26 is an isometric view of an alternative net-spreading roller according to the present invention.

FIGS. 26 and 27 depict an alternative net-spreading roller 108 (e.g., to spreading rollers 62, 64 discussed above with reference to FIGS. 24 and 25). In this alternative embodiment of the net-spreading roller 108, the grooves 102 extend from the center of the roller outwardly toward each end of the roller 108. FIG. 27 shows an enlarged view of the circled portion of FIG. 26, where the two groove patterns meet at the center of the net-spreading roller 108. Although the alternative net-spreading roller 108 depicted in FIGS. 26 and 27 can influence the netting 60 more than the rollers 62, 64 depicted in, for example, FIG. 24, because of the presence of more grooves 102, the ultimate effectiveness of the roller 108 depicted in FIGS. 26 and 27 may depend to a large extent on how carefully the netting 60 is originally aligned.

Figure 28:
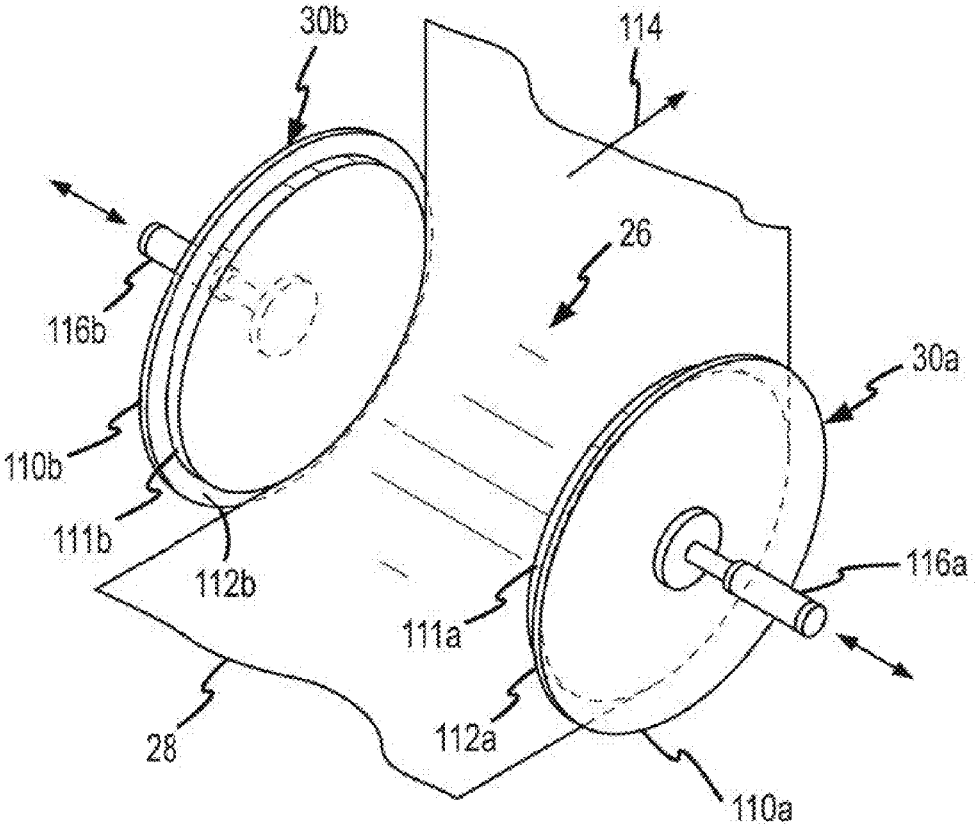
FIG. 28 is an isometric view of a section of endless belt extending between a pair of lipped end plates.

FIG. 28 shows a section of the endless belt and two bale chamber end plates, such as, the endless compression belt 28 and end plates 30*a*, 30*b* described above with reference to FIGS. 1-8. The bale chamber end plates 30*a*, 30*b* depicted in FIG. 28 are "lipped" end plates. In other words, the end plates 30*a*, 30*b* include both an outer circumferential surface 110*a*, 110*b* and a smaller, bell-support lip or ledge 111*a*, 111*b*, respectively. As shown in FIG. 28, the inner surface of the endless belt 28 rides against the belt-support lip 111*a*, 111*b*, and each lateral edge of the belt sits adjacent to an annular retainment surface 112*a*, 112*b*. This lipped end plate configuration provides some advantages. For example, since the inner surface of the endless belt 28 rests on the belt-support lips 111*a*, 111*b*, the material being baled is potentially more fully contained within the baling chamber 26 formed by the inner surface of the endless belt 28 and the inner surface of the lipped end plates 30*a*, 30*b*.

Figure 30:
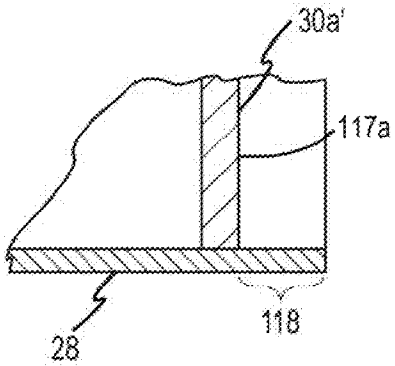
FIG. 30 is a fragmentary, cross-sectional view taken along line 30-30 of FIG. 29, with the endless belt delivering a low to moderate compressing force to the material in the baling chamber.
Figure 31:
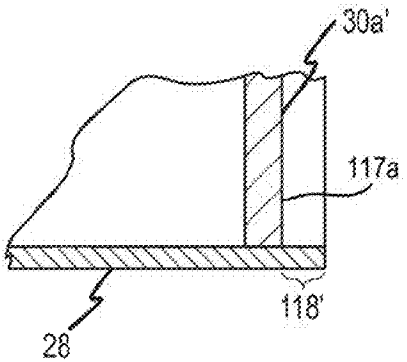
FIG. 31 is similar to FIG. 30, but depicts the relationship between the endless belt and the end plate while the endless belt is delivering high pressure to the materials in the baling chamber.
Figure 29:
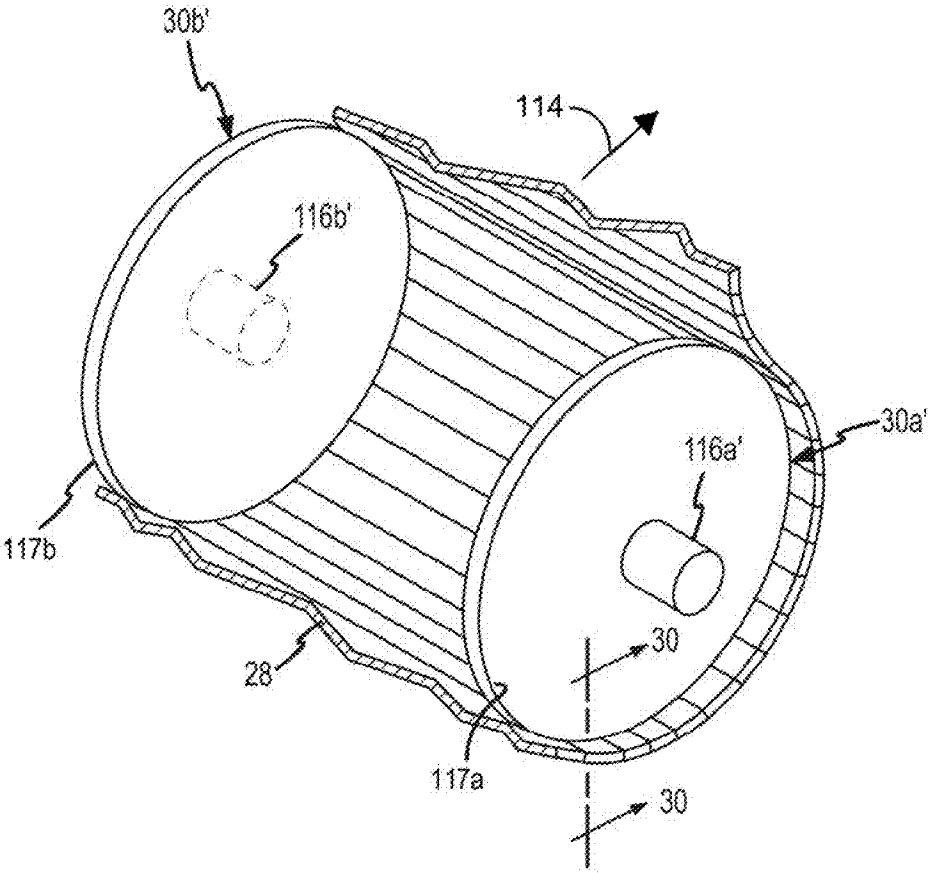
FIG. 29 is similar to FIG. 28, but depicts a section of endless belt extending between a pair of lipless end plates.

Under high compression, the endless belt 28 may experience a negative moment, causing the belt 28 to bulge in the direction of the arrow 114 shown at the top of FIG. 28. As the pressure being applied to the material increases, this "belt bulge" can also increase. Of course, as the bulge increases, and assuming the position of the end plates 30*a*, 30*b* are fixed for the moment, each belt lateral edge may be displaced toward the lip inner edge (see FIG. 28). Under certain circumstances, the stresses on the belt 28 may continue to increase, and the belt lateral edges may eventually retract past the lip inner edge, no longer riding on the belt-support lips 111*a*, 111*b* at all. Since the overall end plate thickness may be on the order of two inches, it is important to consider other possible end plate configurations for high compression environments. For example, the belt-support lip 111*a*, 111*b* may be made wider. FIGS. 29-31, which will be described more fully below, describe an alternative solution that works for certain applications. In FIG. 28, each end plate 30*a*, 30*b* is also connected to an end plate displacement ram 116*a*, 116*b*, respectively. Thus, if excessive belt bulge were to occur, the end plate displacement ram 116*a*, 116*b* at each end of the bale 20 could be activated to move the longitudinal end plates 30*a*, 30*b* closer together until the bulge subsided.

Figure 44:
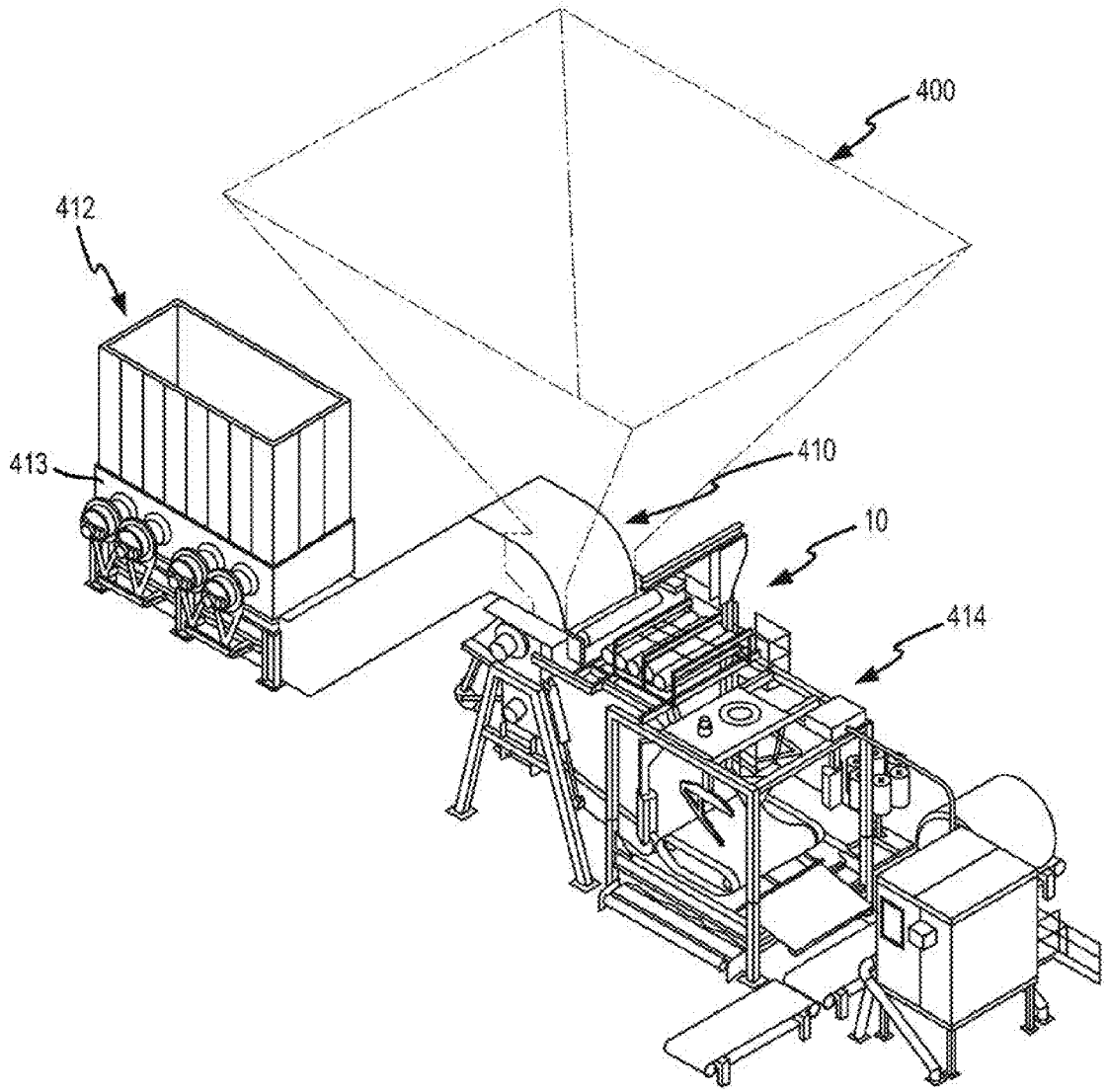
FIG. 44 is an isometric view of the baler of FIGS. 1-8 in one possible configuration for a baling system, with the alternative super-charging hopper shown in phantom.
Figure 45:
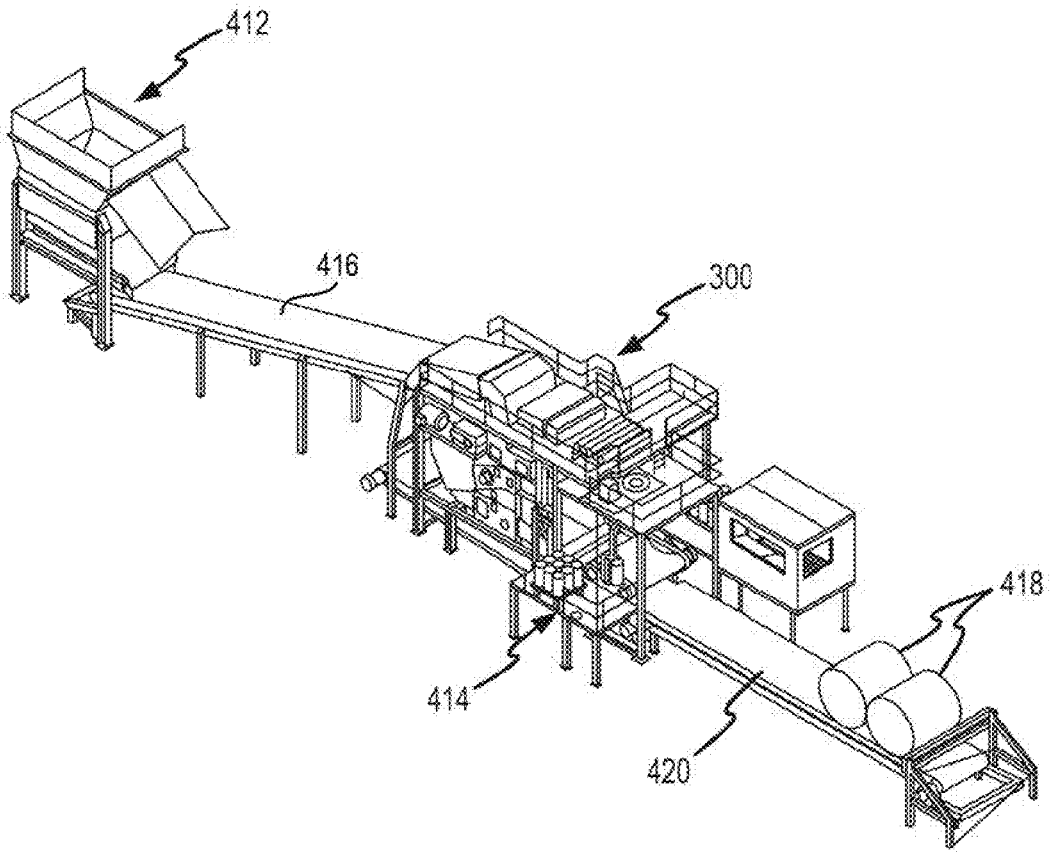
FIG. 45 is similar to FIG. 44, but depicts one possible baling system that includes the baler also shown in FIGS. 11-14.

Even if the endless compression belt 28 is not bulging, it may be desirable to adjust the overall length of the bales 20 by selectively activating the rams 116*a*, 116*b* via instrumentation in the baler control room (see FIGS. 44 and 45). Being able to adjust the ultimate length of the bales 20 on the fly, makes it possible to, for example, ensure that the length of the bales 20 maximize the available space in a shipping container (see, e.g., FIGS. 47 and 48) or to ensure that the bales 20 fit snuggly in a railcar (see, e.g., FIG. 50) or other transportation means (see, e.g., FIGS. 49 and 51).

As mentioned above, FIGS. 29-31 show an alternative configuration for the baling chamber itself. In particular, the end plates shown in these figures are "lipless" end plates (designated 30*a*' and 30*b*'). In this configuration, the lateral edges of the endless compression belt 28 extend past the end plate outer surfaces 117*a*, 117*b*, creating the portion 118 (e.g., 3-4 inches) of the endless belt 28 that extends beyond the end outer surfaces 117*a*, 117*b* as clearly shown in FIG. 30. Then, if the belt 28 bulges or flexes under high compression in the direction of the bulge deflection arrow 114 shown in FIG. 29, the lateral edges of belt 28 are pulled inwardly, as shown by comparing portion 118 in FIG. 30 with portion 118' in FIG. 31. For particular situations, the lipless end plates 30*a*', 30*b*' can be advantageous because they permit extensive belt bulging without detrimental effects and unnecessarily thick end plates. Again, end plate displacement mechanisms 116*a*', 116*b*' are shown in FIG. 29 associated with each end plate 30*a*', 30*b*' to provide the ability to control the length of the bales 20 for specific applications where a difference of a few inches in longitudinal length of a bale 20 provides advantages.

Figure 32:
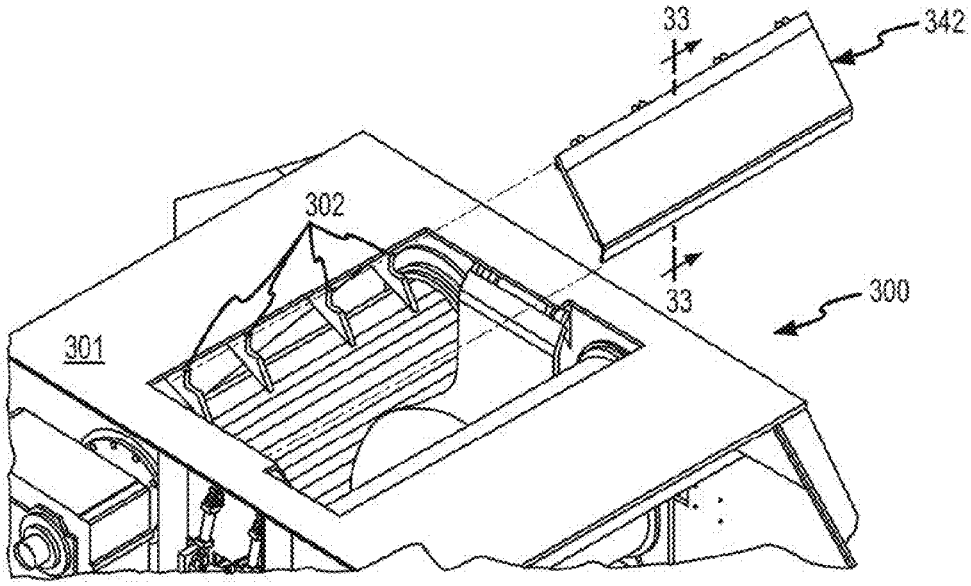
FIG. 32 is a fragmentary isometric view of a portion of the baler depicted in FIGS. 11-14, with the sprayer assembly exploded away from the baler.
Figure 34:
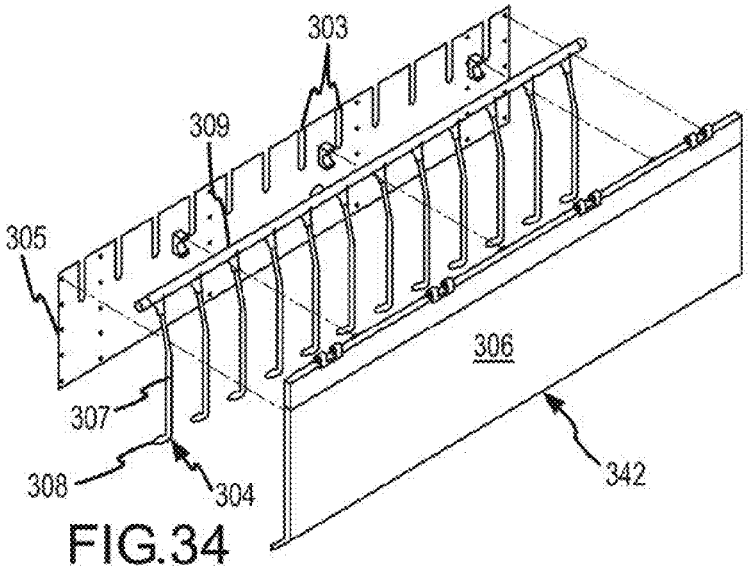
FIG. 34 is an exploded, isometric view of the sprayer assembly depicted in FIGS. 32 and 33.
Figure 33:
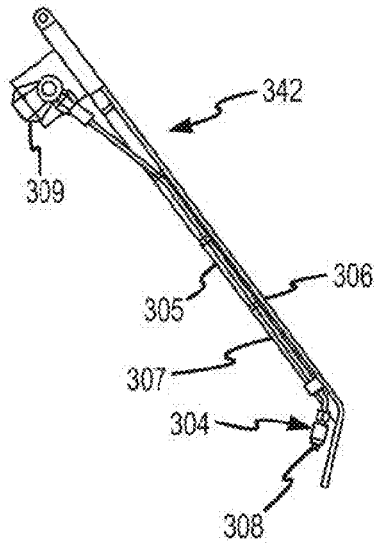
FIG. 33 is a cross-sectional view of the sprayer assembly, taken along line 33-33 of FIG. 32.

FIGS. 32-34 depict details for an optional sprayer assembly, such as the sprayer assembly 342 mentioned above with reference to FIGS. 13-14. It may be desirable, for example, to spray the material to be baled as it enters the baler 300. For example, it may be desirable to spray a small amount of water on the material to control dust, or it may be desirable to spray odor control additives, or disinfectant additives, or stabilizing compounds, or any other additives on the material entering the baler. In FIGS. 11-14 the sprayer assembly 342 is shown mounted in position, whereas in FIG. 32, the sprayer assembly 342 is shown exploded away from the baler 300. Four mounting brackets 302 are depicted on the baler body 301 to receive and support the sprayer assembly 342. FIG. 33 is a cross-sectional view of the sprayer assembly 342 taken along line 33-33 of FIG. 32. In FIG. 33, one of the sprayers 304 is visible, being protected between a back plate 305 and a cover plate 306 depending upon the particular situation, these plates 305, 306 may be constructed from, for example, sheet metal or ¼ or ½ inch thick steel plate.

The back plate 305 and the cover plate 306 are clearly visible in FIG. 34. As shown to best advantage in FIGS. 33 and 34, each of the sprayers 304 includes a sprayer tube 307 and a sprayer head or nozzle 308. The nozzle 308 is at the distal end of each sprayer tube 307, and the proximal end of each sprayer tube 307 is connected to a distribution manifold 309. The back plate 305 comprises a plurality of sprayer tube slots 303 (FIG. 34) that are present to accommodate the sprayer tubes 307 when the back plate 305 is affixed to the cover plate 306.

Figure 35:
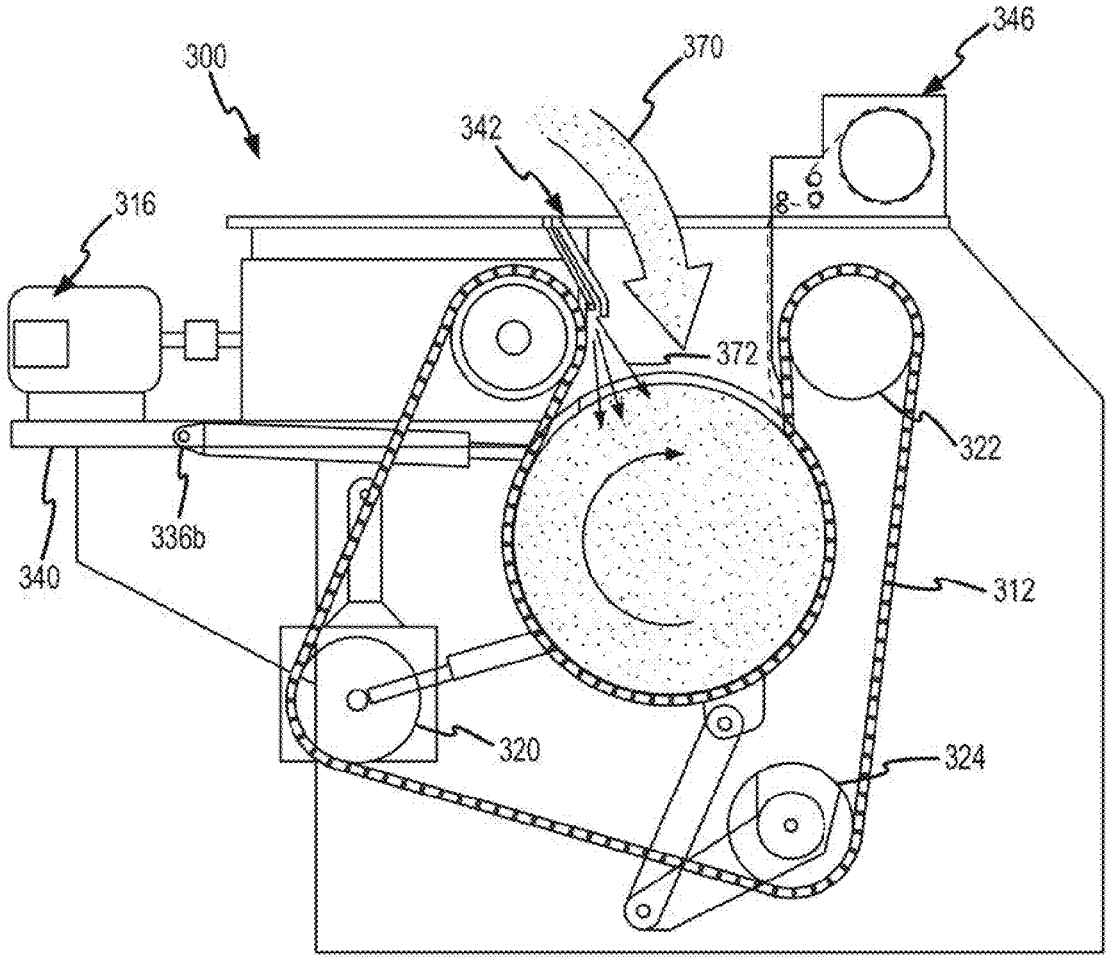
FIG. 35 is similar to FIG. 13, but depicts the sprayer delivering an additive to the material being introduced into the baler.

FIG. 35 is a schematic view one embodiment of a baler 300 in operation with the sprayer assembly 342 functioning. In particular, a stream of materials to be baled is schematically depicted by the fat arrow 370 pointing into the throat of the baler 300. The additives being applied to the material as it enters the baler are represented by the three smaller arrows 372 adjacent to the lower edge of the sprayer assembly 342.

Figure 36C:
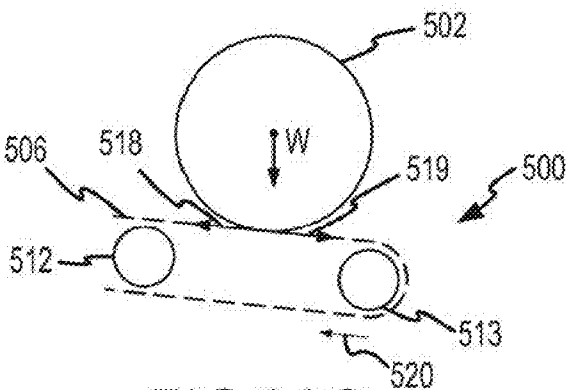
FIG.36C PRIOR ART
FIGS. 36A, 36B, and 36C are schematic representations of a prior art tailgate having a relatively low deployment angle.
Figure 36B:
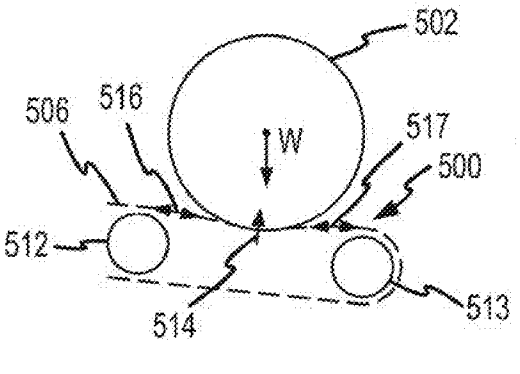
FIG.36B PRIOR ART
Figure 36A:
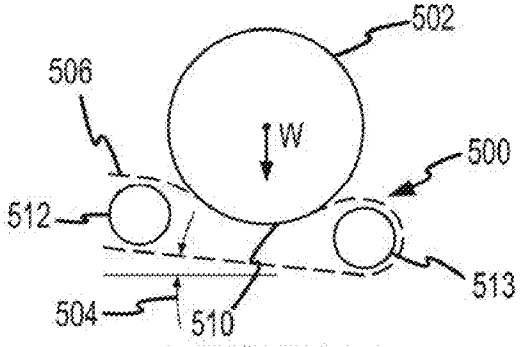
FIG.36A PRIOR ART

FIGS. 36A, 36B, 36C, 37A, 37B, 37C, 38A, and 38B are schematic representations of the process of off-loading precursor bales produced by different balers. FIGS. 36A, 36B, and 36C depict a prior art tailgate 500 in a fully-down or fully-open position as a bale 502 is off-loaded. The tailgate slope angle 504 is relatively shallow (e.g., approximately 5.98°) even though the tailgate 500 is depicted in its fully-open configuration. In FIG. 36A, the tailgate 500 has just reached its fully-opened position. At this point, the slack in the endless compression belt 506 and the weight (indicated by W) of the bale 502 (e.g., 8 U.S. tons) create a trough 510 between the two rollers 512, 513. Once the bale 502 settles in this trough 510 in the prior art system where the tailgate slope angle 504 is relatively shallow, it can be difficult and hard on the equipment to get the bale 502 off of the tailgate 500. In particular, the tension in the belt 506 may need to be dramatically increased (e.g., as indicated by arrows 516, 517) in order to counter the weight W of the bale 502 and to start to lift the bale 502 in the direction of the baler lift direction arrow 514 as shown in FIG. 36B. Comparing the tension 516, 517 in FIG. 36B to the tension in FIG. 36C (indicated by arrows 518, 519), it is apparent that even further increases in belt tension have to be generated in order to fully support the weight W of the bale 502 (i.e., to lift the bale 502 sufficiently out of the trough 510 formed by the previously existing slack in the endless compression belt 506).

In addition to increasing the tension in the belt 506 to the highest point it reaches during the entire baling process, once the bale 502 is lifted sufficiently out of the trough 510 as shown in FIG. 36C, the belt direction (indicated by arrow 520) may need to be reversed from the direction that it was moving during the bale formation, in order to move the bale off of the end of the tailgate 500. Thus, this prior embodiment required both tremendous belt tensions and reversing the motors in order to unload each bale 502. Such high belt tensions can limit the life of the belt 506, and the need to fully reverse the direction of the belt 506 undesirably increases the total processing time required to create and unload the bale 502.

Figure 37C:
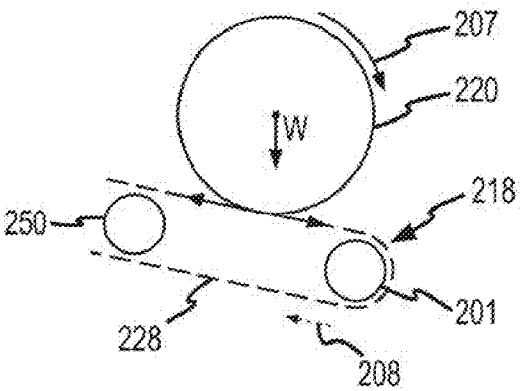
FIGS. 37A, 37B, and 37C are schematic views of the baler depicted in, for example, FIGS. 9 and 10, showing delivery of a bale off of a tailgate having enhanced bale-deployment characteristics.
Figure 37B:
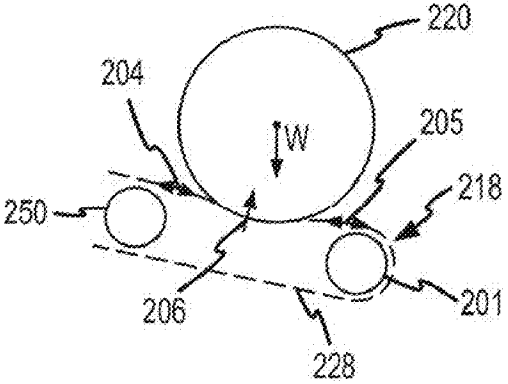
Figure 37A:
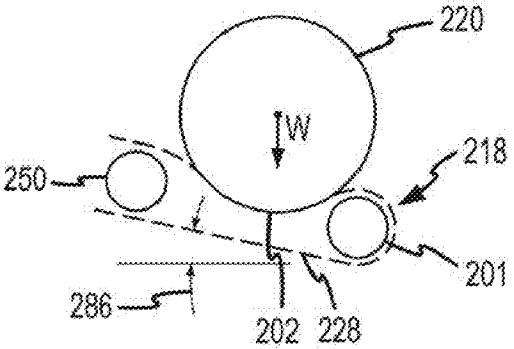

FIGS. 37A, 37B, and 37C depict schematically how the new embodiments address some of these concerns. The embodiment of baler 200 depicted in FIGS. 9 and 10 is most similar to what is represented schematically in FIGS. 37A, 37B, and 37C. As may be observed from comparing FIGS. 36A to 37A, the tailgate slope angle 286, when the tailgate 218 is in the bale-delivery position, has been increased. In one embodiment of the improved mechanism, the tailgate 218 is lowered an additional 6°, from 5.98° to 11.98° below the horizontal. This relatively steep tailgate slope angle was not used in the prior art because of concerns that the bale would roll off of the distal end of the tailgate prematurely. In FIG. 37A, the tailgate 218 has just initially reached its fully-opened configuration. Again, the slack in the belt 228 and weight (indicated by W) of the bale 220 has permitted the formation of a trough 202 in which the bale 220 rests in FIG. 37A. Since the tailgate 218 is at a steeper angle 286, however, less belt tension is required to lift the precursor bale 220 out of its trough 202. Further, also in view of the relatively steeper tailgate slope angle 286 in the depicted bale-delivery position, the bale 220 tends to naturally roll in the direction of arrow 207 off of the distal edge of the tailgate 218 as soon as sufficient belt tension (indicated by arrows 204 and 205) has been applied to lift the bale 220 in the direction of arrow 206 out of the trough 202. As represented by the dashed arrow 208 in the bottom of FIG. 37C, it is still an option to run the endless compression belt 218 in the opposite direction if necessary (e.g., if the bale 220 hangs up on the compression roller 201).

It is noted that the tailgate slope angle 286 depicted in FIG. 37A has been determined through empirical studies to establish a tailgate slope angle 286 that "motivates" the bale to leave the tailgate 218, without sending the bale rocketing off the end of the tailgate prematurely. Also, control system improvements have made it possible to more carefully control the specific position of the tailgate making it possible to implement the steeper sloped configuration.

Figure 38A:
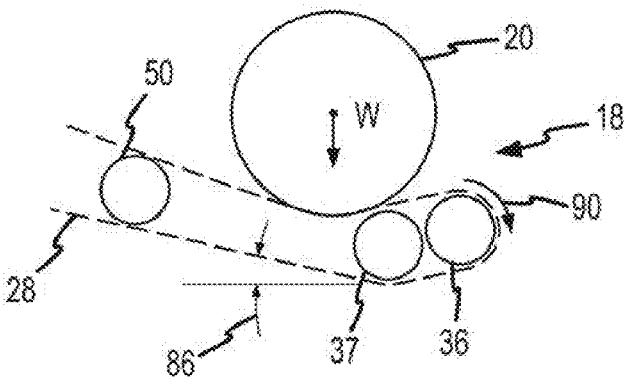
FIGS. 38A and 38B are schematic depictions of the baler also shown in, for example, FIGS. 1-8, delivering a precursor bale off of the tailgate.
Figure 38B:
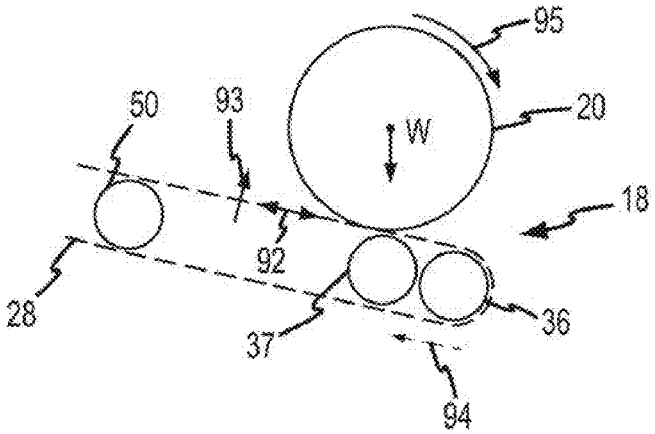

FIGS. 38A and 38B essentially depict the embodiment of the baler 10 that is also shown in FIGS. 1-8. As mentioned above in connection with FIGS. 7 and 8, this configuration of the baler 10 comprises a tilt roller pair 36, 37. The tilt roller pair 36, 37 can be used to contain the bale 20 on the distal portion of the tailgate 18 until it is time to move the bale 20 off of the tailgate 18. In particular, as shown in FIG. 38A, the tilt roller pair 36, 37 is tilted upward and thereby stops the bale 20 exiting the baling chamber from rolling off the distal edge of the tailgate 18. Once the bale 20 is stabilized in the position shown in FIG. 38A, the tilt roller pair 36, 37 can be rotated the opposite direction (see the curved arrow 90 near the distal edge of the tailgate in FIG. 38A) so that the bale 20 may roll off the end of the tailgate 18 to the awaiting transfer belt or wrapping table (e.g., belt 88 shown in FIG. 8). If necessary, the belt tension may be increased (see, the double-headed arrow 92 in FIG. 38B) to lift the belt in the direction of the arrow 93 in FIG. 38B and/or the belt 28 may be operated in the direction of dashed arrow 94 to help roll the bale 20 off of the tailgate 18 in the direction of arrow 95.

Figure 39:
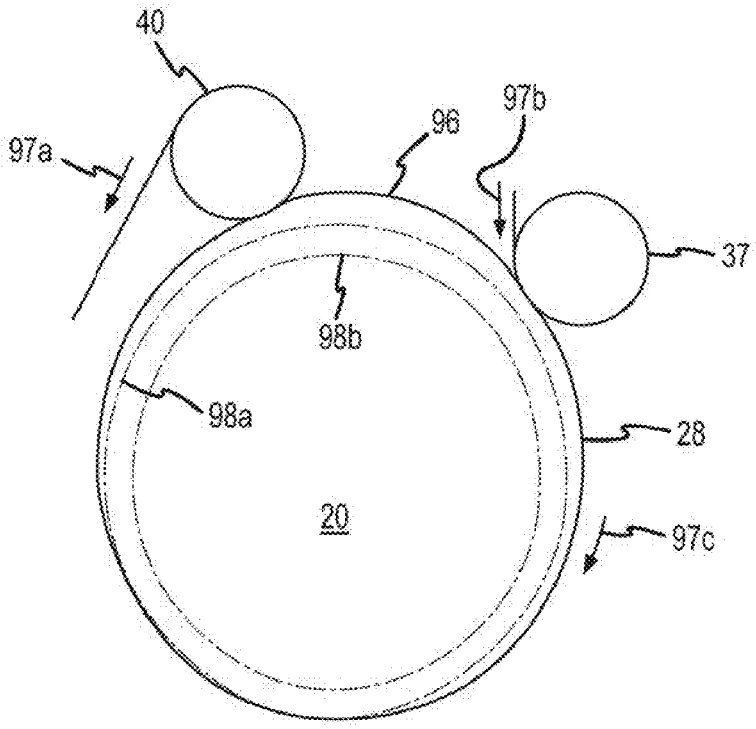
FIGS. 39-42 schematically depict the bulges that form at the throat of the compression chamber under different simulated conditions and baler configurations.
Figure 40:
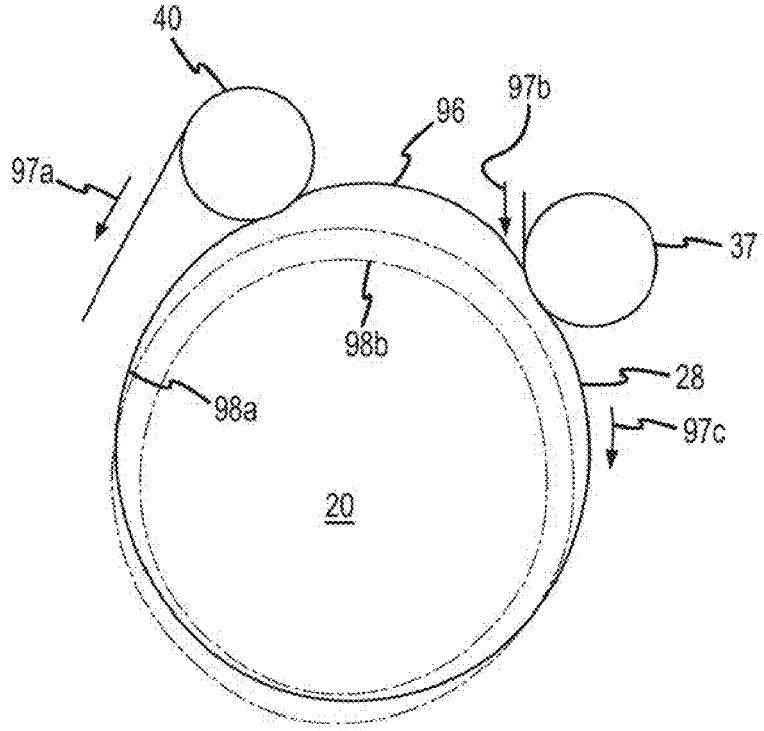
Figure 41:
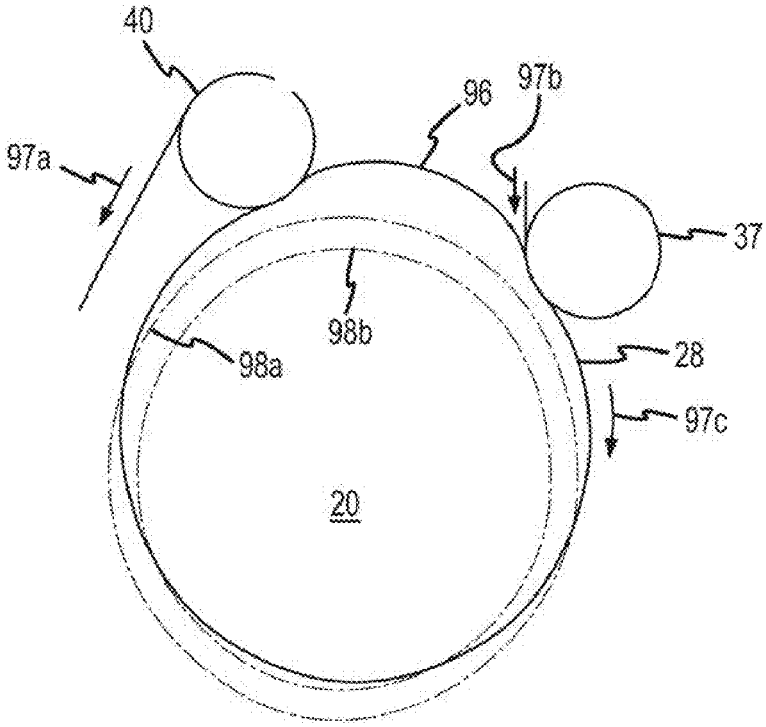
Figure 42:
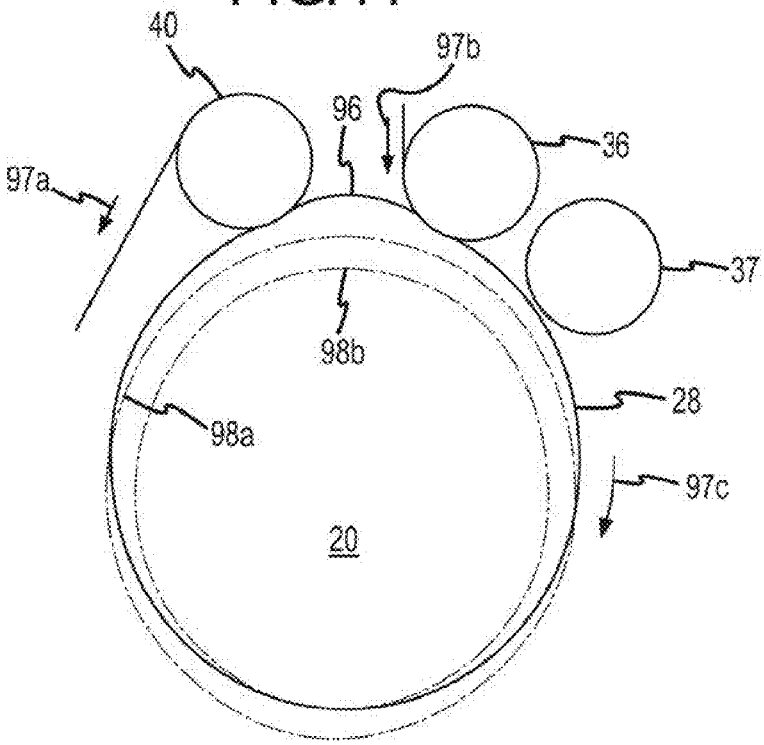

Each of FIGS. 39-42 is a graphical depiction of the results of a computer simulation. For each of these figures, the same starting parameters were used (e.g., the same amount of material was assumed to be in the baling chamber, and the material was assumed to have exactly the same properties for each of the four simulations). FIGS. 39-42 depict the bulge 96 that forms when the tension on the endless compression belt 28 is increased. In FIGS. 39-42, the endless belt 28 is traveling in the direction of the three arrows 97*a*, 97*b*, and 97*c* appearing in each of the four figures. In FIGS. 39-41, the baler 10 is assumed to be operating in the configuration depicted in, for example, FIGS. 3 and 4. In other words, the distal tilt roller 36 of the tilt roller pair 36, 37 is not shown in FIGS. 39-41, but would be directly above the proximal tilt roller 37, which is shown in these three figures and which is acting as the compression roller. In FIG. 42, the baler 10 is assumed to be operating in the configuration depicted in, for example, FIG. 6. There are two concentric dashed rings 98*a*, 98*b* also depicted in each of FIGS. 39-42. The outer dashed ring 98*a* represents the outer circumference of a large baler end plate 30*a*, 30*b*, and the inner dash ring 98*b* represents the outer circumference of a smaller baler end plate 30*a*, 30*b*.

In FIG. 39, the tension of endless belt 28 was simulated to be at a first, relatively low tension. For FIG. 40, the baler 10 was assumed to have the same configuration that it had for the simulation of FIG. 39, but the belt tension was simulated to be at a higher tension than for the FIG. 39 simulation. In FIG. 41, the baler 10 was again assumed to have the same configuration as the baler 10 used for the simulations of FIGS. 39 and 40, but the belt tension used in the simulation that generated the drawing of FIG. 41 was assumed to be higher than the belt tension used for the simulations that resulted in FIGS. 39 and 40. For FIG. 42, the belt tension is assumed to be the same as the belt tension of FIG. 41. In the FIG. 42 simulation, as mentioned above, the distal tilt roller 36 has been rotated toward the baling chamber and into contact with the outer surface of the bale 20, so it is acting as the compression roller. In FIG. 42, the proximal tilt roller 37 is no longer acting as the compression roller as it was for the simulations depicted in FIGS. 39-41. Thus, in FIG. 42, the gap between the drive roller 40 and the effective compression roller has been reduced.

Referring back to FIG. 39, at this relatively low simulated belt pressure, a small bulge 96 has started to form in the gap between the drive roller 40 and the compression roller (i.e., the proximal tilt roller 37). Further, as shown in FIG. 39, the compression forces being placed upon the material that is being baled could be applied with a large end plate in place, which is evident since the belt 28 is shown at the lower portion of FIG. 39 as tracking closely with the outer dashed ring 98*a*.

In FIG. 40, the simulated belt tension is relatively higher than the belt tension used for FIG. 39. Under this higher belt tension, the bulge 96 has increased in size. Also, it is evident from FIG. 40 that, in order to achieve this higher compression of the material that is being baled, it would be necessary to have the smaller bale chamber end plates in place. This is evident since the endless belt 28 is depicted as traveling inside the outer dashed ring 98*a*, which represents the outer circumference of the larger bale chamber end plate. Thus, it is evident from FIG. 40 that in order to achieve these simulated compressions of the material in the bale chamber, a smaller bale chamber end plate is required.

One way of looking at FIGS. 39-42 is to think of the compression roller as a tire that is trying to drive over the bulge 96 forming in the gap between the compression roller and the drive roller 40. Using this analogy, it is clear that the "tire" (i.e., the compression roller) could more easily "drive over" the bulge 96 depicted in FIG. 39 than the bulge 96 depicted in FIG. 40.

In FIG. 41, the belt tension has been increased again. This time the belt pressure is greater than the simulated belt pressure used for the simulation depicted in FIGS. 39 and 40. In FIG. 41, the bulge 96 has become unmanageable (i.e., the "tire" can no longer drive over the bulge). Thus, when the compression reaches the level used for the simulation that resulted in the drawing of FIG. 41, the baler motors would stall and/or the bale would burst at the bulge 96 and require the baler 10 be shutdown. Also, since the endless belt 28 is now shown as traveling within both dashed rings 98*a* and 98*b*, this makes it clear, if no additional material is added to the bale 20, that an even smaller end plate is required (or one of the existing end plates must be shifted up and to the right), or the depicted compression cannot be achieved.

To create FIG. 42, the simulation was run at the same belt tension used for the FIG. 41 simulation. In FIG. 42, however, the distal tilt roller 36 was rotated toward the baling chamber and into contact with the outer surface of the bale 20 that is being formed. Thus, with the distal tilt roller 36 brought into play, it becomes the compression roller, and the proximal tilt roller 37, which had been acting as the compression roller in the simulations of FIGS. 39-41, is no longer acting as the compression roller. Keeping in mind that the belt tension used in the simulation that created FIG. 42 is the same as the belt tension used in the simulation that created FIG. 41, some interesting things can be seen. First, the bulge 96 is now manageable again. That is, the "tire" (i.e., the distal tilt roller) is able to "drive over" the bulge 96. Further, the endless belt 28 is now remaining outside of the smaller dashed circle 98*b*. Thus, with the tilt roller pair 36, 37 in place and positioned as shown in FIG. 42, a never before achievable compression ratio is now possible as long as the smaller bale chamber end plate is used and the tilt roller pair 36, 37 is positioned as shown.

In essence, the gap size between the drive roller 40 and the compression roller limits the maximum density achievable for a given amount of a given type of material. Thus, the baler 10 depicted to best advantage in FIGS. 2-8 is able to achieve previously unattainable compression levels without stalling the drive motors (i.e., higher bale densities using less power). When the tilt roller pair 36, 37 is positioned as shown in FIG. 42, not only is the bulge 96 in the gap controlled, but also the capture angle is improved, delivering more frictional force to the waste being introduced in the gap between the drive roller 40 and the compression roller, making it possible to ingest additional material into the bale 20 that is being formed. Since the tilt roller pair 36, 37 is adjustable, it is possible to open the throat until the smaller gap becomes necessary for "bulge control."

Figure 43:
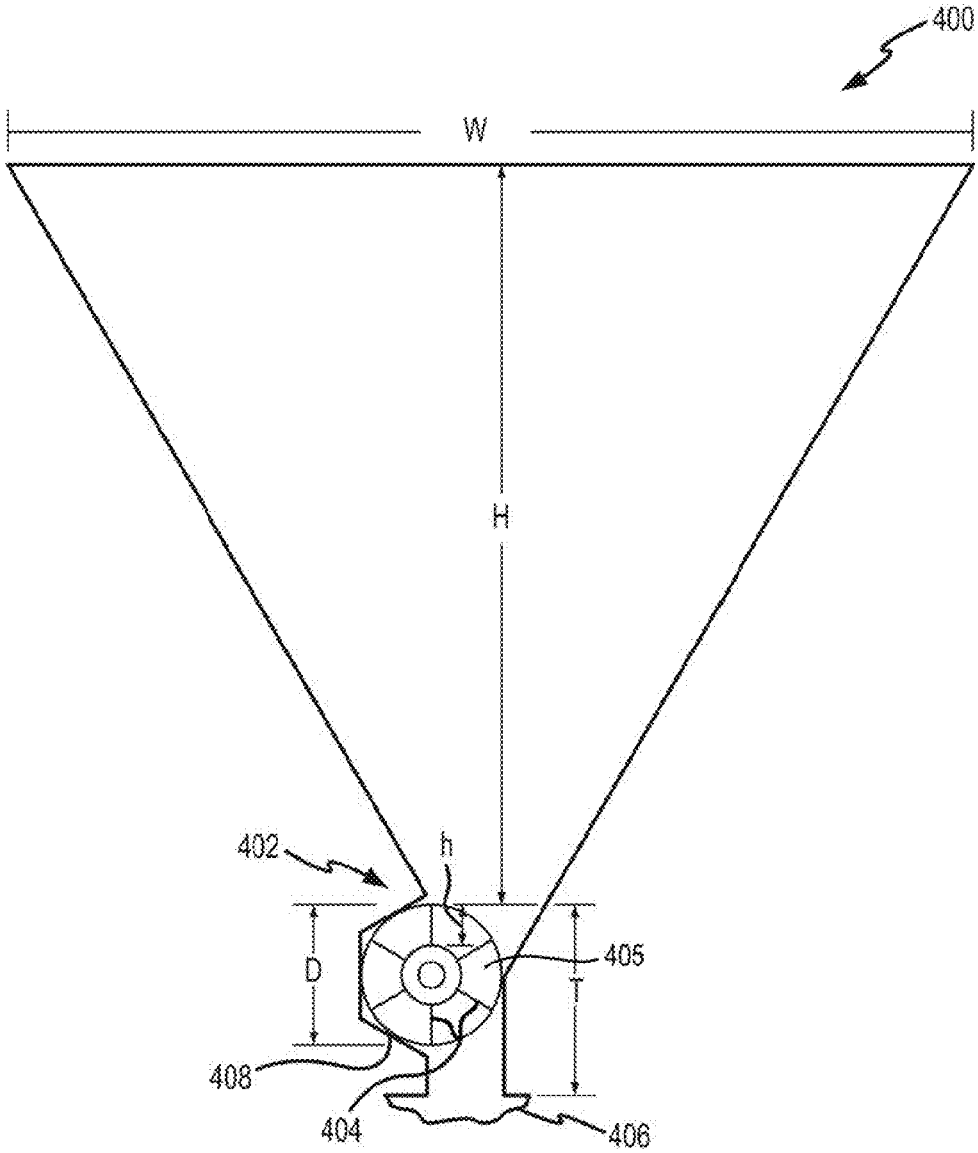
FIG. 43 depicts one possible embodiment for a super-charging hopper that may be used in conjunction with a baler, such as the balers of FIGS. 1-8 (first embodiment), 9 and 10 (second embodiment), and 11-14 (third embodiment).

FIG. 43 depicts a sample super-charging hopper 400 that may be used in combination with any of the balers disclosed herein. In one preferred form of this super charging hopper 400, the width, W, is approximately 34 feet, and the height, H, is approximately 26 feet. Further, in this one preferred embodiment of the super-charging hopper 400, the vane feeder 402 includes feeder vanes 404 having a height, h, of approximately 1½ feet. The vane feeder 402 has an overall diameter, D, of 5 feet. Further, in this one preferred configuration, the distance from the top of the baler to the top of the vane feeder 402, T, is approximately 7 feet. Material to be baled (e.g., shredded municipal solid waste) can be dumped into the super-charging hopper 400.

The vane feeder 402 depicted in FIG. 43 comprises six metered chambers 405, present between feeder vanes 404, that deliver the material in the super-charging hopper 400 to the delivery chute 406, which feeds directly into the entry path or throat (see, e.g., throat 24 in FIGS. 3-5) of the baler. As shown in FIG. 43, the left portion of the vane feeder 402 is protected by a shield 408 that prevents material in the super charging hopper 400 from being delivered to the empty metered chambers on the left side of the vane feeder 402 (since the vane feeder 402 turns clockwise, the fact that these upward-traveling, metered chambers are empty means that the vane feeder motor requires less force to deliver material from the super-charging hopper 400 to the delivery chute 406 and ultimately to the throat of the baler). The vane feeder 402 may turn at, for example, 15 RPMs.

FIG. 44 is an isometric view of one embodiment of a system incorporating the baler 10 depicted in FIG. 1. As shown in FIG. 44, the system includes a closed chute 410 to deliver material to be baled from, for example, a hopper 412 and/or a shredder 413. The material to be baled alternately may be delivered by a super-charging hopper 400 (shown in phantom), or the open belt 416 depicted in, for example, FIG. 45 may be used to deliver material to be baled to the baler 10. As shown in FIG. 44, the baler 10 may be followed by a wrapping station 414 that completely encapsulates the precursor bale, thereby creating a hermetically sealed bale for subsequent disposition.

FIG. 45 is similar to FIG. 44, but depicts one possible system incorporating the baler 300 of, for example, FIG. 11 with other components. In FIG. 45, the material from the hopper 412 is delivered on an open belt 416 to the baler 300. The precursor bales 348 (see, e.g., FIG. 14) are then delivered to a wrapping station 414 that incorporates, for example, a heli-wrapper. The encapsulated (e.g., hermetically sealed) bales 418 are then moved by another conveyor 420 to a location where they can be off-loaded.

Figure 46:
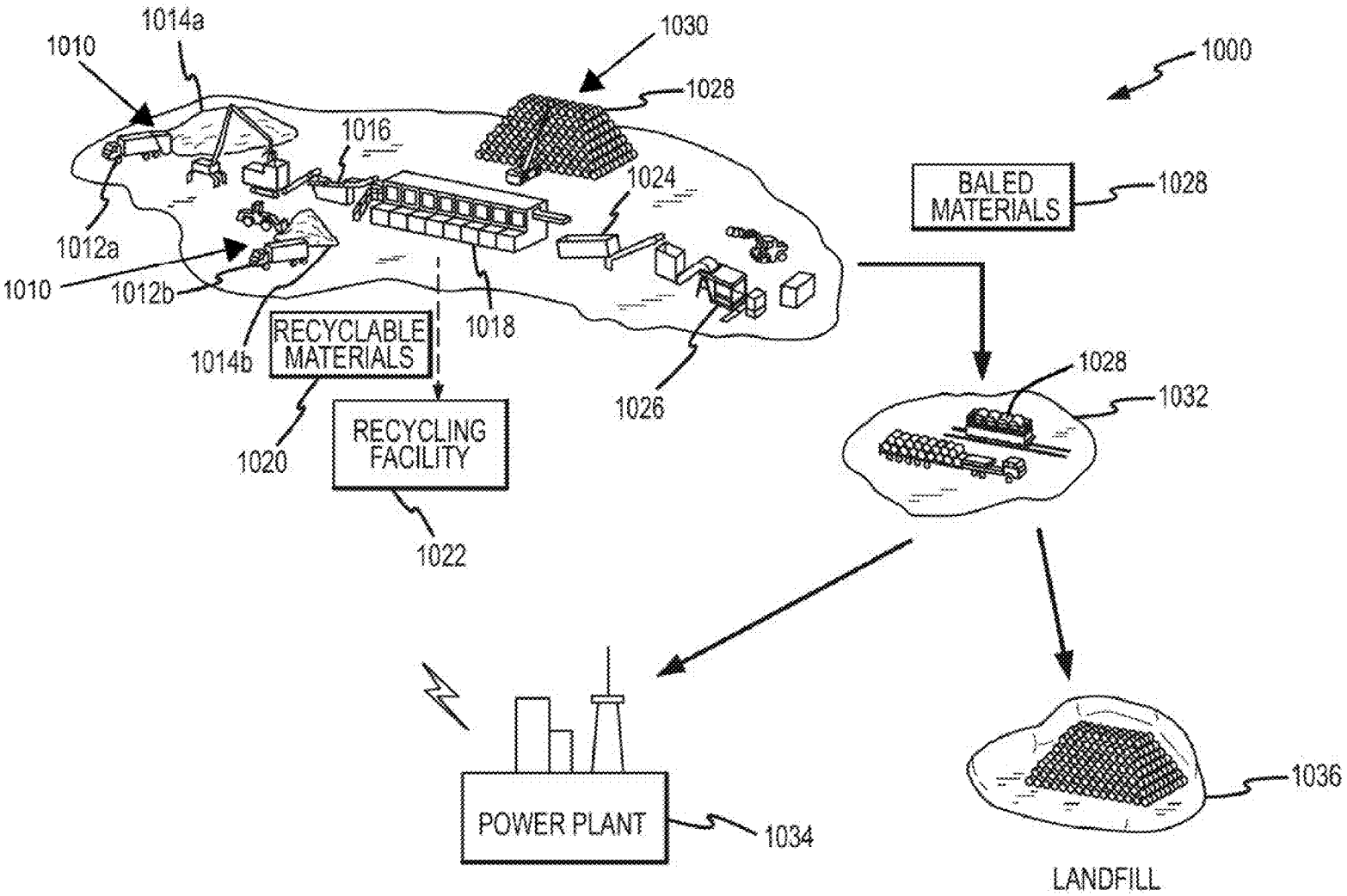
FIG. 46 depicts one possible overall system for processing and baling loose waste or other material, from initial collection through final disposition of a plurality of bales.

FIG. 46 shows one possible overall system 1000 for using the balers according to the present invention. In the upper left-hand portion of FIG. 46, a couple of tipping stations 1010 are shown where trash hauling trucks 1012*a*, 1012*b* have dumped their loads, creating piles of unbaled waste 1014*a*, 1014*b* or other material to be baled. As shown in this figure, this loose material is then loaded into a hopper or shredder 1016. From the hopper or shredder 1016, it may be delivered to a sorting facility 1018 to extract recyclable materials 1020 for subsequent delivery to a recycling facility 1022. Once the material that is to be baled has been sorted from the recyclable material 1020, a secondary hopper 1024 may be used to ultimately deliver the material to be baled to the baler 1026. As shown, the completed bales 1028 may be temporarily placed in a pile 1030 until they can be moved by, for example, rail, truck, barge, or container as shown by transportation element 1032 in FIG. 46 to, for example, a power plant 1034 or a landfill 1036.

Figure 47:
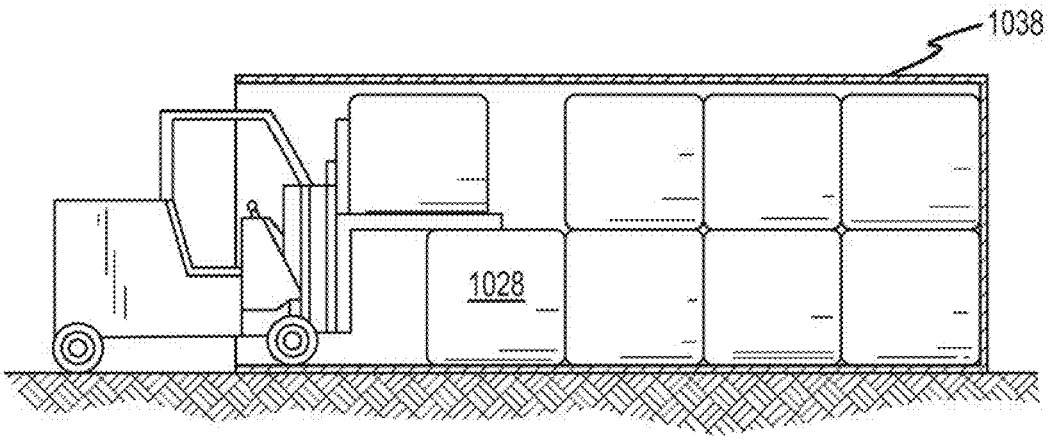
FIG. 47 is a side view in partial cross-section showing a forklift loading cylindrical bales into a shipping container.
Figure 48:
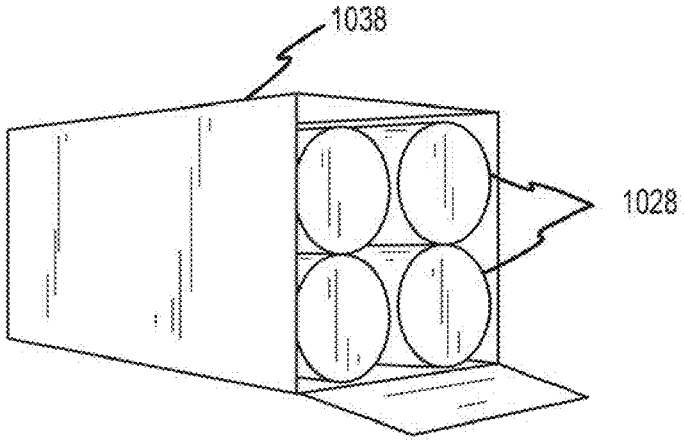
FIG. 48 is an isometric view of the shipping container depicted in FIG. 47, full of cylindrical bales and with the container door still open.
Figure 49:
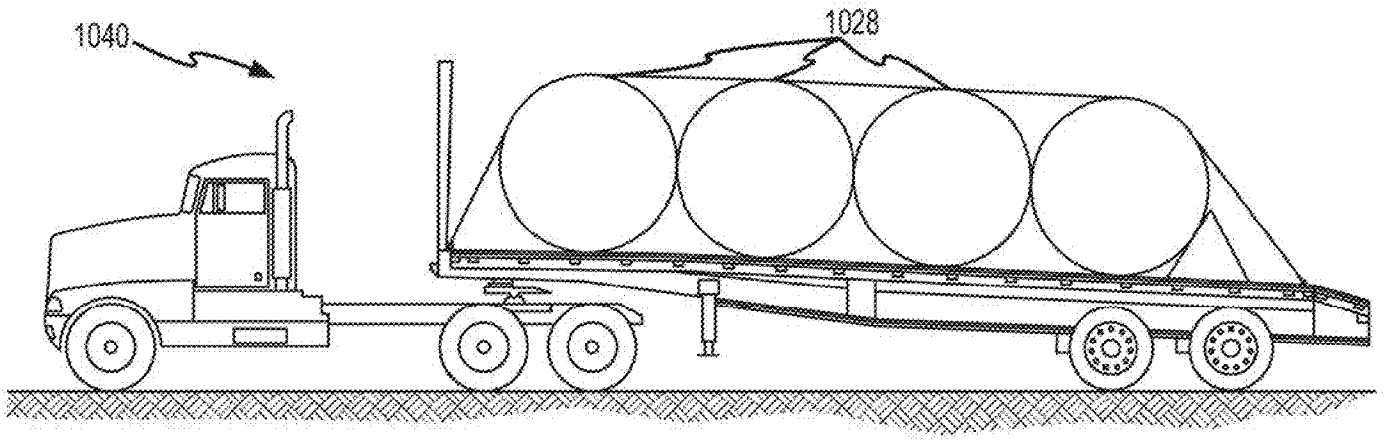
FIG. 49 depicts a plurality of cylindrical bales being moved by truck.
Figure 50:
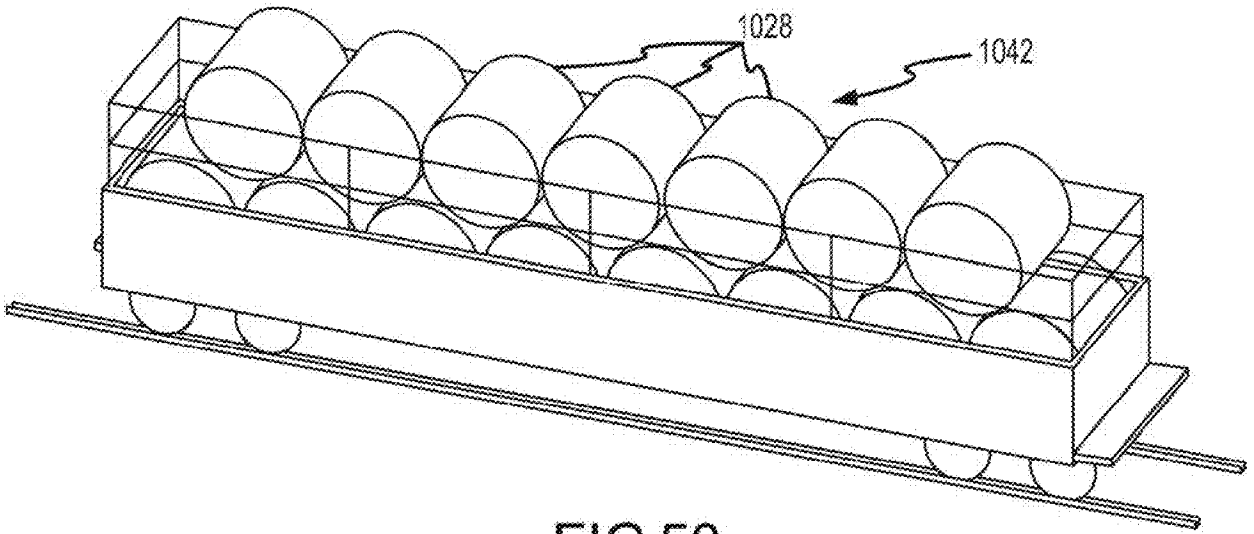
FIG. 50 depicts a plurality of cylindrical bales being moved by railcar.
Figure 51:
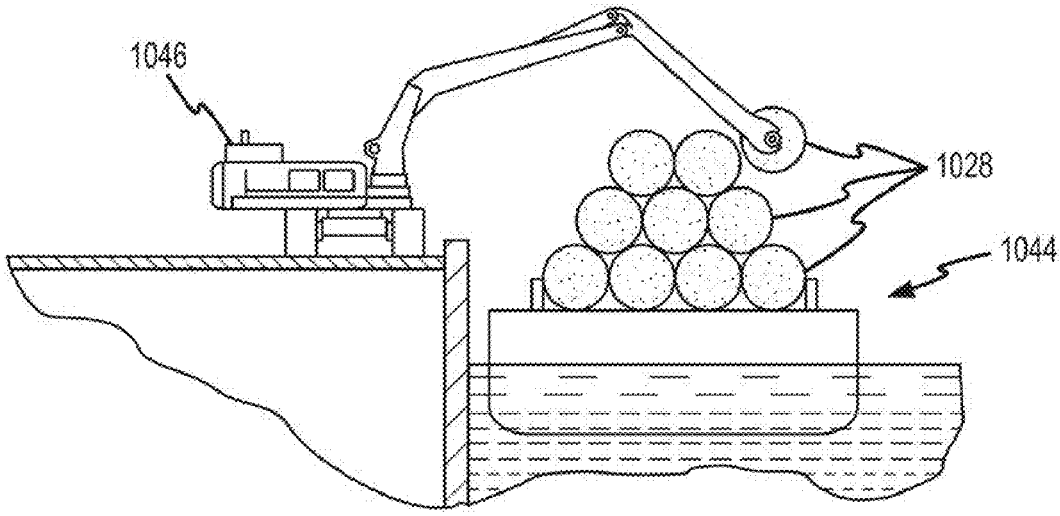
FIG. 51 depicts a bale handler on a dock loading cylindrical bales onto a floating barge.

FIGS. 47 and 48 depict a shipping container 1038 that may be used to move bales 1028 from where they are baled to another location. Since the bales 1028 may be hermetically sealed, the shipping container 1038 does not necessarily need to be a dedicated container that is used only to move waste, for example. FIG. 49 depicts four bales 1028 on a truck 1040, and FIG. 50 depicts fifteen bales 1028 on a railcar 1042. Similarly, FIG. 51 depicts nine bales 1028 on a barge 1044 and a tenth bale 1028 being loaded onto the barge 1044 by a bale handler 1046. Using the balers according to the present invention, bale size and weight may be customized for a particular situation. For example, using the balers described above, bales 1028 may be customized in both length and weight to fit snugly within the shipping container 1038 depicted in FIGS. 47 and 48, while maximizing the weight carrying capacity of that container 1038. Similarly, the balers described above may be readily configured to provide the four bales 1028 shown in FIG. 49 in a dimension that fits the truck 1040 and a weight that maximizes the truck's weight carrying capability. The same holds true for the railcar 1042 of. FIG. 50 and the barge 1044 of FIG. 51. For example, if the railcar 1042 depicted in FIG. 50 can hold fifteen bales 1028 and carry one hundred five tons; the balers described above can be configured to produce bales that weigh seven tons each and that are dimensioned to fit snugly within the railcar 1042, thereby filling the railcar 1042 both dimensionally and at its maximum desired weight-carrying capacity.

Figure 52:
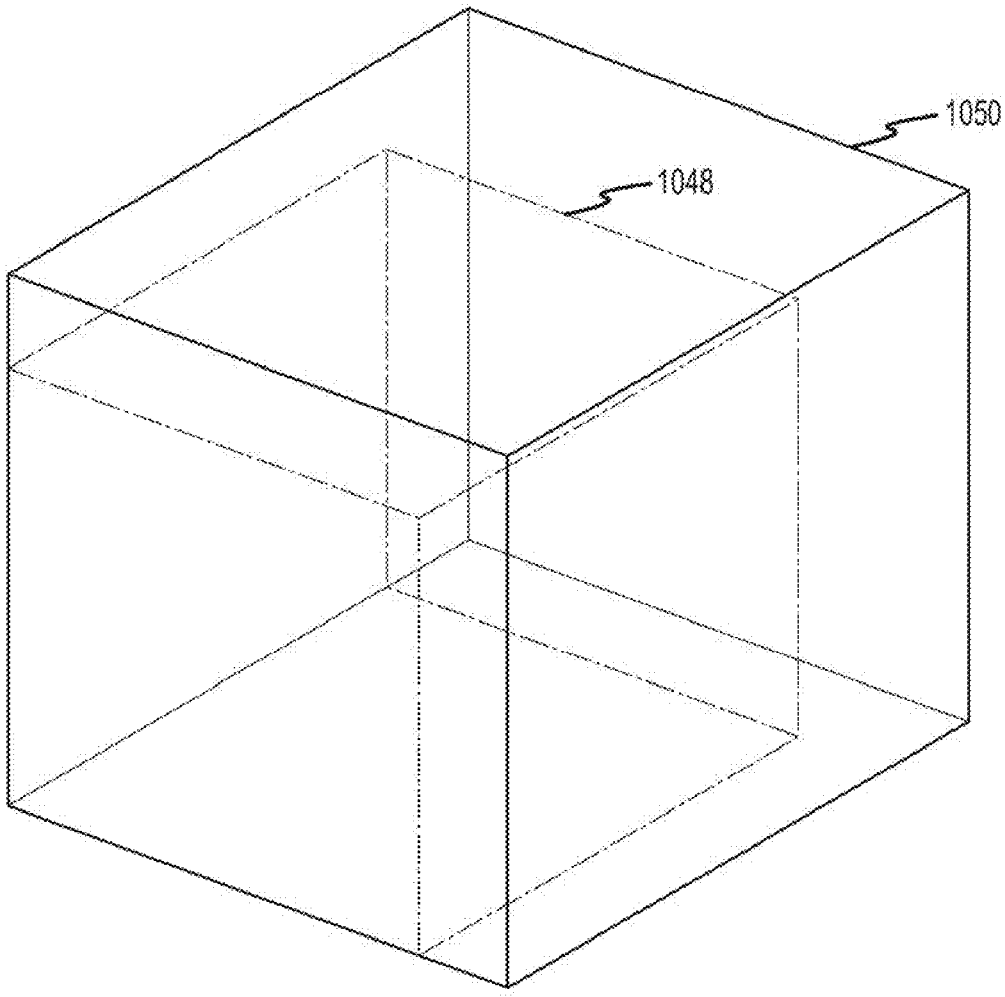
FIG. 52 graphically depicts a sample of the volumetric efficiencies that may be attained by using the balers according to the present invention to make better use of available landfill volume.

Using the balers described above in certain scenarios, it is possible to, for example, fit the same amount of municipal solid waste in 55% of the volume that would otherwise be required to handle that waste in a landfill where the waste was being delivered to the landfill in an unbaled state. FIG. 52 schematically depicts the volume savings. In particular, the dashed box 1048 within the larger box 1050 is shown as taking up 55% of the volume of the large box 1050. Even before taking into account settling and compression resulting from overburden, much more efficient use may be made of the volume available in various landfills.

Figure 53:
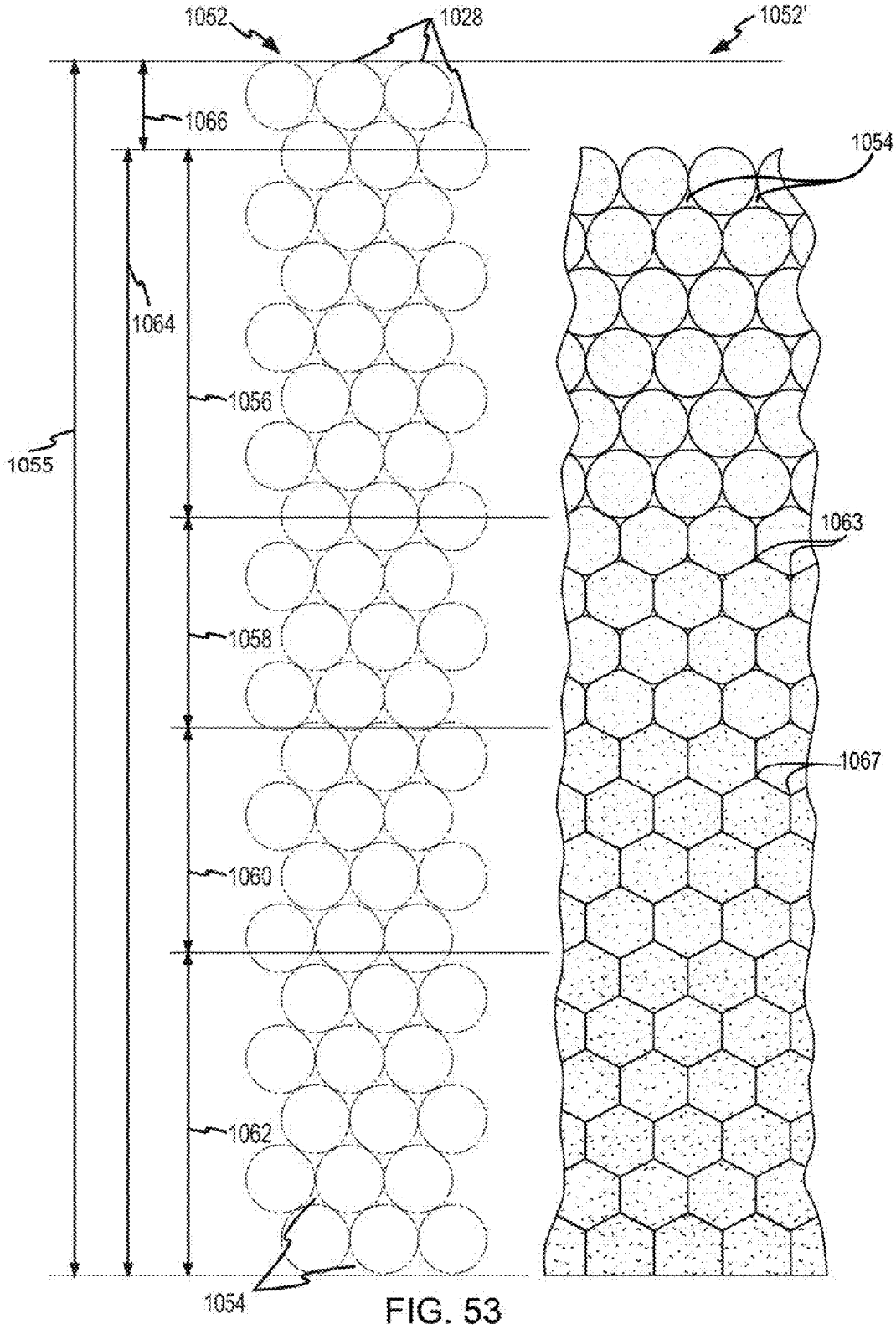
FIG. 53 depicts in phantom twenty rows of bales stacked on top of each other in, for example, a landfill, immediately after being placed in the landfill; and this figure also shows, on its right side, how the gaps between the cylindrical bales eventually close due to overburden and time.

FIG. 53 graphically represents additional long-term gain in landfill volume savings that may be achieved using the balers described above. On the left side of FIG. 53, in phantom, is a stack 1052 including twenty rows of bales 1028 stacked one on top of another in four-bale rows. Since the bales 1028 are cylindrical, initially there may be air gaps (e.g., air gaps 1054) present in the stack of bales 1028. In particular, for certain applications and bale sizes, the air gaps 1054 can account for approximately 10.27% of the total landfill volume (represented by arrow 1055). Over time, however, and due to the pressure placed on bales 1028 that are deeper in a landfill by the bales 1028 stacked on top of those deeper bales (i.e., due to the overburden), the air gaps 1054 between adjacent bales tend to decrease over time. This is graphically represented by the bale stack 1052' on the right-hand portion of FIG. 53. In this portion of FIG. 53, the top six rows 1056 of the aging stack 1052' are depicted with the original air gaps 1054 comprising 10.27% of the total volume 1055. The next four rows 1058 depict the bales 1028 with smaller air gaps 1063 comprising only 3.52% of the total volume 1055. The next four rows 1060 depict bales 1028 with still smaller air gaps 1067 (hardly detectable in FIG. 53) comprising only 0.88% of the total volume 1055. And, the final six rows 1062 demonstrate schematically that, with sufficient time and pressure, the cylindrical bales 1028 eventually settle into all of the air gaps, resulting in few or even no air gaps between adjacent bales 1028. The overall volume has decreased as represented by arrow 1064, and additional savings in landfill volume, for example, is represented by arrow 1066 at the top of FIG. 53.

Figure 54:
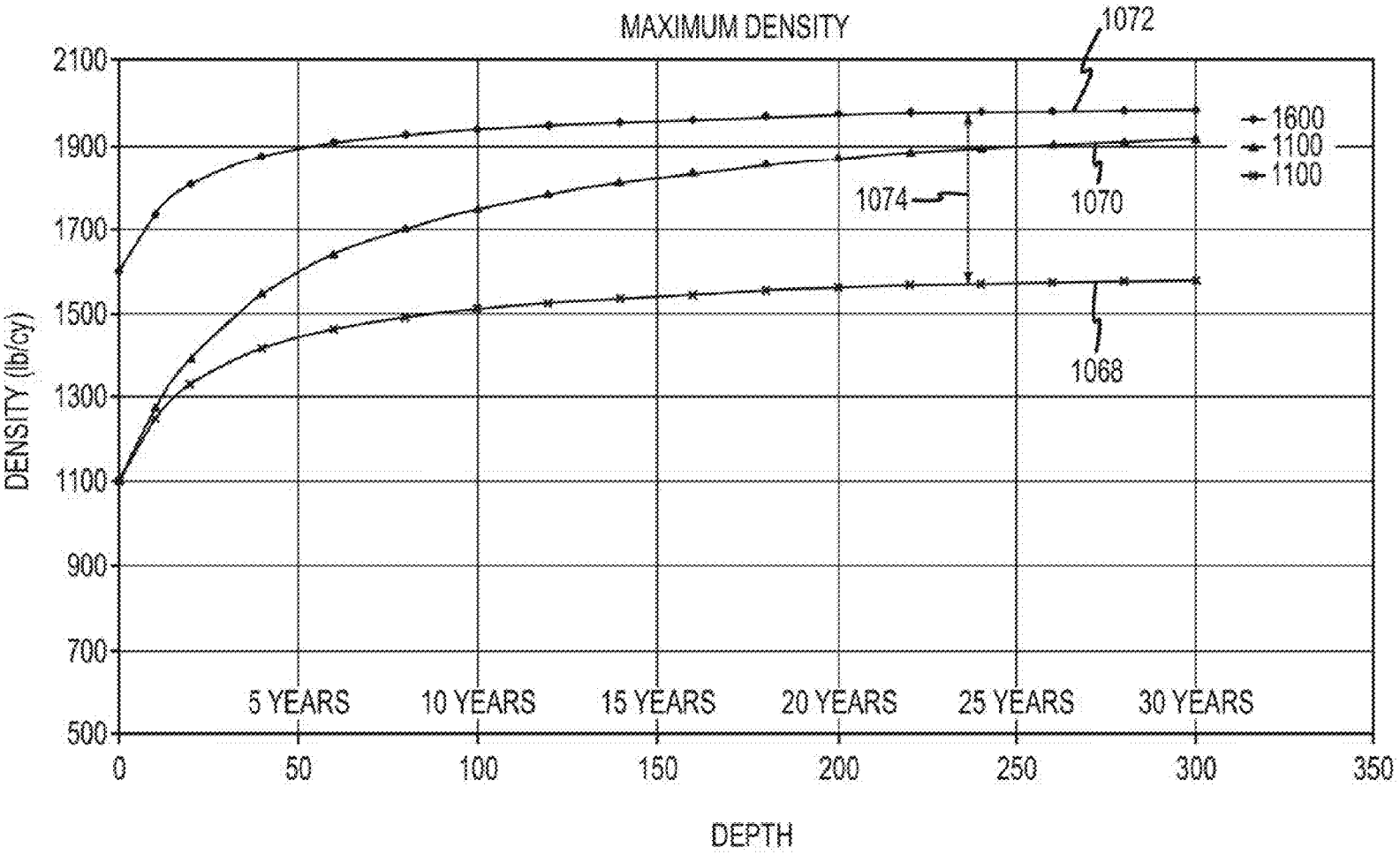
FIGS. 54 and 55 are charts showing some of the volumetric efficiencies that are possible when using the balers according to the present invention rather than conventional means in a landfill.
Figure 55:
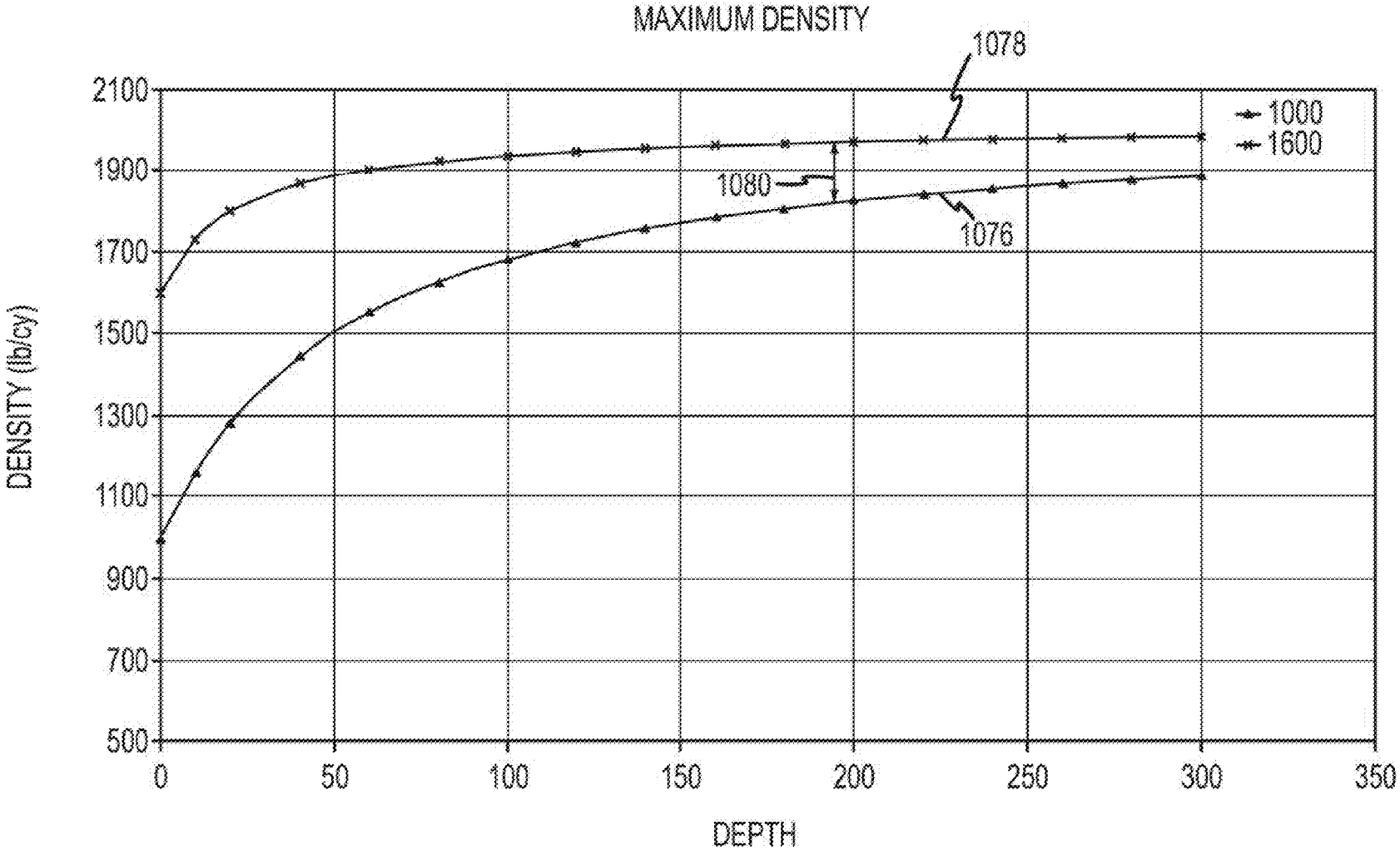

FIGS. 54 and 55 depict in another way the savings that may be achieved through use of the balers described above when the bales 1028 are being placed in a landfill 1036 (FIG. 46). In particular, looking at FIG. 54, three different curves are presented. The lowest curve 1068 (formed through a series of asterisks) represents densities achieved over time and depth of consolidated loose municipal solid waste (MSW) with initial density at 1100 lbs. per cubic yard and realistic compaction conditions taken into account. Thus, the left end of line 1068 starts at the surface at 1100 lbs. per cubic yard. 1100 lbs. per cubic yard is thought by some to be an attainable compaction for loose MSW when it is driven over and compacted by typical landfill surface-working equipment. The right end of line 1068 asymptotically approaches approximately 1600 lbs. per cubic yard at a landfill depth of approximately 300 feet after thirty years.

The intermediate line 1070 on FIG. 54, which passes through a series of triangles, represents the density of consolidated MSW with the initial density at 1100 lbs. per cubic yard (like line 1), but with ideal shredding and compaction. Again, the left end of this intermediate line 1070 shows that it starts at 1100 lbs. per cubic yard at the surface of the landfill. This initial density for the MSW is again thought by some to be achievable by the surface-working equipment at the landfill driving over the MSW. In this case, assuming ideal shredding and compaction, at 300 feet depth in the landfill after thirty years, the MSW asymptotically approaching a density of approximately 1900 lbs. per cubic yard.

Using the balers of the present invention, it is possible to compact the MSW to approximately 1600 lbs. per cubic yard in the baler. Thus, the top line 1072 in FIG. 54 starts at its left-hand end at 1600 lbs. per cubic yard at the surface. This particular line 1072, which passes through a series of circles, represents the density of a "balefill" (i.e., a landfill in which only bales have been placed rather than loose MSW) with initial bale densities at 1600 lbs. per cubic yard. Under these circumstances, the bales 1028 in the balefill at a depth of 300 feet after thirty years would be expected to asymptotically approach a density of approximately 2000 lbs. per cubic yard as represented by the right-hand end of line 1072.

The vertical distance between the different lines depicted on FIG. 54 are proportional to the amount of landfill volume used under each scenario. Thus, for example, the vertical gap 1074 between curves 1068 and 1072 clearly shows that a substantial volume in the landfill will be conserved if a balefill is used rather than a conventional MSW landfill.

FIG. 55 is similar to FIG. 54. Since 1000 lbs. per cubic yard is thought by many to be a more realistic estimate of the surface compaction for loose municipal solid waste, curve 1076, which passes through a series of small triangles, is drawn as starting at 1000 lbs. per cubic yard at the surface and becoming asymptotically approaches approximately 1900 lbs. per cubic yard at a landfill depth of approximately 300 feet. The upper line 1078 in FIG. 55, which passes through a series of small asterisks in this figure, is similar to line 1072 in FIG. 54 and again represents density of a balefill with initial bale densities at 1600 lbs. per cubic yard. Again, at approximately 300 feet of depth in the landfill, the density of the balefill asymptotically approaches approximately 2000 lbs. per cubic yard. As previously discussed, the vertical distance 1080 between these lines is directly proportional to the volume of landfill saved by starting with the high-compression bales that are producible using the balers described above.

Figure 56:
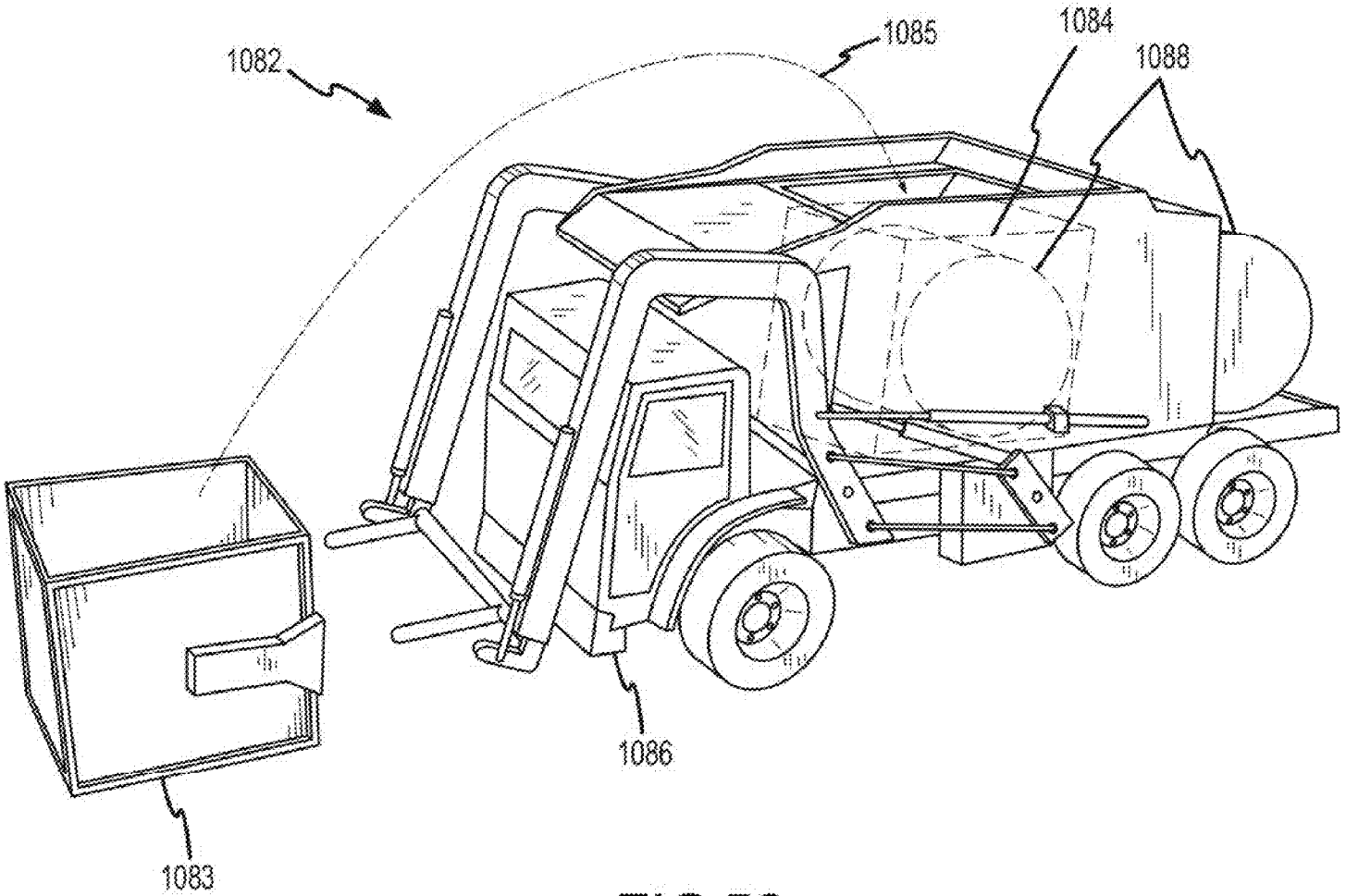
FIG. 56 is an isometric view that schematically depicts a trash truck configured with a baler and used for curbside pickup of, for example, municipal solid waste.

FIG. 56 is an isometric view of an embodiment of a mobile baler 1082 wherein a baler 1084 is mounted on a mobile trash truck 1086. As depicted, this mobile baler 1082 would dump trash from, for example, dumpsters or other curbside pick up receptacles 1083 directly into the throat of the baler 1084, as indicated by arrow 1085. While the truck 1086 was parked or moving to its next pickup, baler 1082 could work on compressing the deposited materials. Once a full bale 1088 was produced, it could be wrapped and then stored on the back of the truck 1086 until it was time for a trip to the landfill. As shown in FIG. 56, one finished bale is being carried on the back of the truck 1086 and a second bale (shown in dashed lines) is being formed in the baler 1084. As soon as these two bales 1088 are complete, the truck 1086 could make a trip to the landfill to off-load the two complete bales 1088.

Figure 57:
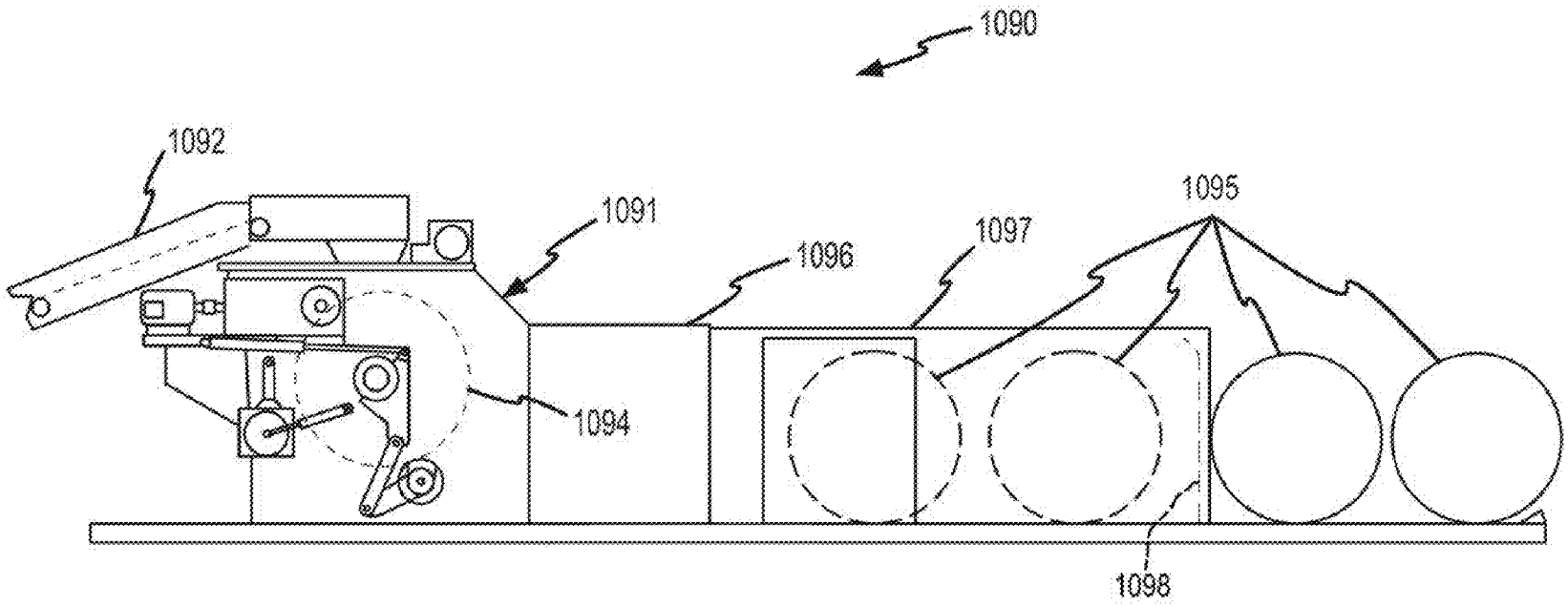
FIG. 57 is a schematic side view of a baling system that could be used in lieu of a trash compactor behind a business that generates a fairly high volume of waste.

FIG. 57 depicts another application for the balers described above. Frequently, large trash compactors may be found installed at large office facilities, restaurants, or hotels that produce a high volume of waste. The baling system 1090 depicted in FIG. 57, including one of the balers described above, could be used in place of these trash compactors. As shown in FIG. 57, trash could be input, possibly by a conveyor 1092, into the top of the baler 1091. The baler 1091 would then be activated (possibly automatically) and would eventually form a precursor bale 1094. The precursor bale 1094 would be delivered from the baler 1091 to a bale wrapper 1096, which is indicated schematically in FIG. 57. The bale wrapper 1096 is depicted in more detail in, for examples, FIGS. 44 and 45. Completed and wrapped (e.g., hermetically sealed) bales 1095 could then be stored internally and/or externally at the site.

In FIG. 57, two complete, hermetically-sealed bales 1095 are shown contained within the housing 1097 of the baler system 1090 to prevent, for example, tampering. Also shown in FIG. 57 is an optional door 1098 that could completely seal the baler system 1090 from unauthorized access. Thus, as trash is dumped into the baler 1091, it could be automatically activated to generate a bale that would then be wrapped and subsequently stored all within a closed compartment. When a pickup was necessary, the optional door 1098, if present, would be opened by someone authorized to haul off the bales 1095, allowing the bales 1095 to move to a pickup station where they could be moved onto a transport of some kind (e.g., a truck) and taken to, for example, a landfill, as described above in more detail with reference to FIG. 46. Since the bale densities and compaction ratios achieved by the balers described above are greater than the densities achievable by conventional compactors, fewer trips to the site would be required by the trash removal service to remove bales 1095 than would otherwise be required to remove the compacted trash coming from a conventional trash compactor.

Figure 58:
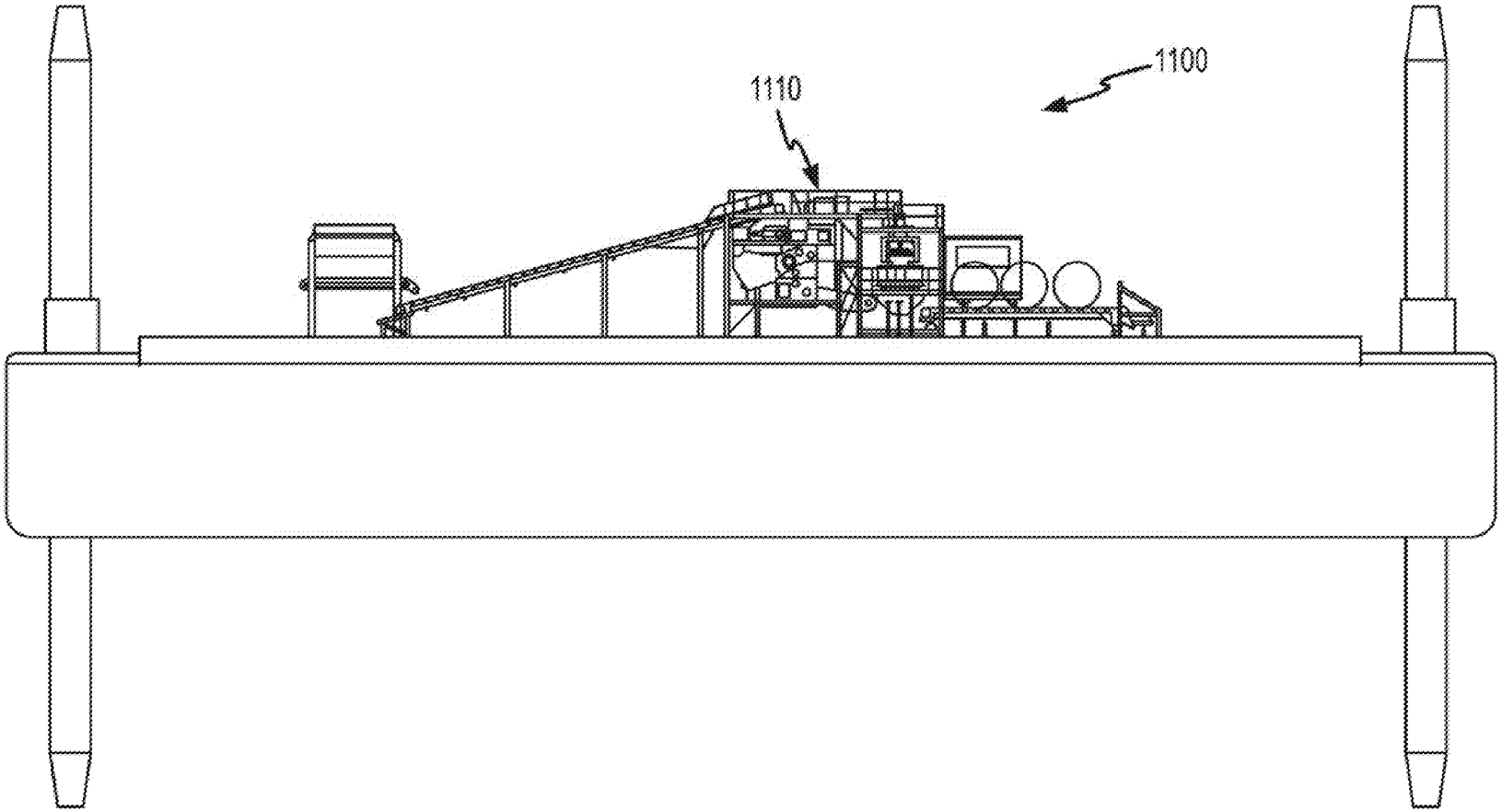
FIG. 58 is a side view of a baling system mounted on a barge, with or without spuds.

FIG. 58 shows another application for the balers described above. In particular, as shown in FIG. 58, a baling system 1100 comprising one of the balers described above can be mounted on a barge 1110, with or without spuds. By mounting the baling system 1100 on a barge 1110, it is easily relocatable whenever necessary or desirable. Also, the barge 1110 can be configured to contain any contaminates or leachate that may be produced or result from the baling process.

Although embodiments of this invention have been described above with a certain degree of particularity, those skilled in the art could make numerous alterations to the disclosed embodiments without departing from the spirit or scope of this invention. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A baler for compressing material into bales, the baler comprising a cylindrical baling chamber configured to receive the material, the baling chamber formed by a pair of end plates establishing opposite, longitudinal end faces of the baling chamber; and a driven endless belt guided by a plurality of rollers, the endless belt extending adjacent to the end plates and establishing a cylindrical outer periphery of the baling chamber, wherein the plurality of rollers includes a tilt roller pair including a distal tilt roller and a proximal tilt roller, wherein said distal tilt roller is adapted to pivot into and out of contact with said cylindrical outer periphery of the baling chamber, thereby pushing the endless belt riding against said distal tilt roller into and out of contact with the material in the baling chamber, and wherein said proximal tilt roller is adapted to remain in contact with said cylindrical outer periphery of the baling chamber; and a driven roller, where a material entry path into the baling chamber is formed between the tilt roller pair and the driven roller, wherein said material entry path is adapted to have a first width upon commencement of bale formation and a second width upon bale completion, and wherein said first width is greater than said second width.

2. The baler of claim 1, wherein each end plate of said pair of end plates comprises a belt-support lip, and wherein the endless belt further comprises an inner surface that rides against at least one of the belt-support lips.

3. The baler of claim 1, wherein each end plate of said pair of end plates comprises a lipless end plate defining an outer circumferential surface, and wherein the endless belt further comprises an inner surface and lateral edges, and wherein said belt inner surface rides against at least one of the end plates outer circumferential surfaces adjacent to at least one of the belt lateral edges.

4. The baler of claim 1, wherein the baler is adapted to form a precursor bale, wherein the baler further comprises a tailgate adapted to open to facilitate removal of the precursor bale from the baling chamber, and wherein the tilt roller pair is adapted to control movement of the precursor bale so that the precursor bale does not inadvertently roll off of the tailgate while unloading the precursor bale from the baler.

5. The baler of claim 1 further comprising a tensioner assembly operatively associated with the endless belt, the tensioner assembly being adapted to selectably adjust a length of a path followed by the endless belt and thereby adjust an amount of pressure being applied by the endless belt to the material in the baling chamber.

6. The baler of claim 1, wherein the baler is adapted to form a precursor bale, and wherein the baler further comprises a tailgate pivotably connected to a baler frame adjacent the baling chamber, the tailgate adapted to open and close to facilitate removal of the precursor bale from the baling chamber.

7. The baler of claim 6, wherein the tailgate is lowered in the range of about 10° to about 14° below a horizontal plane.

8. The baler of claim 6, wherein the tailgate further comprises a shaping plate with a contoured surface for forming a curved side wall of the precursor bale formed inside the baling chamber.

9. The baler of claim 1, wherein the baling chamber tumbles and presses the material, thereby forming a precursor bale while dispersing throughout the material any moisture contained within the material.

10. The baler of claim 1 further comprising a netting delivery system having at least one netting supply roller to dispense netting into the baling chamber for initial securement of the material.

11. The baler of claim 10, wherein the netting delivery system further comprises a smooth netting roller having longitudinal ends and being rotatably mounted adjacent to a grooved netting roller for spreading the netting toward the longitudinal ends of the smooth netting roller; and a netting pinch roller adjacent a netting driven roller and adapted to pull the netting off of the at least one netting supply roller and around both the smooth netting roller and the grooved netting roller for feeding the netting into the baling chamber.

12. The baler of claim 1 further comprising a sprayer assembly with at least one protected sprayer fluidly connected at a first end to a distribution manifold and at a second end to a sprayer nozzle, the sprayer assembly being positioned adjacent to the material entry path and being adapted to spray water or additives onto the material entering the baling chamber.

13. The baler of claim 1 further comprising a super-charging hopper for feeding the material into the baling chamber, the super-charging hopper including a vane feeder comprising a plurality of metered chambers for delivering the material in the super-charging hopper into the baling chamber.

14. The baler of claim 1, wherein each end plate of said pair of end plates comprises a belt-support lip and an annular retainment surface, wherein the endless belt further comprises an inner surface that rides against at least one of the belt-support lips, and wherein the endless belt further comprises a lateral edge that rides against one of the annular retainment surfaces.

15. The baler of claim 12, wherein said sprayer assembly further comprises a cover plate overlying said at least one protected sprayer and adapted to shield said at least one protected sprayer from material entering the cylindrical baling chamber through the material entry path.

16. The baler of claim 6 further comprising a mechanical linkage for opening and closing the tailgate, the mechanical linkage comprising an idler roller link arm adapted to move the tailgate, the idler roller link arm having first and second ends, wherein the first end of the idler roller link arm is coupled to the tailgate;

a pivot arm adapted to move the idler roller link arm, the pivot arm having first and second ends, wherein the first end of the pivot arm is hingedly attached to the second end of the idler roller link arm; and a pivot arm clamp assembly adapted to rotate around a longitudinal axis of the cylindrical baling chamber and to move the pivot arm, wherein the pivot arm clamp assembly comprises a first attachment point that is radially offset about the longitudinal axis of the cylindrical baling chamber from a second attachment point, wherein the first attachment point of the pivot arm clamp assembly is hingedly attached to the second end of the pivot arm, and wherein the second attachment point of the pivot arm clamp assembly is attached to an activation ram.

* * * * *